US007828570B2

(12) United States Patent
Suzuki et al.

(10) Patent No.: US 7,828,570 B2
(45) Date of Patent: Nov. 9, 2010

(54) CONNECTOR HAVING IMPROVED PIVOTING MEMBER DESIGN

(75) Inventors: Masayuki Suzuki, Tokyo (JP); Yuki Nakano, Tokyo (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 12/274,305

(22) Filed: Nov. 19, 2008

(65) Prior Publication Data

US 2009/0130881 A1 May 21, 2009

(30) Foreign Application Priority Data

Nov. 20, 2007 (JP) ..... 2007-300249
Nov. 20, 2007 (JP) ..... 2007-300266

(51) Int. Cl.
*H01R 13/15* (2006.01)

(52) U.S. Cl. ..... 439/260

(58) Field of Classification Search ..... 439/260, 439/261, 262, 267, 492, 494, 495, 327, 328, 439/329

See application file for complete search history.

(56) References Cited

U.S. PATENT DOCUMENTS

| | | | | |
|---|---|---|---|---|
| 7,137,838 | B2 * | 11/2006 | Koga | 439/260 |
| 7,140,896 | B2 * | 11/2006 | Takai et al. | 439/260 |
| 7,258,561 | B2 * | 8/2007 | Fukazawa | 439/260 |
| 7,275,954 | B2 * | 10/2007 | Ikenaga et al. | 439/494 |
| 7,306,478 | B2 * | 12/2007 | Kudo et al. | 439/494 |
| 7,581,973 | B2 * | 9/2009 | Fukazawa | 439/260 |
| 2006/0089036 | A1 * | 4/2006 | Takai et al. | 439/260 |
| 2007/0175741 | A1 * | 8/2007 | Fukazawa | 200/61.45 R |
| 2009/0130881 | A1 * | 5/2009 | Suzuki et al. | 439/260 |

FOREIGN PATENT DOCUMENTS

| | | | |
|---|---|---|---|
| JP | 06-060983 | U | 8/1994 |
| JP | 10-208810 | A | 8/1998 |
| JP | 11-031561 | A | 2/1999 |
| JP | 2001-307805 | A | 11/2001 |
| JP | 2002-270290 | A | 9/2002 |
| JP | 2004-071160 | A | 3/2004 |
| JP | 2006-032216 | A | 2/2006 |

* cited by examiner

*Primary Examiner*—Chandrika Prasad
(74) *Attorney, Agent, or Firm*—Sughrue Mion, PLLC

(57) ABSTRACT

A connector to be detachably fitted with a connecting object, includes a required number of contacts, a housing, and a pivoting member acting upon the contacts to bring them into contact with a connecting object. In case of having many contacts, at least one contact is provided with an extended portion at a tip of its pressure receiving portion to extend toward its connection portion, and instead of a pushing portion of the pivoting member acting upon the contact, the pivoting member is provided with an engaging rod to engage the extending portion of the contact. The contact is arranged at an optional position so as to prevent the pivoting member from being warped. The contacts are arranged in a single row, or alternately arranged to be staggered. With the connector thus constructed, the pivoting member is not damaged when pivotally moving after the connecting object has been inserted to achieve a stable electrical connection even with very small pitches of contacts and very thin walls of the housing.

20 Claims, 26 Drawing Sheets

CONNECTOR HAVING IMPROVED PIVOTING MEMBER DESIGN

BACKGROUND OF THE INVENTION

This invention relates to a connector for use in electric and electronic appliances such as mobile or cellular phones, notebook personal computers, digital cameras and the like, and more particularly to a connector with a structure superior in stable electrical connection without a pivoting member being damaged when it is being pivotally moved after a connecting object such as a flexible printed circuit board and flexible flat cable has been inserted, even if pitches of contacts become extremely smaller (miniaturization of the connector) and wall thicknesses of insulators become thinner.

As such connectors using a flexible printed circuit board or flexible flat cable, there are following types of connectors. A connector of non-zero insertion force (N-ZIF) type has contacts so arranged that gaps between contact portions of the contacts are a little less than the thickness of a flexible printed circuit board or flexible flat cable which is forced into the gaps between the contacts, thereby causing the circuit board or flat cable to be in contact with the contact portions of the contacts. A connector of zero insertion force (ZIF) type has contacts so arranged that gaps between contact portions of the contacts are larger than the thickness of a flexible printed circuit board or flat cable. After the circuit board or flat cable has been inserted in the gaps between the contacts, the contact portions of the contacts are brought into contact with the circuit board or flat cable by some means. Among connectors of the zero insertion force (ZIF) type, there are connectors of slider type, front pivoting type and rear pivoting type. A connector of slider type uses a wedge-shaped slider which is inserted into connector after a flexible printed circuit board or flat cable has been inserted to bring the contacts into contact with the circuit board or flat cable. A connector of front pivoting type has a pivoting member which is pivotally moved on the side of an inserting opening for a flexible printed circuit board or flat cable after the circuit board or flat cable has been inserted into the connector, thereby bringing contacts into contact with the circuit board or flat cable. A connector of rear pivoting type has also a pivoting member which is pivotally moved on the opposite side of an inserting opening for a flexible printed circuit board or flexible flat cable after the circuit board or flat cable has been inserted into the connector, thereby bringing contacts into contact with the circuit board or flat cable.

With connectors of these types, there are increasing demands for the zero insertion force (ZIF) type and light insertion force (LIF) type connectors which reduce the forces for inserting the circuit board or flat cable as much as possible and further demands for reduced overall height connectors and connectors having contacts arranged with extremely small pitches.

As examples of the types described above, incorporated herein are a connector of slider type of Japanese Utility Model Application Opened No. H06-60,983 (1994) (Patent Literature 1), connectors of front pivoting type of Japanese Patent Application Opened No. 2001-307,805 (Patent Literature 2) and Japanese Patent Application Opened No. 2006-032,216 (Patent Literature 3), and connectors of rear pivoting type of Japanese Patent Application Opened No. H10-208,810 (1998) (Patent Literature 4), Japanese Patent Application Opened No. H11-031,561 (1999) (Patent Literature 5), Japanese Patent Application Opened No. 2002-270,290 (Patent Literature 6) and Japanese Patent Application Opened No. 2004-071,160 (Patent Literature 7) filed by the applicant of the present case.

Patent Literature 1

According to the abstract of the Japanese Utility Model Application Opened No. H06-60,983 (1994), this utility model has an object to provide a connector having a slider for a printed circuit board for use in a small space in an electronic or communication appliance. The slider 5 of a connector is formed at ends on both sides with U-shaped arms 52 whose proximal ends are fixed to the slider as guiding means when the slider is being inserted into a housing 4. The U-shaped arms are each provided on the side of the opening 52 with a projection 56 and formed with a notch 55 so that the opening end of the U-shaped arm is visible from the inserting side. The housing is provided at both the side ends with projections 48 having an oblique surface adapted to engage the projection of the slider. When the slider together with connection terminals 31 of a flexible printed circuit board 3 is inserted into the housing, the projections 56 of the slider ride over the projections 48 having the oblique surface of the housing so that the opening ends of the U-shaped arms of the slider are temporarily spread outwardly and then returned to their normal positions when the insertion has been completed.

Incidentally, claim 1 of the Japanese Utility Model Application Opened No. H06-60,983 (1994) recites a connector having a slider for a print circuit board, comprising a housing provided with a number of contacts and with connection terminals of a flexible printed circuit board installed at the contact portion, into which contact portion a slider having a plate-shaped portion provided at its tip with a wedge-shaped portion is forcedly inserted, thereby bringing the flexible printed circuit board into contact with said contacts, wherein said slider is formed at ends on both sides with U-shaped arms whose proximal ends are fixed to the slider as guiding means when the slider is being inserted into said housing, and the U-shaped arms are each provided on their opening side with a projection and formed with a notch so that the opening end of said U-shaped arms is visible from the inserting side, and wherein said housing is provided at both the side ends with projections each having an oblique surface adapted to engage the projection of said slider, and when said slider together with connection terminals of the flexible printed circuit board is inserted into said housing, the projections of said slider engage the projections having oblique surfaces of said housing so that the opening ends of the U-shaped arms of the slider are temporarily spread outwardly and then returned to their normal positions when the insertion has been completed.

Patent Literature 2

According to the abstract of the Japanese Patent Application Opened No. 2001-307,805, this invention has an object to provide an electrical connector for a flexible substrate which is capable of reducing the overall height of the electrical connector. Disclosed is an electrical connector for a flexible substrate, including a plurality of terminals having contact portions to which the flexible substrate P is pushed by pushing portions of a pressure applying member, wherein the plurality of terminals include two kinds of terminals, that is, first terminals 10 and second terminals 20, and corresponding thereto the pressure applying member 30 comprises first guided portions 31A and second guided portions 32A pivoted and guided by upper arms 11 and 21 of the first and second terminals, and wherein when the pressure applying member is pivotally moved into a closed position, the first guided portions come into contact with lower edges of the upper arms of the first terminals and the second guided portions come into contact with upper edges of the upper arms of the second terminals.

Incidentally, claim 1 of the Japanese Patent Application Opened No. 2001-307,805 recites an electrical connector for a flexible substrate, including a housing having an opening which communicates with and opens at forward portion and upper portion adjacent thereto; a plurality of terminals having contact portions arranged in said opening or an inner portion of said opening and further having lower arms positioned on the bottom side of the housing and upper arms positioned above the lower arms, the lower and upper arms extending forwardly, and said contact portions provided on upper edges of said lower arms; and a pressure applying member provided at said opening and pivotally movable in upper position of said lower arms between its opened position and closed position, and when said pressure applying member is opened, after the flexible substrate has been inserted from the front side of the connector into said opening so that the circuit surface of said flexible substrate is arranged above the contact portions of said lower arms, the pressure applying member being pivotally moved into its closed position to cause said flexible substrate to be pushed to said contact portions by the pushing portions of said pressure applying member, wherein the plurality of terminals include two kinds of terminals, that is, first terminals and second terminals, and corresponding thereto the pressure applying member comprises first guided portions and second guided portions pivoted and guided by upper arms of the first and second terminals, and wherein when the pressure applying member is pivotally moved into a closed position, the first guided portions come into contact with lower edges of the upper arms of the first terminals and the second guided portions come into contact with upper edges of the upper arms of the second terminals. Claim 2 recites the electrical connector for a flexible substrate as claimed in claim 1, wherein the upper arms of the first terminals are flexible, and by pivotally moving the pressure applying member from its opened position to the closed position, the first guided portions cause said upper arms to be elastically deformed upwardly, and reaction force from the upper arms causes the pressure applying member to be movable downwardly. Claim 3 recites the electrical connector for a flexible substrate as claimed in claim 2, wherein the upper arms of the second terminals are flexible, and when the pressure applying member is moved downwardly, said upper arms are subjected to a force downwardly from the second guided portions of the pressure applying member to cause said upper arms to be elastically deformed, thereby pushing the flexible substrate. Claim 4 recites the electrical connector for a flexible substrate as claimed in claim 3, wherein the upper arms and lower arms of the second terminals are integrally connected at their proximal ends by jointing portions which are each provided with a removal-preventing anchoring portion extending therefrom, and said anchoring portions are anchored in anchoring holes of the housing with clearances so that when the upper arms are elastically deformed, the lower arms can partly be elastically deformed. Claim 5 recites the electrical connector for a flexible substrate as claimed in claim 1, wherein positions of the contact portions provided on the lower arms of the first and second terminals are staggered relative to each other in the inserting direction of the flexible substrate. Claim 6 recites the electrical connector for a flexible substrate as claimed in claim 1, wherein a distance from the center of pivotal movement in the normally closed position of the pressure applying member to the contact point of the first arm portion is smaller than corresponding distances when the pressure applying member is moved from the normally closed position to other positions. Claim 7 recites the electrical connector for a flexible substrate as claimed in claim 1, wherein the plurality of terminals include two kinds of first terminals and second terminals, and corresponding thereto the pressure applying member comprises first guided portions and second guided portions to be pivoted and guided by the upper arms of the first terminals and the second terminals, respectively, so that when the pressure applying member is pivotally moved toward its opened position, at least either of said first and second guided portions pushes the upper arms of the first and second terminals upwardly so as to be elastically deformed so that the minimum spacing between said upper arms and said lower arms corresponding thereto is made to be wider. Claim 8 recites an electrical connector for a flexible substrate, including a housing having an opening which communicates with and opens at forward portion and upper portion adjacent thereto; a plurality of terminals having contact portions arranged in said opening or an inner portion of said opening and further having lower arms positioned on the bottom side of the housing and upper arms positioned above the lower arms, the lower and upper arms extending forwardly, and said contact portions provided on at least edges of said upper or lower arms; and a pressure applying member provided at said opening and pivotally movable in upper position of said lower arms between its opened position and closed position, and when said pressure applying member is opened, after the flexible substrate has been inserted from the front side of the connector into said opening so that the circuit surface of said flexible substrate is arranged above the contact portions of said lower arms, the pressure applying member being pivotally moved in its closed position to cause said flexible substrate to be pushed to said contact portions by the pushing portions of said pressure applying member, wherein the upper arms and lower arms of the second terminals are integrally connected at their proximal ends by jointing portions which are each provided with a removal-preventing anchoring portion extending therefrom, and said anchoring portions are anchored in anchoring holes of the housing with clearances so that when the upper arms are elastically deformed, the lower arms can partly be elastically deformed, wherein said terminals are fixed relative to the housing on the side of free ends of the lower arms positioned in a reverse direction relative to said jointing portions. Claim 9 recites an electrical connector for a flexible substrate, including a housing having an opening which communicates with and opens at forward portion and upper portion adjacent thereto; a plurality of terminals having contact portions arranged in said opening or an inner portion of said opening and further having lower arms positioned on the bottom side of the housing and upper arms positioned above the lower arms, the lower and upper arms extending forwardly, and said contact portions provided on at least edges of said upper or lower arms; and a pressure applying member provided at said opening and pivotally movable in upper position of said lower arms between its opened position and closed position, and when said pressure applying member is opened, after the flexible substrate has been inserted from the front side of the connector into said opening so that the circuit surface of said flexible substrate is arranged opposite to said contact portions, the pressure applying member being pivotally moved into its closed position to cause said flexible substrate to be pushed to said contact portions by the pushing portions of said pressure applying member, wherein the pressure applying member comprises guided portions pivoted and guided by upper arms of the terminals, and said guided portions consist of first guided portions adapted to come into contact with lower edges of the upper arms of said terminals and second guided portions adapted to come into contact with upper edges of the upper arms of said terminals when the pressure applying member is being pivotally moved toward its closed position. Claim 10 recites an electrical connector for a flexible substrate, including a housing having an opening which communicates with and opens at forward portion and upper portion adjacent thereto; a plurality of terminals having contact portions arranged in said opening or an inner portion of said opening and further having lower arms positioned on the bottom side of the housing and upper arms positioned above the lower arms, the lower and upper arms extending forwardly, and said contact portions provided on at least edges of said upper or lower arms; and a pressure applying member provided at said opening and pivotally movable in upper position of said lower arms between its opened position and closed position, and when said pressure applying member is opened, after the flexible substrate has been inserted from the front side of the connector into said opening so that the circuit surface of said flexible substrate is arranged opposite to said contact portions, the pressure applying member being pivotally moved to cause said flexible substrate to be pushed to said contact portions by the pushing portions of said pressure applying member, wherein the pressure applying member comprises guided portions pivoted and guided by upper arms of the terminals, and said guided portions comprise guided portions adapted to come into contact with inner edges of the upper arms of said terminals when the pressure applying member is opened, and wherein the upper arms are adapted to be elastically deformed such that the spacing between the upper arms and the lower arms corresponding thereto when the pressure applying member is opened becomes larger than the spacing when the flexible substrate is not inserted and the pressure applying member is closed. Claim 11 recites the electrical connector for a flexible substrate claimed in claim 10, wherein means for elastically deforming the upper arms is cam means formed between the pressure applying member and the housing.

Patent Literature 3

According to the abstract of the Japanese Patent Application Opened No. 2006-032,216, this invention has an object to provide an electrical connector for a flexible substrate, enabling terminals to be arranged with small pitches, and the invention further has an object to provide a flexible substrate for use with the above electrical connector and a method for producing the flexible substrate. Disclosed is an electrical connector for a flexible substrate, including a plurality of terminals 1 arranged in parallel with one another and each having a support arm 3, a contact arm 4 and a fixed portion 7, extending in the substantially same direction and formed so as to maintain plate surfaces of a metal plate, the fixed portion being press-fitted in said extending direction in a holding groove of a housing, and a pressure applying member having pushing portions 23 causing the flexible substrate P to be brought into elastic contact with contact portions 4A of said contact arms 4, said support arms each formed with a supporting portion 3A for supporting said pressure applying member, wherein either of the support arm and the contact arm of each of the terminals is at least partly accommodated in an accommodating groove 13 formed in the housing 10, the groove 13 formed and opening in a direction perpendicular to said extending direction and the other being positioned outside the accommodating groove.

Incidentally, claim 1 of the Japanese Patent Application Opened No. 2006-032,216 recites an electrical connector for a flexible substrate, including a plurality of terminals arranged in parallel with one another with a predetermined interval in the direction of their thickness and each having a support arm, a contact arm and a fixed portion extending in substantially the same direction and formed so as to maintain plate surfaces of a flat metal plate, the fixed portion being press-fitted in said extending direction in a holding groove of a housing, and a pressure applying member having pushing portions for causing the flexible substrate to be brought into elastic contact with contact portions formed on said contact arms, said pressure applying member being movable between an opened position for permitting the flexible substrate to be inserted and an closed position for bringing the flexible substrate into an elastic contact position, and support arms each formed with a support portion for supporting said pressure applying member, wherein either of the support arm and the contact arm of each of the terminals is at least partly accommodated in an accommodating groove formed in the housing, the groove formed opening in a direction perpendicular to said extending direction and the other being positioned outside the accommodating groove. Claim 2 recites the electrical connector for a flexible substrate as claimed in claim 1, wherein the fixed portion of each of the terminals is a margin of a U-shaped groove formed between either of the support arm and the contact arm and a fixed arm extending in parallel therewith. Claim 3 recites the electrical connector for a flexible substrate as claimed in claim 1, wherein the fixed portion of each of the terminals is a margin of a U-shaped groove formed between the support arm and the contact arm. Claim 4 recites the electrical connector for a flexible substrate as claimed in any one of claims 1 to 3, wherein the support arm of each of the terminals is positioned outside the accommodating groove. Claim 5 recites the electrical connector for a flexible substrate as claimed in any one of claims 1 to 3, wherein the contact arm of each of the terminals is positioned outside the accommodating groove. Claim 6 recites the electrical connector as claimed in any one of claims 1 to 5, wherein the terminals on one side among the plurality of alternately positioned terminals each have the support arm, the contact arm and fixed arm, and the other terminals each have the contact portion and fixed arm, only the other terminals on the one side movably supporting the pressure applying member by the support arms, and wherein the contact portions of both the terminals are positioned outside the accommodating grooves, and the contact arms other than the contact portions are positioned in the accommodating grooves. Claim 7 recites the electrical connector as claimed in claim 1, wherein arranged in the housing are a series of the terminals movably supporting the pressure applying member with the support arms and the other series of the terminals opposite thereto, said other series of the terminals having no support arms, and the housing forms a space at location above the flexible substrate arranged on the contact arms for receiving the pressure applying member pivoted in its closed position. Claim 8 recites a flexible substrate having a plurality of lands formed and arranged in the proximity of its end, wherein the flexible substrate is formed with a reference mark at predetermined distances in the direction of arrangement of the lands and in the direction perpendicular thereto. Claim 9 recites the flexible substrate claimed in claim 8, wherein the reference mark is a cross mark having line segments extending in the direction of arrangement of the lands and in the direction perpendicular thereto and intersecting with each other. Claim 10 recites a method for producing a flexible substrate comprising steps of forming a reference mark at predetermined distances from lands in the direction of their arrangement and in the direction perpendicular thereto, and working edges of the flexible substrate in a manner that distances from the reference mark to the edges in the direction of the arrangement of the lands and in the direction perpendicular thereto become predetermined distances while image-recognizing said reference mark.

Patent Literature 4

According to the abstract of the Japanese Patent Application Opened No. H10-208,810 (1998), this invention has an object to provide a connector to be fitted with a flexible printed circuit board or flexible flat cable, which is miniaturized without degrading its operationality, and the invention has a purpose of preventing a misaligned connection and improving reliability and quality of the connector. Disclosed is a connector including contact elements which are each "H-shaped" and each comprise a rotating beam having a rotating portion whose end is circular arc-shaped provided on one of upper beams connected in the form of "T" to one end of a vertical column, a contact beam provided at a tip end of the other upper beam and having a contact portion to be connected to a flexible printed circuit board or flexible flat cable, and an SMT terminal to be connected to a pad of a substrate and arranged at one end of a lower beam of the contact element on the side of the substrate, the lower beam being arranged at location opposite to the rotating beam; a lever adapted to engage the rotating portions of the rotating beams and upon being operated to cause the rotating beams to be displaced upwardly and cause the contact beams to be displaced downwardly about columns as fulcrums according to the principle; and an insulator for accommodating the contact elements and lever.

Incidentally, claim 1 of the Japanese Patent Application Opened No. H10-208,810 (1998), a connector of slight fitting force, including a housing and a contact element, wherein said contact elements each having a column and a T-shaped portion consisting of an upper beams on said column, said upper beam having a contact beam having a contact portion on one side relative to said column and a rotating beam on the side opposite from said contact beam, and there are provided means between said rotating beam and a portion opposite to said contact beams for displacing said rotating beams to change a spacing between said contact beam and the portion opposite to said contact beam utilizing connection portions of said column and said upper beams as a fulcrum. Claim 2 as claimed in claim 1, wherein said contact elements having the T-shaped portions each have a lower beam adapted to contact said column on the side opposite from said upper beam with respect to said column and have an H-shaped portion. Claim 3 recites the connector of slight fitting force as claimed in claim 1 or 2, wherein a flexible flat cable or flexible printed circuit board is inserted between said contact beams and the portions opposite to said contact beams so as to come into contact with said contact portions. Claim 4 recites the connector of slight fitting force as claimed in any one of claims 1 to 3, wherein said means for displacing said rotating beams is a rotatable lever including recesses adapted to engage expanded portions in the form of a circular arc of said rotating beams, and said lever has rotating portions whose thicknesses are varied in the rotating direction so that when said lever is rotated, said rotating beams are displaced to vary the distance between said rotating beams and the portions opposite to said rotating beams. Claim 5 recites the connector of slight fitting force as claimed in any one of claims 1 to 3, wherein said means for displacing said rotating beams is a rotatable lever having expanded portions in the form of a circular arc adapted to engage recesses in the form of a circular arc of said rotating beams, and said lever has rotating portions whose thicknesses are varied in the rotating direction so that when said lever is rotated, said rotating beams are displaced to vary the distance between said rotating beams and the portions opposite to said rotating beams. Claim 6 recited the connector of slight fitting force as claimed in claim 4 or 5, wherein the thickness of said rotating portions of said lever varies such that when said lever is pushed downwardly toward a substrate on which the connector is mounted and said lever is rotated, the spacing between said rotating beams and the portions opposite to said rotating beams is widened. Claim 7 recites the connector of slight fitting force as claimed in any one of claims 4 to 6, wherein said rotating portions of said lever has a thicker portion in a manner such that the thickness of the thicker portion on the way of said lever being pushed downwardly and rotated becomes larger than the spacing between said rotating beams and the portions opposite thereto before and after the lever is pushed downwardly and rotated. Claim 8 recites the connector of slight fitting force as claimed in claim 1 or 2, wherein said means for displacing said rotating beams is a slide member, and said slide member or said rotating beams are provided with recesses or protrusions in a manner such that by sliding said slide member, said rotating beams are displaced. Claim 9 recites the connector of slight fitting force as claimed in claim 2, wherein said lower beams are each provided at least one side relative to said column with an SMT terminal to be connected to a substrate. Claim 10 recites the connector of slight fitting force as claimed in claim 2, wherein said lower beams are each provided at least one side relative to said column with a terminal for connecting a through-hole of a substrate. Claim 11 recites the connector of slight fitting force as claimed in claim 2, wherein said lower beams are each provided at least one side relative to said column with an anchoring portion adapted to be anchored in said housing. Claim 12 recites the connector of slight fitting force as claimed in claim 1, wherein said column is provided at its part with an anchoring portion adapted to be anchored in said housing. Claim 13 recites the connector of slight fitting force as claimed in any one of claims 1 to 12, wherein there is provided a hook pin anchored and fixed to the housing and connected to a pad of a substrate by soldering. Claim 14 recites the connector of slight fitting force as claimed in claim 13, wherein the direction of anchoring said hook pin in the housing by press-fitting is counter to the direction of anchoring said lower beams in the housing by press-fitting.

Patent Literature 5

According to the abstract of Japanese Patent Application Opened No. H11-31,561 (1999), this invention has an object to provide a connector superior in operationality and being capable of reliably connecting flat wires. Disclosed is a connector so constructed that when a pivoting member 4 provided at an opening 6 on the opposite side of an inserting opening 5 for flat wires 8 is at the starting position of the pivotal movement, the pressure-connection portions 4*b* of the pivoting member 4 do not abut against peripheries of corners 3*a*2 of contact elements 3 so that the connector is under the opened condition in which flat wires are freely inserted or removed, and by pivotally moving the pivoting member 4 the pressure-connection portions 4*b* of the pivoting member 4 press the peripheries of corners 3*a*2 of the contact elements 3 to cause them to be elastically deformed so that the contact portions 3*a*1 are pressure-connected to the flat wires 8, and at the terminal position of the pivotal movement, the pressure-connection portions 4*b* of the pivoting member 4 ride over the apexes P2 of the corners 3*a*2 of the contact elements 3 to produce forces in directions maintaining the connection state by elastic restoring force of the contact elements 3.

Incidentally, claim 1 of the Japanese Patent Application Opened No. H1-31,561(1999) recites a connector comprising a housing having an inserting opening for flat wires and an opening on the opposite side thereof, a plurality of contact elements installed in the housing, and a pivoting member pivotally movablly supported on said housing on the side of said opening, said pivoting member having pressure-connection portions which are not pressed to the contact elements to allow the flat wires to be inserted and removed into and from the inserting opening of the housing at the starting position of the pivoting member, while the pressure-connection portions are pressed against the contact elements to cause the contact elements to be elastically deformed so that contact portions of said contact elements are brought into close contact with the flat wires at the terminal position of the pivotal movement of the pivoting member. Claim 2 recites the connector as claimed in claim 1 wherein said pivoting member serves to cause said pressure-connection portions to be pressed against peripheries of corners of the contact elements, and said pivoting member is so positioned that said pressure-connection portions are on one side of a line connecting the center of pivotal movement and apexes of the corners at the starting position of the pivotal movement, on progressing of the pivotal movement said pressure-connection portions are moving over the line, and the pressure-connection portions are on the other side of the line at the terminal position of the pivotal movement. Claim 3 recites the connector as claimed in claim 2, wherein the pressure-connection portions of said pivoting member are pressed against peripheries of the corners on one ends of the contact elements so that the contact portions on the other ends of the contact elements are brought into close contact with the inserted flat wires. Claim 4 recites the connector as claimed in any one of claims 1 to 3, wherein said contact elements each having a pair of contact portions opposed to each other, and the pressure-connection portions of said pivoting member are pressed against said contact elements at the terminal position of said pivotal movement so that one of each pair of contact portions is elastically deformed onto the other side to embrace the inserted flat wires by both the contact portions.

Patent Literature 6

According to the abstract of the Japanese Patent Application Opened No. 2002-270,290, this invention has an object to provide a reduced overall height connector having an actuator which is actuated by a slight operating force and capable of enlarging moving distances of contacts to securely perform electrical connection. Disclosed is a connector comprising an actuator 30 having cam portions 31 and an actuating portion 33, between both the portions being formed with relief grooves 32 into which proximities 14*a* of tips of spring portions 14 of the contacts 10 are inserted and removed, so that when the actuator is rotated about its fulcrum 31*a* through 90° in a clockwise direction, the cam portions cause the spring portions and connecting spring portions 13 of the respective contacts to be elastically deformed to embrace a flexible printed circuit board 50 between projections 11*a* and 11*b* of the contact portions 11 and projections 12*a* and 12*b* of the contact portions 12, with the result that patterns of the flexible printed circuit board 50 are connected to a printed substrate 60 through terminals 17 of the contacts, and an insulator 20 having a ceiling portion 20 covering the contact portions 11 of the respective contacts and formed in the lower portion of the front side of the ceiling portion with a guide portion 22*a* for inserting the flexible printed circuit board into the connector.

Incidentally, claim 1 of the Japanese Patent Application Opened No. 2002-270,290 recites a connector including contacts, an insulator holding said contacts, and an actuator rotatably mounted on said insulator and enabling said contacts to be elastically deformed to bring them into contact with a connecting object, wherein said contacts each comprise a first beam having on one side a contact portion adapted to contact said connecting object and on the other side an actuated portion to be actuated by said actuator, a second beam having on one side a contact portion adapted to contact said connecting object and on the other side a terminal portion to be connected to a printed substrate, and a jointing spring portion connecting said first and second beams, and wherein said insulator includes a ceiling portion for covering at least ones of the contact portions from the fitting side and said ceiling portion is formed with a guide portion for guiding the insertion of said connecting object. Claim 2 recites the connector as claimed in claim 1, wherein at least ones of the contact portions are each provided with an inclined portion inclined toward said connecting object in the proximity of said jointing spring portion. Claim 3 recites the connector as claimed in claim 1, wherein said actuator comprises an actuating portion, cam portions for actuating said actuated portions of said contacts, and relief grooves between said actuating portion and said cam portions so that said actuated portions can be inserted into said relief grooves before the connector is connected to said connecting object. Claim 4 recites a connector including contacts, an insulator holding said contacts, and an actuator rotatably mounted on said insulator and enabling said contacts to be elastically deformed to bring them into contact with a connecting object, wherein said contacts each comprise a first beam having on one side a contact portion adapted to contact said connecting object and on the other side an actuated portion to be actuated by said actuator, a second beam having on one side a contact portion adapted to contact said connecting object and on the other side a terminal portion to be connected to a printed substrate, and a jointing spring portion connecting said first and second beams, and wherein the contact portions of said first beams each include a first protrusion and a second protrusion arranged side by side in the inserting direction of said connecting object and extending toward said connecting object, and the contact portions of said second beams each include a third protrusion and a fourth protrusion arranged side by side in the inserting direction of said connecting object and extending toward said connecting object so that said third protrusion is positioned between said first protrusion and said second protrusion or said first protrusion is positioned between said third protrusion and said fourth protrusion with the result that said first and second protrusions or said third and fourth protrusions become the contacts contacting said connecting object.

Patent Literature 7

According to the abstract of the Japanese Patent Application Opened No. 2004-71,160, this invention has an object to provide a connector being capable of securely pushing a flexible printed circuit board 40 or flexible flat cable to contact portions 22 of contacts 14 by means of a slider 16 without degrading strength of respective members and specifications or customers demands, and achieving a superior operationality, extremely smaller pitches of conductors and reduced overall height. Disclosed is a connector achieving the reduced overall height of this object comprises contacts 14 each comprising a contact portion 22, a connection portion 24, and an elastic portion 34 and a fulcrum portion 32 between the contact portion 22 and the connection portion 24, and a pressure receiving portion 20 extending from the elastic portion 34 in a position facing to the connection portion 24, and the contact portion 22, elastic portion 34, fulcrum portion 32 and connection portion 24 being arranged in the form of a crank, and a slider 16 comprising pushing portions 36 arranged continuously in the longitudinal direction and the slider 16 being pivotally mounted on a housing so that the pushing portions 36 are pivotally moved in a space between the connection portions 22 and pressure receiving portions 20 of the contacts 14.

Incidentally, claim 1 of the Japanese Patent Application Opened No. 2004-71,160 recites a connector detachably fitted with a flexible printed circuit board or flexible flat cable, including a required number of contacts each having a contact portion adapted to contact said flexible printed circuit board or flexible flat cable, a housing holding and fixing the contacts and having a fitting opening for inserting the flexible printed circuit board or flexible flat cable, and a slider for pushing the flexible printed circuit board or flexible flat cable to the contacts, wherein the contacts each comprise an elastic portion and a fulcrum portion between the contact portion and a connection portion, and a pressure receiving portion extending from the elastic portion and located in a position facing to the connection portion, and the contact portion, elastic portion, fulcrum portion and connection portion being arranged substantially in the form of a crank, and the slider is provided with pushing portions continuously arranged in its longitudinal direction and is mounted on the housing so that the pushing portions are pivotally moved in a space between the connection portions and pressure receiving portions of the contacts. Claim 2 recites a connector detachably fitted with a flexible printed circuit board or flexible flat cable, including a required number of contacts each having a contact portion adapted to contact said flexible printed circuit board or flexible flat cable, a housing holding and fixing the contacts and having a fitting opening for inserting the flexible printed circuit board or flexible flat cable, and a slider for pushing the flexible printed circuit board or flexible flat cable to the contacts, wherein two kinds of contacts are alternately arranged to be staggered, the contacts of one kind each comprising an elastic portion and a fulcrum portion between the contact portion and a connection portion, and a pressure receiving portion extending from the elastic portion in a position facing to the connection portion, and the contact portion, elastic portion, fulcrum portion and connection portion being arranged substantially in the form of a crank, and the contacts of the other kind each comprising an elastic portion and a fulcrum portion between the contact portion and a contact portion, and the contact portion, elastic portion, fulcrum portion, and connection portion being arranged substantially in the form of a U-shape, and the slider is provided with pushing portions arranged continuously in its longitudinal direction and mounted on the housing so that the pushing portions are pivotally moved in a space between the connection portions and the pressure receiving portions of the contacts of the one kind and between the pressure receiving portions of the contacts of the other kind and the housing. Claim 3 recites the connector as claimed in claim 1, wherein when the pushing portions of the slider are pivotally moved in the space between the connection portions and the pressure receiving portions of the contacts of the one kind, the pressure receiving portions are raised by the pushing portions so that the elastic portions are tilted about the fulcrum portions toward the contact portions to push the contact portions against the flexible printed circuit board or flexible flat cable. Claim 4 recites the contact as claimed in claim 1 or 2, wherein the pressure receiving portions of the contacts of the one kind or the other kind are each provided with a projection so that the pushing portions of the slider are prevented from moving toward the connection portions of the contacts of the one kind. Claim 5 recites the contact as claimed in claim 1 or 2, wherein the pushing portions of said slider are of an elongated shape. Claim 6 recites the connector as claimed in claim 5, wherein the slider is formed with a required number of anchoring holes independent from one another, which are adapted to engage the projections of the contacts, respectively. Claim 7 recites the connector as claimed in claim 5, wherein the elongated shape of said pushing portions is in the form of an ellipsoid. Claim 8 recites the connector as claimed in claim 1, wherein said contacts of the one kind are each provided with a further contact portion in the direction extending from the fulcrum portion and adapted to contact said flexible printed circuit board or flexible flat cable. Claim 9 recites the connector as claimed in claim 2, wherein said contacts of the other kind are each provided with an extension portion extending from said fulcrum in the direction opposite from the connection portion, and said slider is mounted on the housing so that the pushing portions of the slider are pivotally moved in the space between the extension portions and the pressure receiving portions. Claim 10 recites the connector as claimed in claim 2, wherein said contacts of the other kind are each further provided between the fulcrum portion and the connection portion with a contact portion adapted to contact said flexible printed circuit board or flexible flat cable.

With the slider type connector as disclosed in the Utility Model Application Opened No. H06-60,983 (1994) (Patent Literature 1), the connector is constructed in six layers (upper and lower walls of the housing, contact portions and receiving portions of the contacts, the pushing portions of the slider, and the flexible printed circuit board or flexible flat cable), so that this type of the connector is not suitable for reducing the overall height of the connector. In the slider type, moreover, if the receiving portions of contact are omitted to construct the connector in five layers (upper and lower walls of the housing, contact portions of the contacts, the pushing portions of the slider, and the flexible printed circuit board or flexible flat cable), a further reduction of the overall height of the connector would be impossible for maintaining strengths of respective parts, required specifications, and the like. Since the operations for inserting a flexible printed circuit board or flat cable into the connector and for pushing contact portions of contacts to the circuit board or flat cable are only carried out on the side of the fitting opening of the housing, its operationality would become worse, as the connector becomes smaller.

The connectors of front pivoting type have been disclosed in the Japanese Patent Application Opened No. 2001-307,805 (Patent Literature 2) and the Japanese Patent Application Opened No. 2006-032,216 (Patent Literature 3). The connectors of the front pivoting type may enable a miniaturization of connector, very narrow pitches of contacts, and space-saving in the inserting direction of the connector (achieving on the order of 3 mm). However, it would be difficult to realize a reduced overall height of the connector (limitation of the order of 1 mm), a requirement for arranging upper and lower contacts opposite to each other according to specifications and the like, stability of connection and holding force when a connecting object is accidentally forced upward, easy and reliable guidance of the connecting object, and the like.

The connectors of rear pivoting type are disclosed in the Japanese Patent Application Opened No. H10-208,810 (1998) (Patent Literature 4), the Japanese Patent Application Opened No. H11-031,561 (1999) (Patent Literature 5), the Japanese Patent Application Opened No. 2002-270,290 (Patent Literature 6), and the Japanese Patent Application Opened No. 2004-071,160 (Patent Literature 7) filed by the applicant of the present application. These connectors of rear pivoting type may have advantages enabling a miniaturization of connector, very small pitches of contacts, a reduced overall height of connector (on the order of 0.65 mm), an arrangement of upper and lower contacts opposite to each other according to specifications and the like, stability of connection and holding force when a connecting object is accidentally forced upward, easy and reliable guidance of a connecting object. However, it would be difficult to achieve space-saving in the inserting direction of the connector.

In the connectors of rear pivoting type of the Patent Literatures 4 to 6 other than the Patent Literature 7 proposed by the applicant of the present case, the pivoting member is pivotally moved about a certain fulcrum so that when pivotally moving, a great load will act on the fulcrum, with the result that there would be a tendency for the fulcrum to be damaged. As described above, further, as there is an increasing demand for very small pitches of contacts (miniaturization of connector), the pivoting member becomes thinner so that the possibility of damage at the pivotal movement further increases. In the connector disclosed in the Patent Literature 7 proposed by the applicant of the present case, although the axis of rotation moves to avoid any concentration of load, there is a risk of the fulcrum being damaged. In general, further, when a great number of contacts are used, the pivoting member tends to be deformed or warped at its center when being pivotally moved.

SUMMARY OF THE INVENTION

In view of the problems with the prior art, the invention has been completed, and the invention has an object to provide a connector whose pivoting member is not damaged when the pivoting member is pivotally moved after a flexible flat cable or printed circuit board has been inserted into the connector to achieve a stable electrical connection even if pitches of contacts of the connector become very small (miniaturization of the connector) and walls of an insulator become very thinner.

The object of the invention can be achieved by the connector 10 to be detachably fitted with a connecting object, said connector including a required number of contacts each having a contact portion adapted to contact said connecting object and a connection portion to be connected to a substrate, a housing 12 having inserting holes 44 for arranging and holding said contacts inserted in said inserting holes and a fitting opening 5 into which said connecting object is inserted, and a pivoting member 14 mounted on said housing on the opposite side of said fitting opening 5 and acting upon said contacts to bring them into contact with said connecting object, constructed according to the invention of claim 1 in that said contacts each comprise a first piece 151 having at one end said contact portion 152 and at the other end a pressure receiving portion 153, a second piece 155 having at an outer end said connection portion 156, and an elastic portion 22 and a fulcrum portion 24 positioned between said contact portion 152 and said connection portion 156 and jointing said first piece 151 and the other end of said second piece 155, and said contact portion 152, said elastic portion 22, said fulcrum portion 24 and said connection portion 156 being arranged substantially in the form of a crank, and such type of contacts are named as first contacts 15, that said pivoting member 14 is provided with anchoring grooves 28 independent from one another for receiving the pressure receiving portions 153 of said first contacts 15, respectively, and said pivoting member 14 is further provided with pushing portions 30 formed by bottoms of said anchoring grooves 28, said pushing portions 30 acting upon said pressure receiving portions 153 of said first contacts 15, respectively, when said pivoting member 14 is being pivotally moved (rotated), that when the number of said contacts is a predetermined number or less, said first contacts 15 only are installed in said housing 12, that when the number of said contacts is more than said predetermined number, one or more of said first contacts 15 are each provided with an extended portion 164 located at the tip of the pressure receiving portion 153 of said first contact 15 and extending toward said connection portion, such type of contacts being named as second contacts 16, and said pivoting member 14 is further provided with an anchoring hole or holes 32 independent from one another each for receiving the pressure receiving portion 163 of said second contact 16, and said pivoting member 14 is further provided with an engaging rod or rods 34 each engaging said extended portion 164 of said second contact 16, and that said second contact 16 is arranged instead of at least one of said first contacts 15 at an arbitrary location so as to prevent said pivoting member 14 from being warped.

The object of the invention can be achieved by the connector 11 to be detachably fitted with a connecting object, said connector including a required number of contacts each having a contact portion adapted to contact said connecting object and a connection portion to be connected to a substrate, a housing 13 having inserting holes 44 for arranging and holding said contacts inserted in said inserting holes 44 and a fitting opening 5 into which said connecting object is inserted, and a pivoting member 14 mounted on said housing 13 on the opposite side of said fitting opening 5 and acting upon said contacts to bring them into contact with said connecting object, constructed according to the invention of claim 2 in that said contacts each comprise a first piece 171 having at one end said contact portion 172 and at the other end a pressure receiving portion 173, a second piece 175 having at one end said connection portion 176, and an elastic portion 22 and a fulcrum portion 24 positioned between said contact portion 172 and said connection portion 176 and jointing said first piece 171 and the other end of said second piece 175, and said contact portion 172, said elastic portion 22, said fulcrum portion 24 and said connection portion 176 being arranged substantially in a U-shape, and such type of contacts are named as third contacts 17, that said pivoting member 14 is provided with anchoring grooves 28 independent from one another for receiving the pressure receiving portions 173 of said third contacts 17, respectively, and said pivoting member 14 is further provided with pushing portions 30 formed by bottoms of said anchoring grooves 28, said pushing portions 30 acting upon said pressure receiving portions 173 of said third contacts 17, respectively, when said pivoting member 14 is being pivotally moved (rotated), that when the number of said contacts is a predetermined number or less, said third contacts 17 only are installed in said housing 13, that when the number of said contacts is more than said predetermined number, one or more of said third contacts 17 are each provided with an extended portion 184 located at the tip of the pressure receiving portion 173 of said third contact 17 and extending toward said housing, such type of contacts being named as fourth contacts 18, and said pivoting member 14 is further provided with an anchoring hole or holes 32 independent from one another each for receiving the pressure receiving portion 183 of said fourth contact 18 and said pivoting member 14 is further provided with an engaging rod or rods 34 each engaging said extended portion 184 of said fourth contact 18, and that said fourth contact 18 is arranged instead of at least one of said third contacts 17 at an arbitrary location so as to prevent said pivoting member 14 from being warped.

The object of the invention can be achieved by the connector 10 to be detachably fitted with a connecting object, said connector including a required number of contacts each having a contact portion adapted to contact said connecting object and a connection portion to be connected to a substrate, a housing 12 having inserting holes 44 for arranging and holding said contacts inserted in said inserting holes 44 and a fitting opening 5 into which said connecting object is inserted, and a pivoting member 14 mounted on said housing 12 on the opposite side of said fitting opening 5 and acting upon said contacts to bring them into contact with said connecting object, constructed according to the invention of claim 3 in that some of said contacts each comprise a first piece 151 having at one end said contact portion 152 and at the other end a pressure receiving portion 153, a second piece 155 having at an outer end said connection portion 156, and an elastic portion 22 and a fulcrum portion 24 positioned between said contact portion 152 and said connection portion 156 and jointing said first piece 151 and the other end of said second piece 155, and said contact portion 152, said elastic portion 22, said fulcrum portion 24 and said connection portion 156 being arranged substantially in the form of a crank, and such type of contacts are named as first contacts 15, that the other contacts each comprise a first piece 171 having at one end said contact portion 172 and at the other end a pressure receiving portion 173, a second piece 172 having at one end said connection portion 176, and an elastic portion 22 and a fulcrum portion 24 positioned between said contact portion 171 and said connection portion 176 and jointing said first piece 171 and the other end of said second piece 175, and said contact portion 172, said elastic portion 22, said fulcrum portion 24 and said connection portion 176 being arranged substantially in a U-shape, and such type of contacts are named as third contacts 17, that said pivoting member 14 is provided with anchoring grooves 28 independent from one another for receiving the pressure receiving portions 153 and 173 of said first and third contacts 15 and 17, respectively, and said pivoting member 14 is further provided with pushing portions 30 formed by bottoms of said anchoring grooves 28, said pushing portions 30 acting upon said pressure receiving portions 153 and 173 of said first and third contacts 15 and 17, respectively, when said pivoting member 14 is being pivotally moved (rotated), that when the number of said contacts is a predetermined number or less, said first and third contacts 15 and 17 are installed in said housing 12 so as to be alternately arranged to be staggered, that when the number of said contacts is more than said predetermined number, one or more of either or both of said first and third contacts 15 and 17 are each provided with an extended portion 164 or 184 located at the tip of the pressure receiving portion 153 or 173 and extending toward said connection portion and said housing, such type of contacts being named as second and fourth contacts 16 and 18, respectively, and said pivoting member 14 is further provided with an anchoring hole or holes 32 independent from one another each for receiving the pressure receiving portion 163 or 183 of either or both of said second and fourth contacts 16 and 18, and said pivoting member 14 is further provided with an engaging rod or rods 34 each engaging said extended portion 164 or 184 of either or both of said second and fourth contacts 16 and 18, and that either or both of said second and fourth contacts 16 and 18 are arranged instead of at least one of either or both of said first and third contacts 15 and 17 at an arbitrary location so as to prevent said pivoting member 14 from being warped.

The invention claimed in claim 4 lies in the connector 10 or 11 constructed in that said pushing portions 30 are substantially plate-shaped, and when said pivoting member 14 is being pivotally moved, during initial stage of which said pushing portions 30 do not contact said first or third contacts 15 or 17, and in the state that the pivotal movement of said pivoting member 14 has been completed, surfaces of said pushing portions 30 cause the pressure receiving portions 153 and 173 of said first and third contacts 15 and 17 to be raised.

The invention claimed in claim 5 lies in the connector 10 or 11 constructed in that in the case that said engaging rods 34 each comprises a rod portion 36 only, a spacing between the contact portions 162 or 182 of said second or fourth contacts 16 and 18 and said housing 12 or 13 is smaller than the thickness of said connecting object.

The invention claimed in claim 6 lies in the connector 10 or 11 constructed in that said engaging rods 34 are each formed as a cam portion 38 having a substantially L-shaped cross-section including the rod portion 36, and when said pivoting member 14 is pivotally moved about the rod portions 36 of said cam portions 38 as a center of the pivotal movement, the pressure receiving portions 163 and 183 of said second and fourth contacts 16 and 18 are raised by said cam portions 38.

The invention claimed in claim 7 lies in the connector 10 or 11 constructed in that said first, second, third and fourth contacts 15, 16, 17 and 18 are each provided with an extension portion 157, 167, 177 and 187 extending from said fulcrum portion 24 to a location facing to said contact portion 152 and 162 or said pressure receiving portion 173 and 183.

The invention claimed in claim 8 lies in the connector 10 constructed in that said first and fourth contacts 15 and 18 are alternately arranged to be staggered, or said third and second contacts 17 and 16 are alternately arranged to be staggered.

The invention claimed in claim 9 lies in the connector 10 or 11 constructed in that said pressure receiving portion 153 or 173 is provided with an extended surface 154 or 174 adapted to contact a surface of said pushing portion 30 of said pivoting member 14.

As can be seen from the above description, the connector according to the invention can bring about the following significant functions and effects.

(1) A connector claimed in claim 1 is the connector 10 to be detachably fitted with a connecting object, said connector including a required number of contacts each having a contact portion adapted to contact said connecting object and a connection portion to be connected to a substrate, a housing 12 having inserting holes 44 for arranging and holding said contacts inserted in said inserting holes and a fitting opening 5 into which said connecting object is inserted, and a pivoting member 14 mounted on said housing on the opposite side of said fitting opening 5 and acting upon said contacts to bring them into contact with said connecting object, wherein said contacts each comprise a first piece 151 having at one end said contact portion 152 and at the other end a pressure receiving portion 153, a second piece 155 having at an outer end said connection portion 156, and an elastic portion 22 and a fulcrum portion 24 positioned between said contact portion 152 and said connection portion 156 and jointing said first piece 151 and the other end of said second piece 155, and said contact portion 152, said elastic portion 22, said fulcrum portion 24 and said connection portion 156 being arranged substantially in the form of a crank, and such type of contacts are named as first contacts 15, wherein said pivoting member 14 is provided with anchoring grooves 28 independent from one another for receiving the pressure receiving portions 153 of said first contacts 15, respectively, and said pivoting member 14 is further provided with pushing portions 30 formed by bottoms of said anchoring grooves 28, said pushing portions 30 acting upon said pressure receiving portions 153 of said first contacts 15, respectively, when said pivoting member 14 is being pivotally moved (rotated), wherein when the number of said contacts is a predetermined number or less, said first contacts 15 only are installed in said housing 12, wherein when the number of said contacts is more than said predetermined number, one or more of said first contacts 15 are each provided with an extended portion 164 located at the tip of the pressure receiving portion 153 of said first contact 15 and extending toward said connection portion, such type of contacts being named as second contacts 16, and said pivoting member 14 is further provided with an anchoring hole or holes 32 independent from one another each for receiving the pressure receiving portion 163 of said second contact 16, and said pivoting member 14 is further provided with an engaging rod or rods 34 each engaging said extended portion 164 of said second contact 16, and wherein said second contact 16 is arranged instead of at least one of said first contacts 15 at an arbitrary location so as to prevent said pivoting member 14 from being warped. Accordingly, after a connecting object such as a flexible printed circuit board 80 or flat cable has been inserted, when the pivoting member 14 is pivotally moved, a stable electrical connection is obtained without damaging the pivoting member 14, even if pitches of contacts of the connector become very small (miniaturization of the connector) and walls of the insulator become very thinner.

(2) A connector claimed in claim 2 is the connector 11 to be detachably fitted with a connecting object, said connector including a required number of contacts each having a contact portion adapted to contact said connecting object and a connection portion to be connected to a substrate, a housing 13 having inserting holes 44 for arranging and holding said contacts inserted in said inserting holes 44 and a fitting opening 5 into which said connecting object is inserted, and a pivoting member 14 mounted on said housing 13 on the opposite side of said fitting opening 5 and acting upon said contacts to bring them into contact with said connecting object, wherein said contacts each comprise a first piece 171 having at one end said contact portion 172 and at the other end a pressure receiving portion 173, a second piece 175 having at one end said connection portion 176, and an elastic portion 22 and a fulcrum portion 24 positioned between said contact portion 172 and said connection portion 176 and jointing said first piece 171 and the other end of said second piece 175, and said contact portion 172, said elastic portion 22, said fulcrum portion 24 and said connection portion 176 being arranged substantially in a U-shape, and such type of contacts are named as third contacts 17, wherein said pivoting member 14 is provided with anchoring grooves 28 independent from one another for receiving the pressure receiving portions 173 of said third contacts 17, respectively, and said pivoting member 14 is further provided with pushing portions 30 formed by bottoms of said anchoring grooves 28, said pushing portions 30 acting upon said pressure receiving portions 173 of said third contacts 17, respectively, when said pivoting member 14 is being pivotally moved (rotated), wherein when the number of said contacts is a predetermined number or less, said third contacts 17 only are installed in said housing 13, wherein when the number of said contacts is more than said predetermined number, one or more of said third contacts 17 are each provided with an extended portion 184 located at the tip of the pressure receiving portion 173 of said third contact 17 and extending toward said housing, such type of contacts being named as fourth contacts 18, and said pivoting member 14 is further provided with an anchoring hole or holes 32 independent from one another each for receiving the pressure receiving portion 183 of said fourth contact 18 and said pivoting member 14 is further provided with an engaging rod or rods 34 each engaging said extended portion 184 of said fourth contact 18, and wherein said fourth contact 18 is arranged instead of at least one of said third contacts 17 at an arbitrary location so as to prevent said pivoting member 14 from being warped. Therefore, after a connecting object such as a flexible printed circuit board 80 or flat cable has been inserted, when the pivoting member 14 is pivotally moved, the pivoting member 14 is never damaged to obtain a stable electrical connection, even if pitches of contacts of the connector become very small (miniaturization of the connector) and walls of the insulator become very thinner.

(3) A connector claimed in claim 3 is the connector 10 to be detachably fitted with a connecting object, said connector including a required number of contacts each having a contact portion adapted to contact said connecting object and a connection portion to be connected to a substrate, a housing 12 having inserting holes 44 for arranging and holding said contacts inserted in said inserting holes 44 and a fitting opening 5 into which said connecting object is inserted, and a pivoting member 14 mounted on said housing 12 on the opposite side of said fitting opening 5 and acting upon said contacts to bring them into contact with said connecting object, wherein some of said contacts each comprise a first piece 151 having at one end said contact portion 152 and at the other end a pressure receiving portion 153, a second piece 155 having at an outer end said connection portion 156, and an elastic portion 22 and a fulcrum portion 24 positioned between said contact portion 152 and said connection portion 156 and jointing said first piece 151 and the other end of said second piece 155, and said contact portion 152, said elastic portion 22, said fulcrum portion 24 and said connection portion 156 being arranged substantially in the form of a crank, and such type of contacts are named as first contacts 15, wherein the other contacts each comprise a first piece 171 having at one end said contact portion 172 and at the other end a pressure receiving portion 173, a second piece 172 having at one end said connection portion 176, and an elastic portion 22 and a fulcrum portion 24 positioned between said contact portion 171 and said connection portion 176 and jointing said first piece 171 and the other end of said second piece 175, and said contact portion 172, said elastic portion 22, said fulcrum portion 24 and said connection portion 176 being arranged substantially in a U-shape, and such type of contacts are named as third contacts 17, wherein said pivoting member 14 is provided with anchoring grooves 28 independent from one another for receiving the pressure receiving portions 153 and 173 of said first and third contacts 15 and 17, respectively, and said pivoting member 14 is further provided with pushing portions 30 formed by bottoms of said anchoring grooves 28, said pushing portions 30 acting upon said pressure receiving portions 153 and 173 of said first and third contacts 15 and 17, respectively, when said pivoting member 14 is being pivotally moved (rotated), wherein when the number of said contacts is a predetermined number or less, said first and third contacts 15 and 17 are installed in said housing 12 so as to be alternately arranged to be staggered, wherein when the number of said contacts is more than said predetermined number, one or more of either or both of said first and third contacts 15 and 17 are each provided with an extended portion 164 or 184 located at the tip of the pressure receiving portion 153 or 173 and extending toward said connection portion and said housing, such type of contacts being named as second and fourth contacts 16 and 18, respectively, and said pivoting member 14 is further provided with an anchoring hole or holes 32 independent from one another each for receiving the pressure receiving portion 163 or 183 of either or both of said second and fourth contacts 16 and 18, and said pivoting member 14 is further provided with an engaging rod or rods 34 each engaging said extended portion 164 or 184 of either or both of said second and fourth contacts 16 and 18, and wherein either or both of said second and fourth contacts 16 and 18 are arranged instead of at least one of either or both of said first and third contacts 15 and 17 at an arbitrary location so as to prevent said pivoting member 14 from being warped. Consequently, after a connecting object such as a flexible printed circuit board 80 or flat cable has been inserted, when the pivoting member 14 is pivotally moved, the pivoting member 14 is never damaged to obtain a stable electrical connection, even if pitches of contacts of the connector become very small (miniaturization of the connector) and walls of the insulator become very thinner. As the contacts of connector are alternately arranged to be staggered, even smaller pitches of the contacts can be achieved.

(4) According to the connector 10 or 11 claimed in claim 4, said pushing portions 30 are substantially plate-shaped, and when said pivoting member 14 is being pivotally moved, during initial stage of which said pushing portions 30 do not contact said first or third contacts 15 or 17, and in the state that the pivotal movement of said pivoting member 14 has been completed, surfaces of said pushing portions 30 cause the pressure receiving portions 153 and 173 of said first and third contacts 15 and 17 to be raised. Therefore, the pivoting member 14 is never damaged to obtain a stable electrical connection when the pivoting member 14 is pivotally moved.

(5) According to the connector 10 or 11 claimed in claim 5, in the case that said engaging rods 34 each comprises a rod portion 36 only, a spacing between the contact portions 162 or 182 of said second or fourth contacts 16 and 18 and said housing 12 or 13 is smaller than the thickness of said connecting object. Accordingly, the pivoting member 14 is never damaged to obtain a stable electrical connection when the pivoting member 14 is pivotally moved.

(6) According to the connector 10 or 11 claimed in claim 6, said engaging rods 34 are each formed as a cam portion 38 having a substantially L-shaped cross-section including the rod portion 36, and when said pivoting member 14 is pivotally moved about the rod portions 36 of said cam portions 38 as a center of the pivotal movement, the pressure receiving portions 163 and 183 of said second and fourth contacts 16 and 18 are raised by said cam portions 38. Consequently, when the pivoting member 14 is pivotally moved, the pivoting member 14 is never damaged to obtain a stable electrical connection, and a zero insertion force (ZIF) type connector can be realized for all kinds of contacts.

(7) According to the connector 10 or 11 claimed in claim 7, said first, second, third and fourth contacts 15, 16, 17 and 18 are each provided with an extension portion 157, 167, 177 and 187 extending from said fulcrum portion 24 to a location facing to said contact portion 152 and 162 or said pressure receiving portion 173 and 183. Therefore, the pivoting member 14 is never damaged to obtain a stable electrical connection when the pivoting member 14 is pivotally moved.

(8) According to the connector 10 claimed in claim 8, said first and fourth contacts 15 and 18 are alternately arranged to be staggered, or said third and second contacts 17 and 16 are alternately arranged to be staggered. Therefore, after a connecting object such as a flexible printed circuit board 80 or flat cable has been inserted, when the pivoting member 14 is pivotally moved, the pivoting member 14 is never damaged to obtain a stable electrical connection, even if pitches of contacts of the connector become very small (miniaturization of the connector) and walls of the insulator become very thinner. As the contacts are alternately arranged to be staggered, even smaller pitches of the contacts can be achieved, and the connector according to the invention is advantageous for cost of dies and management cost.

(9) According to the connector 10 or 11 claimed in claim 9, said pressure receiving portion 153 or 173 is provided with an extended surface 154 or 174 adapted to contact a surface of said pushing portion 30 of said pivoting member 14. Accordingly, when the pivoting member 14 is pivotally moved, the pivoting member 14 is never damaged to obtain a stable electrical connection.

While the invention has been particularly shown and described with reference to the preferred embodiments thereof, it will be understood by those skilled in the art that the foregoing and other changes in form and details can be made therein without departing from the spirit and scope of the invention.

DESCRIPTION OF THE PREFERRED EMBODIMENTS

Figure 1A:
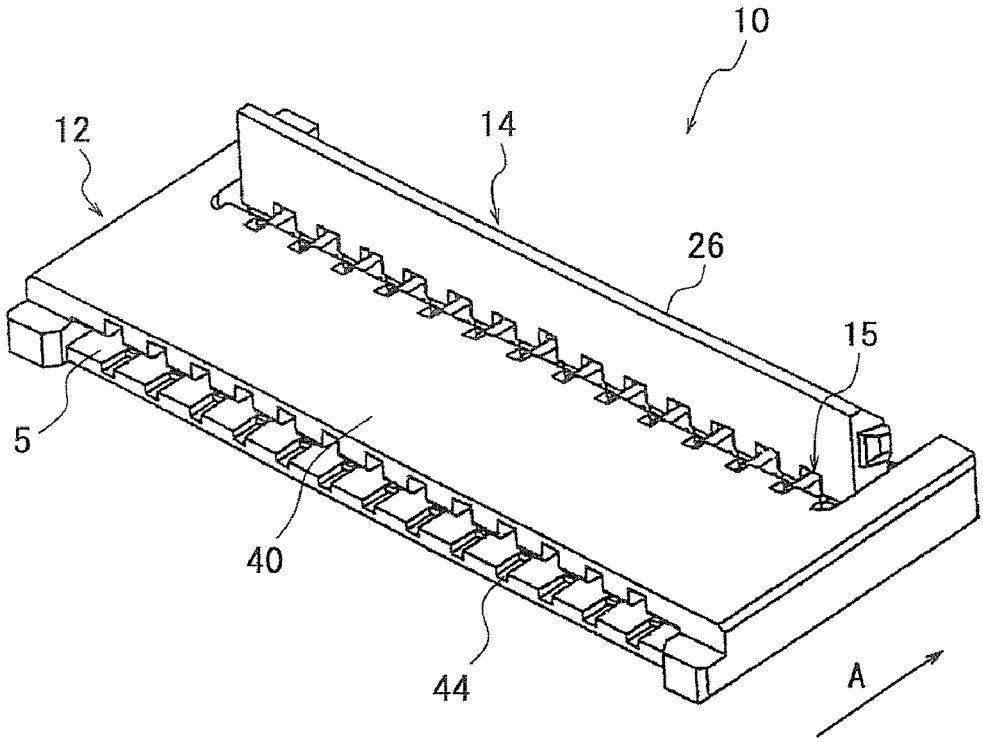
FIG. 1A is a perspective view of the connector according to the invention viewed from the above on the side of the fitting opening for a flexible printed circuit board.

Forming an important aspect of the invention is a construction of pushing portions 30 of a pivoting member 14 configured in a manner that bottoms of anchoring grooves 28 of the pivoting member 14 are adapted to act on pressure receiving portions 153 and 173 of first and third contacts 15 and 17 when the pivoting member 14 is pivotally moved (rotated) in order to prevent the pivoting member 14 from being damaged due to loading upon pivoting. In case of a great number of contacts, the center portion of the pivoting member may be likely to be deformed owing to the load upon pivoting. In order to overcome this problem, according to the invention at optional positions there are provided contacts each having an extended portion at the outer end of the pressure receiving portion, and the pivoting member is provided with engaging rods 34 instead of the pushing portions 30 at locations corresponding to those of the extended portions of the contacts so as to engage the extended portions.

In other words, according to the number of contacts pushing portions 30 of the pivoting member 14 are formed substantially in the form of a plate so that when the pivoting member 14 is being pivotally moved, during an initial stage of which the pushing portions 30 do not contact the contacts, but in the state that the pivoting movement has been completed the pushing portions 30 push the pressure receiving portions of the contacts upwardly. On the other hand, contacts are optionally arranged each having an extended portion at the tip of its pressure receiving portion, and the pivoting member is provided with an engaging rod or rods 34 instead of the pushing portions 30, which engage the extended portions of the contact.

The words "optionally arranged" are here understood as signifying that the contacts each having the extended portion provided at the tip of the pressure receiving portion are arranged at locations and the pivoting member is provided with the engaging rods 34 adapted to engage the extended portions, instead of the pushing portions 30, for preventing the pivoting member from being deformed at its center due to the load upon being pivotally moved.

A connector whose contacts are arranged in a single row will be explained. The words "arranged in a single row" means that all the connection portions of the contacts are arranged on one side of the connector, i.e. on the side of the fitting opening or on the opposite side of the fitting opening of the connector.

Figure 1B:
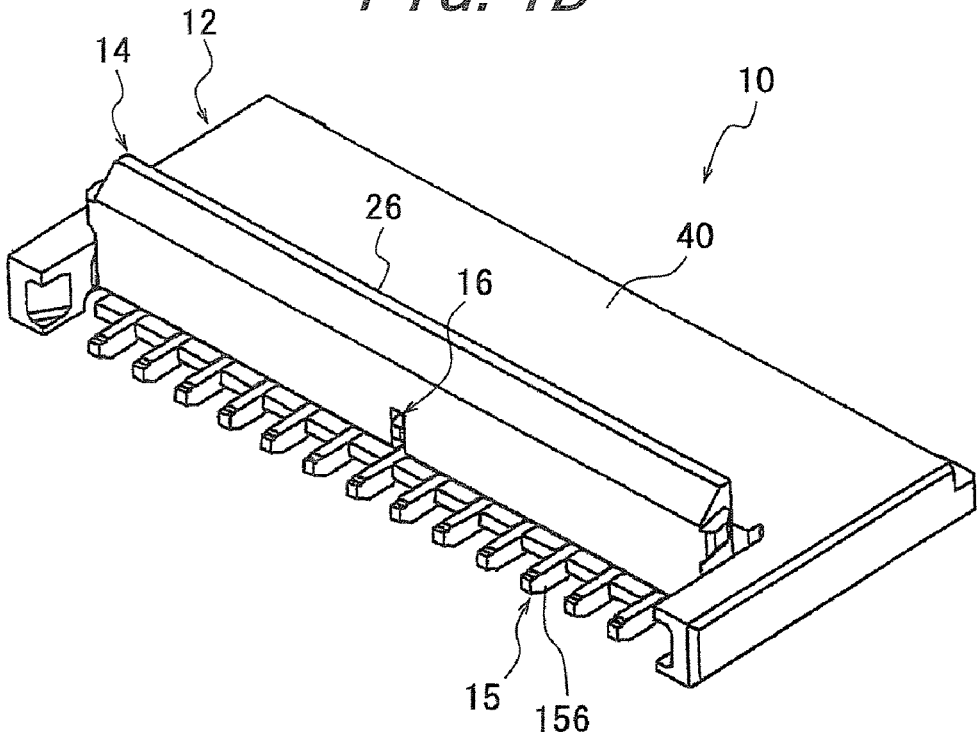
FIG. 1B is a perspective view of the connector viewed from the below on the opposite side of the fitting opening.
Figure 2A:
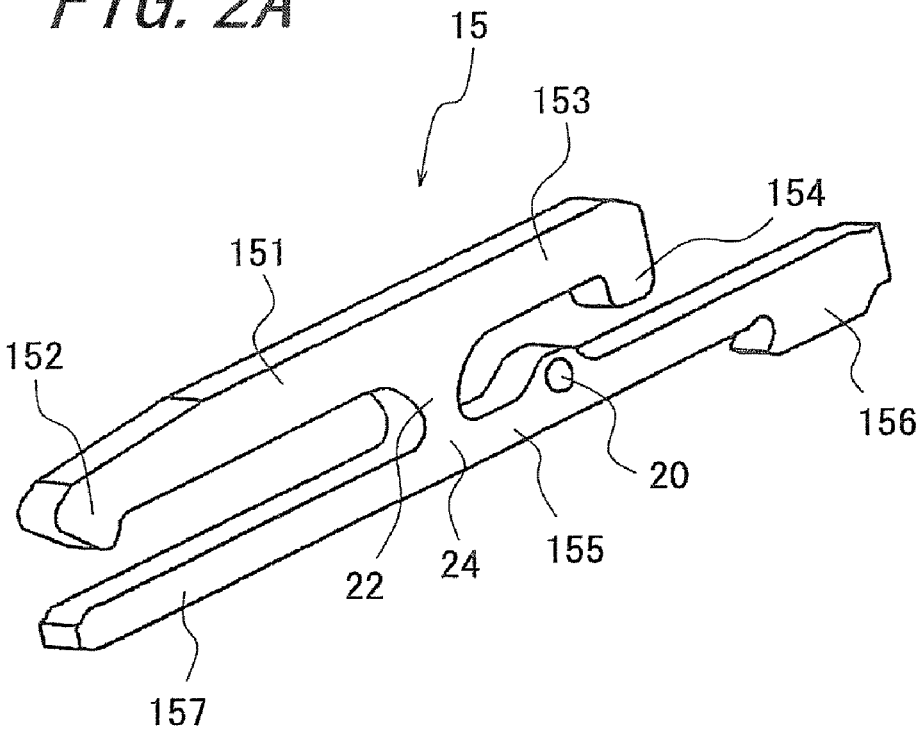
FIG. 2A is a perspective view of a first contact.
Figure 2B:
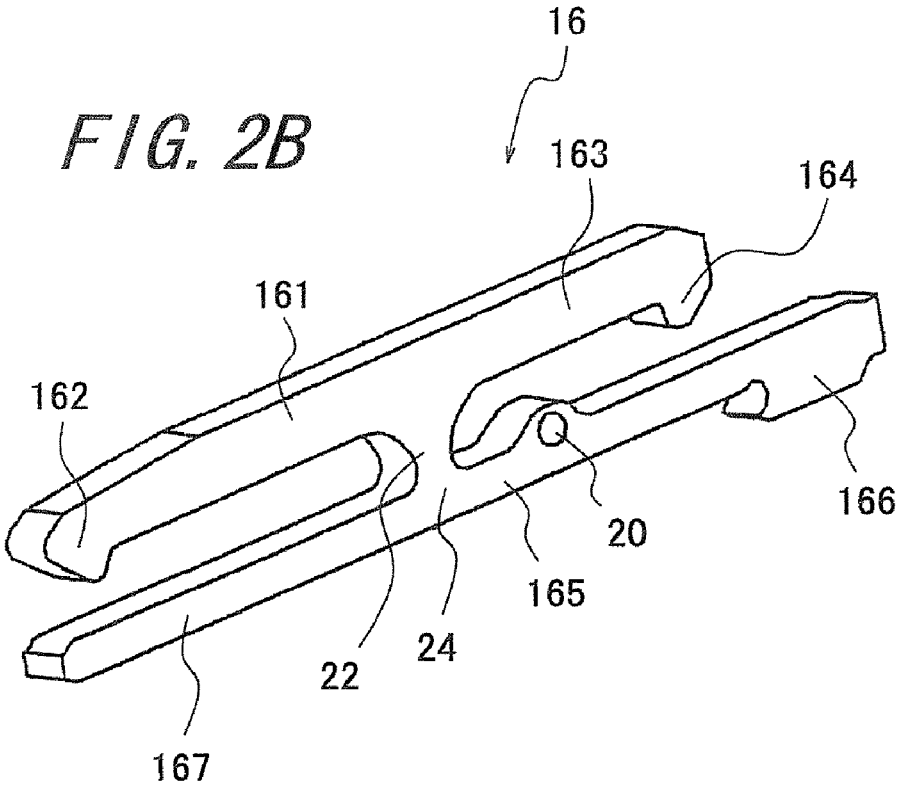
FIG. 2B is a perspective view of a second contact.
Figure 3A:
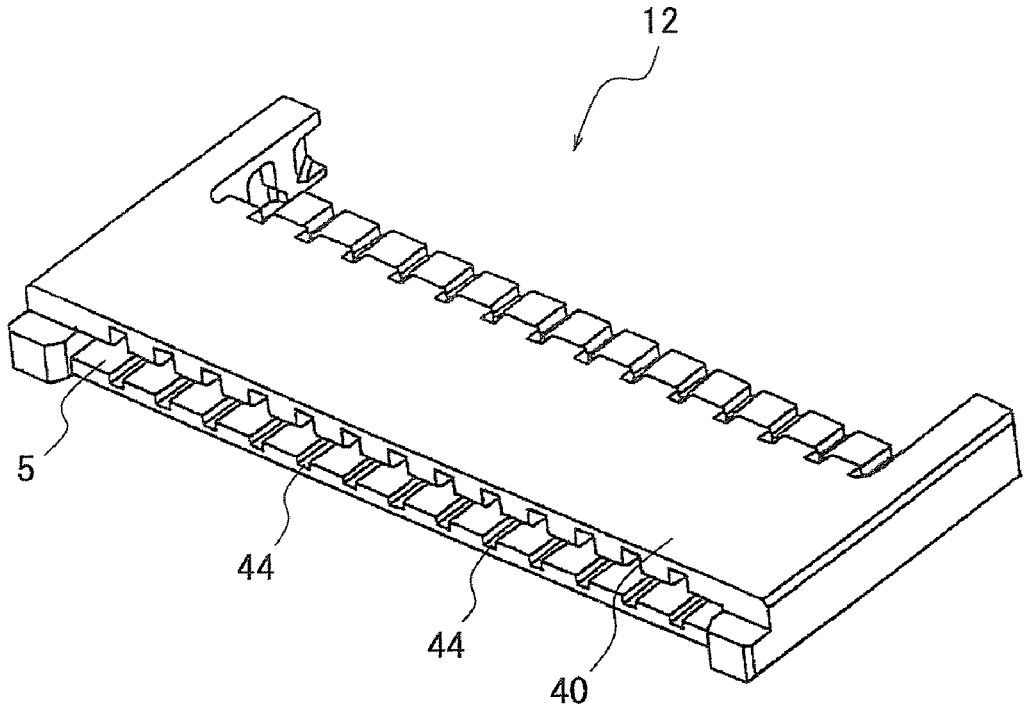
FIG. 3A is a perspective view of a housing viewed from the above on the side of the fitting opening.
Figure 3B:
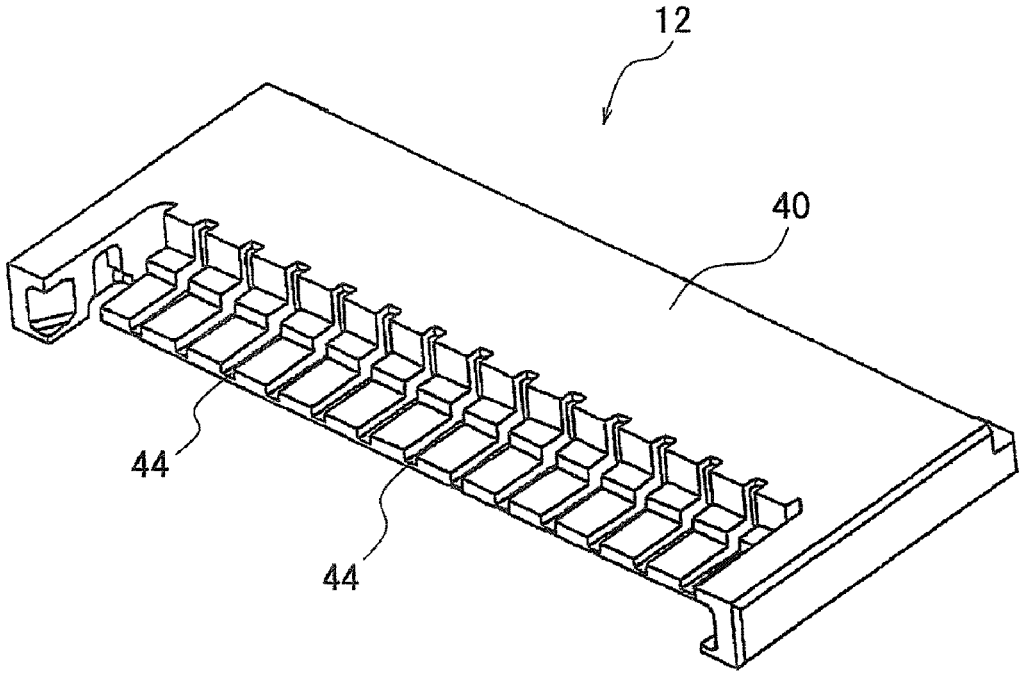
FIG. 3B is a perspective view of the housing viewed from the below on the opposite side of the fitting opening.
Figure 4:
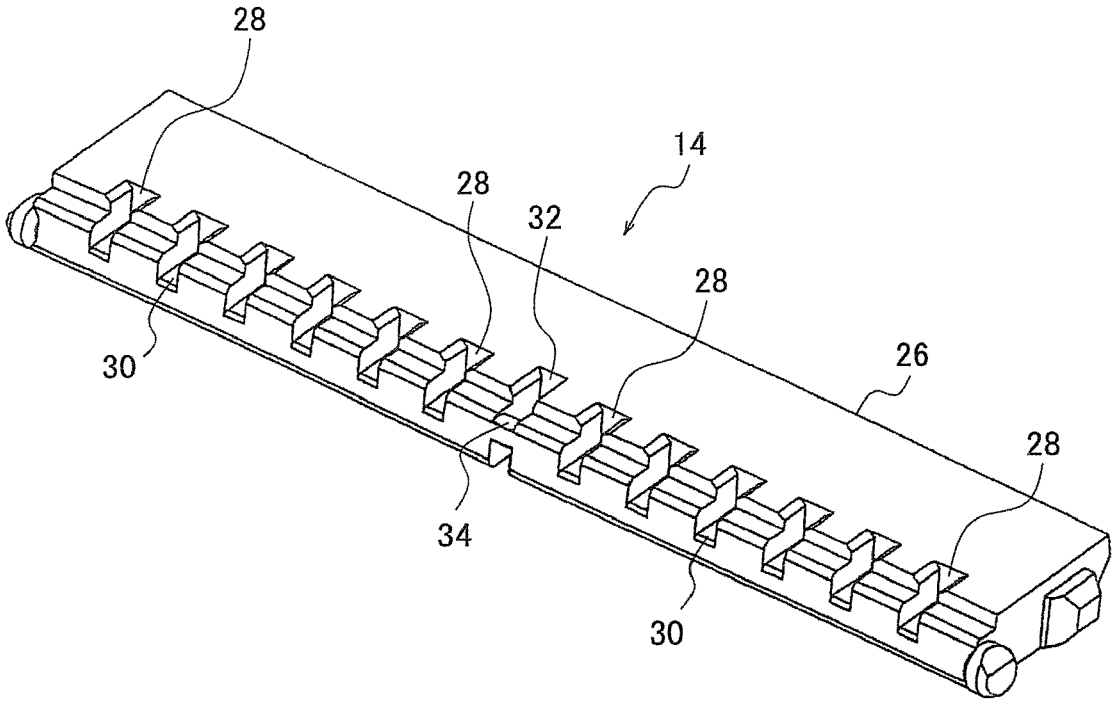
FIG. 4 is a perspective view of a pivoting member.
Figure 5A:
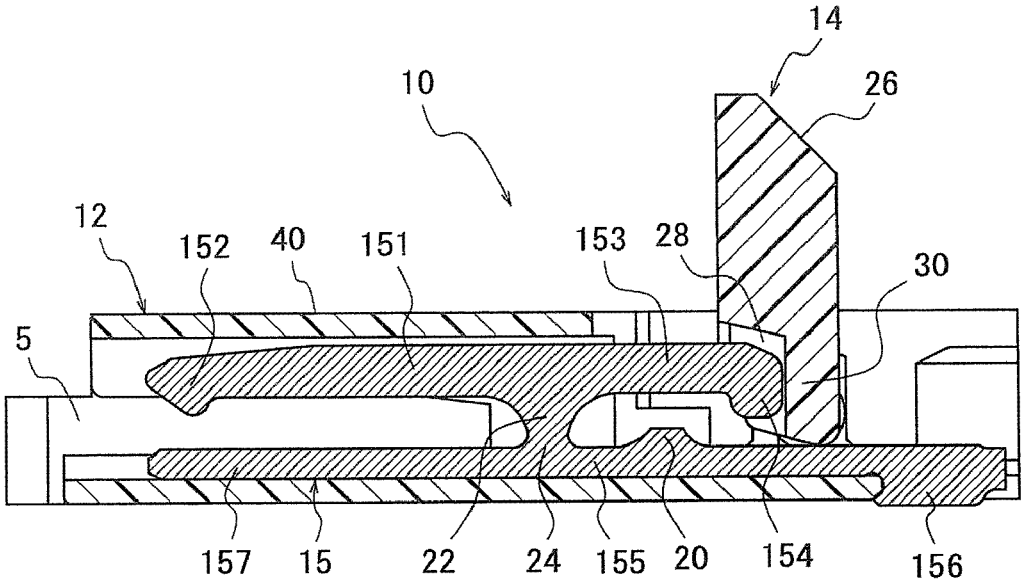
FIG. 5A is a sectional view of the connector with the pivoting member opened, taken along the first contact.
Figure 5B:
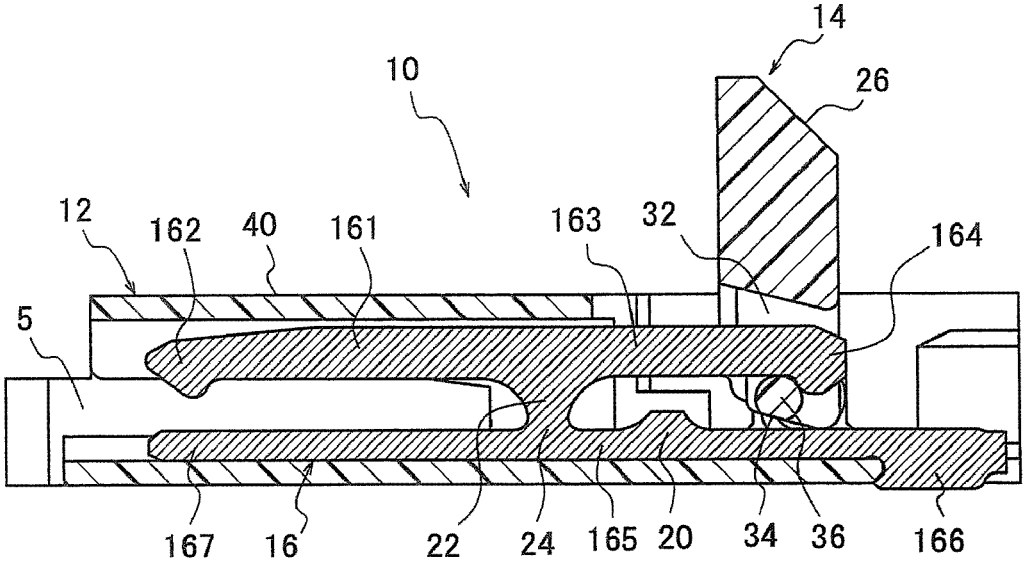
FIG. 5B is a sectional view of the connector with the pivoting member opened, taken along the second contact.
Figure 6A:
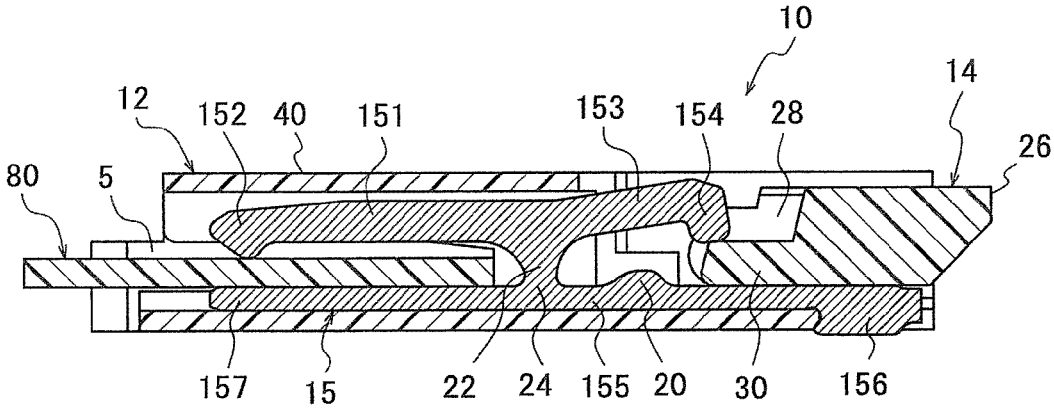
FIG. 6A is a sectional view of the connector with the flexible printed circuit board inserted and with the pivoting member closed, taken along the first contact.
Figure 6B:
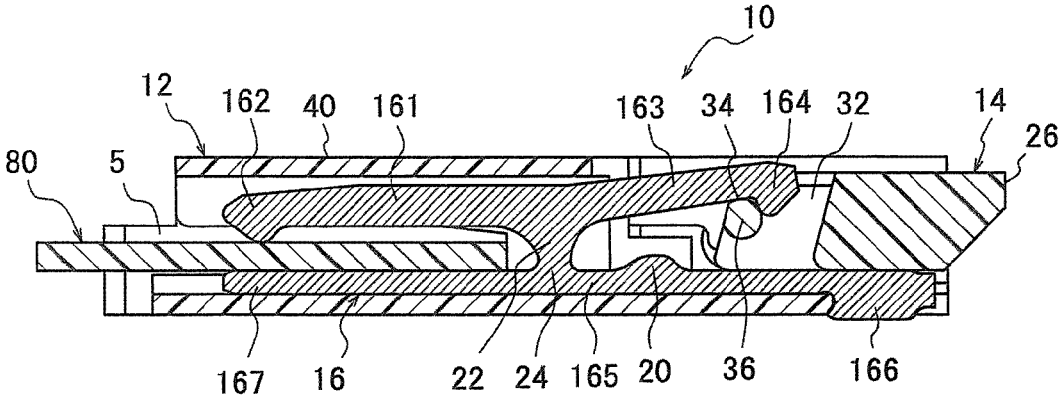
FIG. 6B is a sectional view of the connector with the flexible printed circuit board inserted and with the pivoting member closed, taken along the second contact.

Initially, one embodiment of the connector 10 according to the invention will be explained with reference to FIGS. 1A to 6B. FIG. 1A is a perspective view of the connector according to the invention viewed from the above on the side of the fitting opening for a flexible printed circuit board, and FIG. 1B is a perspective view of the connector viewed from the below on the opposite side of the fitting opening. FIG. 2A is a perspective view of a first contact, while FIG. 2B is a perspective view of a second contact. FIGS. 3A and 3B are perspective views of a housing, and FIG. 4 is a perspective view of a pivoting member. FIG. 5A is a sectional view of the connector with the pivoting member opened, taken along the first contact, while FIG. 5B is a sectional view of the connector with the pivoting member opened, taken along the second contact. FIG. 6A is a sectional view of the connector with the flexible printed circuit board inserted and with the pivoting member closed, taken along the first contact, and FIG. 6B is a sectional view of the connector with the flexible printed circuit board inserted and with the pivoting member closed, taken along the second contact.

The connector 10 according to the invention mainly comprises a housing 12, two kinds of contacts (first and second contacts 15 and 16), and a pivoting member 14.

Components of the connector 10 according to the invention will be explained with reference to the drawings. First, the two kinds of the contacts will be explained. The first and second contacts 15 and 16 of the two kinds are both made of a metal and formed by means of the press-working of the known technique. Preferred metals from which to form first and second contacts 15 and 16 of the two kinds include brass, beryllium copper, phosphor bronze and the like which comply with the requirements as to springiness, electric conductivity, and the like. In the illustrated embodiment, the two kinds of the contacts (first and second contacts 15 and 16) are inserted into inserting holes 44 of the housing 12 from the side opposite from the fitting opening 5 of the housing.

Said first contact 15 comprises at least a first piece 151 having at one end a contact portion 152 and at the other end a pressure receiving portion 153, a second piece 155 having at its outer end a connection portion 156, and an elastic jointing portion (consisting of a fulcrum portion 24 and an elastic portion 22) for connecting or jointing the first piece 151 and the other end of said second piece 155. Said elastic jointing portion can be divided into the fulcrum portion 24 and the elastic portion 22 in the illustrated embodiment. In other words, said first contact 15 is substantially h-shaped and comprises the first piece 151 having at one end the contact portion 152 adapted to contact a flexible printed circuit board 80 (not shown in FIG. 2A) and at the other end the pressure receiving portion 153 to be pushed by said pivoting member 14, the second piece 155 having at one end the fulcrum portion 24 and at the other end the connection portion 156 to be connected to a substrate, and the elastic portion 22 for jointing the substantially middle portion of the first piece 151 and the fulcrum portion 24 of the second piece 155 (said elastic jointing portion consisting of the fulcrum portion 24 and the elastic portion 22), and further may comprises a fixed portion 20 on the second piece 155 in the proximity of the elastic jointing portion. The contact portion 152 of said first piece 151, the elastic portion 22, the fulcrum portion 24 and the connection portion 156 are arranged substantially in the form of a crank.

In the illustrated embodiment, the first contact 15 is further provided with an extension portion 157 extending from said fulcrum portion 24 in the direction opposite from said connection portion 156 (toward the fitting opening 5) so that the first contact 15 is substantially H-shaped as shown in FIG. 2A.

Said fixed portion 20 is provided on said second piece 155 in the proximity of the elastic jointing portion. The position and size of said fixed portion 20 may be suitably designed in consideration of the holding force for the first contact 15, the rising of the contact, stability of connectivity, and the like.

Said contact portion 152 is in the form of a protrusion for the purpose of facilitating the contact with the flexible printed circuit board 80. The connection portion 156 is of a surface mounting type (SMT) in the illustrated embodiment as shown in FIG. 1B. It may be of a dip type.

Said fulcrum portion 24, said elastic portion 22, and said pressure receiving portion 153 function as the following description when said flexible printed circuit board 80 has been inserted into the connector 10. When the pivoting member 14 is being pivotally moved after the flexible printed circuit board 80 has been inserted into the connector 10, the pushing portions 30 of said pivoting member 14 enter the spaces between the connection portions 156 and the pressure receiving portions 153 of said first contacts 15, and are pivotally moved in the spaces, with the result that said pressure receiving portions 153 are raised upwardly. Therefore, the elastic portions 22 of said first contacts 15 are tilted toward said contact portions 152 about the fulcrum portions 24 of the first contacts 15 by the upward movement of the pressure receiving portions 153, so that the contact portions 152 are pushed to said flexible printed circuit board 80. The sizes and shapes of said fulcrum portions 24, said elastic portions 22, and said pressure receiving portions 153 may be suitably designed so as to achieve these functions.

It is preferable to provide an extended surface 154 on the pressure receiving portion 153 of said first contact 15 so as to extend toward said connection portion 156 for facilitating the occurrence of the above functions. The pushing portions 30 of said pivoting member 14 come into surface contact with said extended surfaces 154 of said first contacts 15 to ensure the above functions and stable electrical connection. The size and shape of said extended surfaces may be suitably designed to achieve the above functions.

The second contact 16 will then be explained with reference to FIG. 2B. A remarkable difference of the second contact 16 from the first contact 15 is in an extended portion 164 provided at the tip of the pressure receiving portion 163 of said second contact 16. The extended portion 164 of the second contact 16 engages an engaging rod 34 of the pivoting member 14 later described to obtain its assured pivotal (rotational) movement and to prevent the center portion of said pivoting member 14 from being deformed in a direction shown by an arrow A in FIG. 1A caused by the load (reaction force against the pivotal movement) acting upon the pivoting member 14 when it is being pivoted. The size of said extended portion 164 may be any one so long as it achieves such functions, and may be suitably designed such that the engaging rod 34 of said pivoting member 14 engages the extended portion 164 to achieve a stable pivotal (rotational) movement. The shape of said second contact 16 may be substantially h-shaped or H-shaped similarly to the first contact 15.

Said second contact 16 comprises at least a first piece 161 having at one end a contact portion 162 and at the other end a pressure receiving portion 163, a second piece 165 having at an outer end a connection portion 166, and an elastic jointing portion (consisting of a fulcrum portion 24 and an elastic portion 22) for connecting or jointing said first piece 161 and the other end of said second piece 165. Said elastic jointing portion can be divided into the fulcrum portion 24 and the elastic portion 22 in the illustrated embodiment. In other words, said second contact 16 is substantially h-shaped and comprises the first piece 161 having at one end the contact portion 162 adapted to contact the flexible printed circuit board 80 (not shown in FIG. 2B) and at the other end the pressure receiving portion 163 to be pushed by said pivoting member 14, the second piece 165 having at one end the fulcrum portion 24 and at the other end the connection portion 166 to be connected to the substrate, and the elastic portion 22 (said fulcrum portion 24 and said elastic portion 22 form the elastic jointing portion) for jointing the substantially middle portion of said first piece 161 and said fulcrum portion 24 of said second piece 165, and further may comprises a fixed portion 20 on said second piece 165 in the proximity of the elastic jointing portion. Said contact portion 162 of said first piece 161, said elastic portion 22, said fulcrum portion 24, and said connection portion 166 are arranged substantially in the form of a crank.

In the illustrated embodiment, said second contact 16 is provided with an extension portion 167 extending from said fulcrum portion 24 in the direction opposite from said connection portion 166 (toward the fitting opening 5) so that the second contact 16 is substantially H-shaped as shown in FIG. 2B.

As described above, said fixed portion 20 is provided on said second piece 165 in the proximity of its elastic jointing portion. The position and size of said fixed portion 20 may be designed taking into account the holding force for the second contact 16, the rising of the contact, stability of connectivity, and the like.

Said contact portion 162 is in the form of a protrusion in order to facilitate the contact with said flexible printed circuit board 80. Although said connection portion 166 is of a surface mounting type (SMT) as shown in FIG. 1B, it may be of a dip type.

In the illustrated embodiment, as shown in FIGS. 5B and 6B, when said engaging rod 34 of said pivoting member 14 is formed by merely a rod portion 36, said pressure receiving portion 163 only serves as a bearing, and said fulcrum portion 24 and said elastic portion 22 only serve to joint the first piece 161 and the second piece 165 of said second contact 16. In such a case, a space between the contact portion 162 and the extension portion 167 of said second contact 16 (the housing 12 in case of being free from the extension portion 167) is designed to be smaller than the thickness of the flexible printed circuit board 80 to be inserted into the space (a so-called non-zero insertion force (N-ZIF) structure), thereby achieving a stable connection of the connector and the flexible printed circuit board inserted therein.

In the case that said engaging rod 34 of said pivoting member 14 is formed as a cam portion 38 which includes the rod portion 36 and has a substantially L-shaped cross-section (although not shown in FIGS. 1A to 6B), said fulcrum portion 24, said elastic portion 22, and said pressure receiving portion 163 perform the following functions when the flexible printed circuit board 80 has been inserted into the connector 10. After the flexible printed circuit board 80 has been inserted into the fitting opening 5 of said housing 12, when the cam portion 38 of said pivoting member 14 is pivotally moved between the connection portion 166 and the pressure receiving portion 163 of said second contact 16, said pressure receiving portion 163 is raised upwardly by the cam portion 38 so that the elastic portion 22 of said second contact 16 is tilted toward said contact portion 162 about the fulcrum portion 24 of said second contact 16, thereby pushing said contact portion 162 to said flexible printed circuit board 80. The sizes and shapes of said fulcrum portion 24, said elastic portion 22, and said pressure receiving portion 163 may be suitably designed so as to achieve such a function.

The pivoting member 14 will then be explained. The pivoting member 14 is formed from an electrically insulating plastic material by means of the injection molding of the known technique. The materials for the pivoting member 14 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC), polyphenylene sulfide (PPS), and the like, and synthetic materials thereof. Said pivoting member 14 mainly comprises an actuating portion 26, axles to be fitted in the housing 12 for pivotally moving the pivoting member relative to the housing 12, anchoring grooves 28 for receiving the pressure receiving portions 153 of said first contacts 15, pushing portions 30 for pushing the pressure receiving portions 153, an anchoring hole or holes 32 for receiving the pressure receiving portions 163 of said second contacts 16, and an engaging rod or rods 34 adapted to engage the extended portions 164. Said axles are fulcrums for pivotally moving the pivoting member 14 and suitably fitted in both the longitudinal ends of the housing 12 so as to permit the pivoting member 14 to be pivotally moved.

According to the invention, made to be different from each other are shapes of the portions (the pushing portions 30, the engaging rod or rods 34, and the like) of said pivoting member 14 with which the pressure receiving portions 153 and 163 of said first and second contacts 15 and 16 are engaged, respectively. In other words, in order to prevent said pivoting member 14 from being deformed (warped) in the direction shown by the arrow A in FIG. 1A due to the load (reaction against the pivotal movement) when the pivoting member 14 is being pivotally moved (rotated), said second contact or contacts 16 are arranged at optional locations instead of the first contacts 15.

Regarding the portions (the pushing portions 30) of said pivoting member 14 cooperating with said first contacts 15 and said anchoring grooves 28 whose bottom surfaces are formed substantially in the form of a plate, when said pivoting member 14 is pivotally moved (rotated), during the initial stage of the pivotal movement, the pushing portions 30 do not contact said first contacts 15 and in the state that the pivotal movement has been completed, the extended surfaces 154 of the pressure receiving portions 153 of said first contacts 15 are raised upwardly by the surfaces of said pushing portions 30, that is, the pushing portions 30 are exerted on said first contacts 15 as described above, thereby bringing the contact portions 152 of said first contacts 15 into contact with the inserted flexible printed circuit board 80. Preferably, the shape of said pushing portions 30 is substantially in the form of a plate. With such plate-shaped pushing portions 30, the extended surfaces 154 of said first contacts 15 can be raised upwardly by the surfaces of said pushing portions 30 (the bottom surfaces of the anchoring grooves 28) when the pivoting member 14 is inserted and pivotally moved. By causing the surfaces to contact each other, the extended surfaces 154 can be securely raised and at the same time the load acting upon the pivoting member 14 when pivotally moving can be reduced.

The size of said pushing portions 30 is determined so as to be larger than the distance between the extended surface 154 and the connection portion 156 of said first contact 15 so that the functions described above can be achieved. The pushing portions 30 may be suitably designed in consideration of the elasticity of the contacts, contact pressure, strength, and the like.

Said engaging grooves 28 are blind holes (grooves) and are independent from one another in order to maintain the strength of said pivoting member 14 and to avoid the pivoting member 14 from being damaged when it is pivotally moving. The depth of said engaging grooves 28 may be suitably designed so as to achieve the functions described above taking into account the relation to the thickness of said pushing portions 30, the elasticity of the contacts, contact pressure, strength and the like.

Figure 14A:
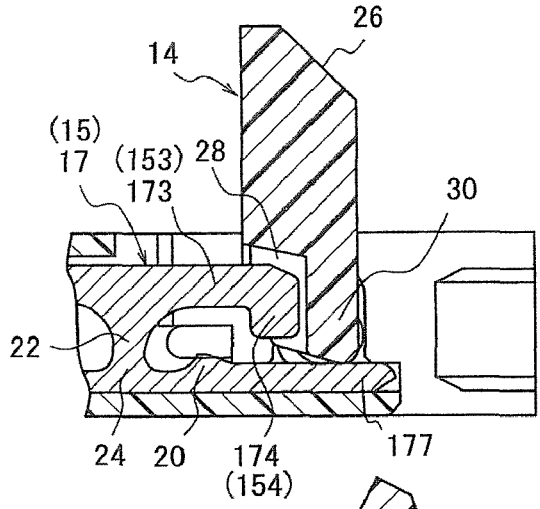
FIG. 14A is a view for explaining the insertion and pivoting movement of a pushing portion of the pivoting member acting on the third contact.
Figure 14B:
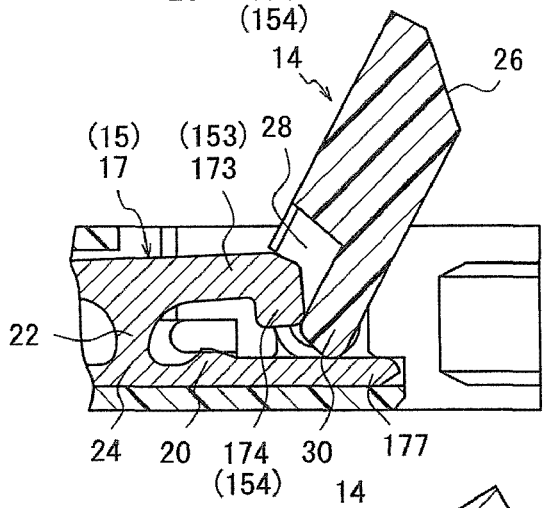
FIG. 14B is a view illustrating the state that the pivoting member has been pivoted by some degrees.
Figure 14C:
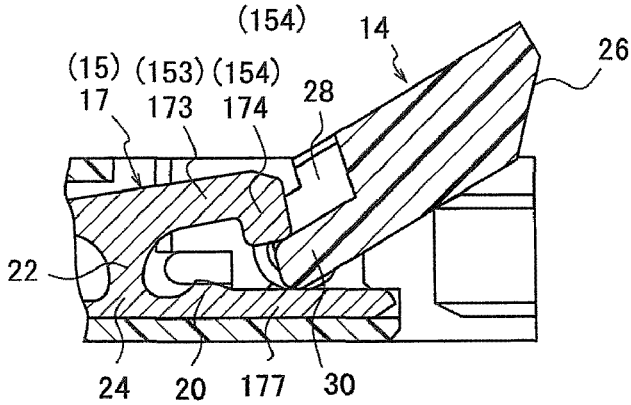
FIG. 14C is a view illustrating the state that the pivoting member has been pivoted further.
Figure 14D:
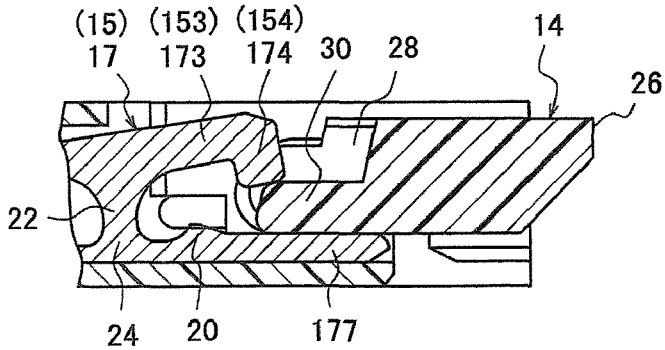
FIG. 14D is a view illustrating the state that the pivoting member has been pivoted in its closed position.

Insertion and pivotal movement of the pushing portions 30 will be explained herein with reference to FIGS. 14A to 14D. First, when the flexible printed circuit board 80 is not inserted into the connector 10, the pivoting member 14 stands substantially upright as shown in FIG. 14A. Then, the flexible printed circuit board 80 is inserted and the pivoting member 14 is started to be pivotally moved, during initial stage of which the pushing portion 30 does not contact the extended surface 154 of the first contact 15 as shown in FIG. 14B. When the pivoting member 14 is further pivotally moved, the tip of said pushing portion 30 comes into line contact with the extended surface 154 as shown in FIG. 14C. Upon further pivotal movement, the pivoting member 14 becomes substantially parallel to the housing 12 and said pushing portion 30 comes into surface contact with the extended surface 154 to cause the extended surface 154 to be raised by said pushing portion 30 as shown in FIG. 14D.

Figure 15A:
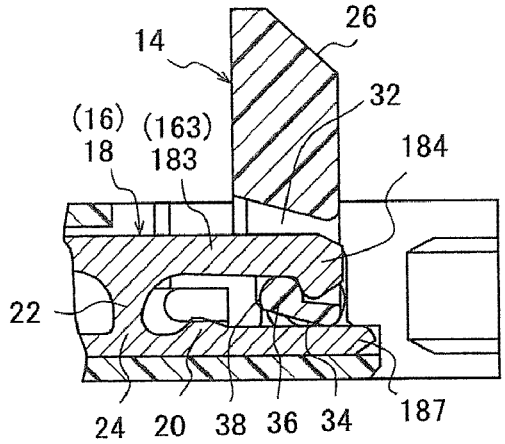
FIG. 15A is a view for explaining the insertion and pivoting movement of a pushing portion of the pivoting member acting on the fourth contact.

There is a case that the engaging rod 34 of said pivoting member 14 cooperating with said second contact 16 is only the rod portion 36 (the non-zero insertion force (N-ZIF) structure as described above) as shown in FIGS. 5B and 6B, or there is a case that the engaging rod 34 is the cam portion 38 having the substantially L-shaped cross-section including the engaging rod 34 and the rod portion 36 as shown in FIG. 15A.

In the case that the engaging rod 34 is the rod portion 36 only (the non-zero insertion force (N-ZIF) structure as described above), the rod portion 36 only needs to engage the extended portion 164 of the second contact 16 and rotate and to be sufficient to prevent the pivoting member 14 from being deformed in the direction shown by the arrow A in FIG. 1A due to the load (the reaction force against the pivotal movement) when the pivoting member 14 is pivotally moving. In the illustrated embodiment, said rod portion 36 is substantially in the form of a cylindrical column. The size of said rod portion 36 may be suitably designed in consideration of the deformation or warping and strength of the pivoting member 14, miniaturization of the connector, pivotal (rotational) movability, the size of the extended portion 164 of the second contact 16, and the like.

In the case that the engaging rod 34 is the cam portion 38 having the substantially L-shaped cross-section including the engaging rod 34 and the rod portion 36, the rod portion 36 only needs to engage the extended portion 164 of said second contact 16 and rotate and to be sufficient to prevent the pivoting member 14 from being deformed in the direction shown by the arrow A in FIG. 1A due to the load (the reaction force against the pivotal movement) when the pivoting member 14 is pivotally moving. Further, the cam portion 38 only needs to raise the pressure receiving portion 163 of said second contact 16 by the difference in contact height of the cam portion 38 (the cross-section of the cam portion 38 is not perfectly circular) when the cam portion 38 is pivotally moved (rotated) so that the function described above occurs, thereby enabling the contact portion 162 of said second contact 16 to contact the flexible printed circuit board 80. In the illustrated embodiment, the rod portion 36 is substantially column-shaped, and the size of said rod portion 36 may be suitably designed in consideration of the deformation (warping) and strength of said pivoting member 14, miniaturization of the connector 10, pivotal (rotational) movability, the size of the extended portion 164 of the second contact 16, and the like. Moreover, the cam portion 38 may be suitably designed so as to achieve the functions described above, taking into account the elasticity, contact pressure and strength of the contact, and the like.

Said pivoting member 14 is provided with an anchoring hole or holes 32 which are through-holes and independent from each other and are located at positions corresponding to those of said second contacts 16. Said anchoring holes 32 may be suitably designed so that the pressure receiving portions 163 of said second contacts 16 are received in said anchoring holes 32 and said extended portions 164 engage said rod portions 36, thereby enabling a stable pivotal movement of said engaging rods 34.

The actuating portion 26 of said pivoting member 14 may be of any shape and size insofar as it enables said pivoting member 14 to be actuated so as to be pivotally moved, and may be suitably designed taking into account its operationality and strength.

Figure 15B:
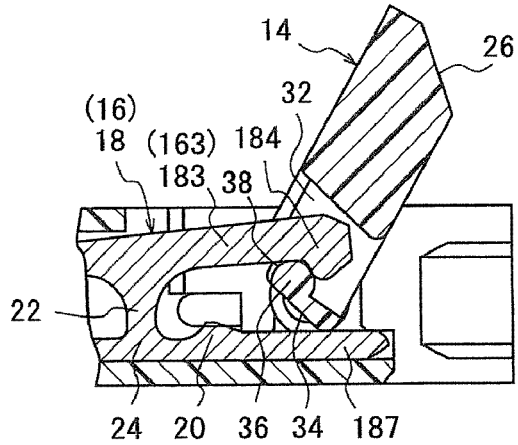
FIG. 15B is a view illustrating the state that the pivoting member has been pivoted by some degrees.
Figure 15C:
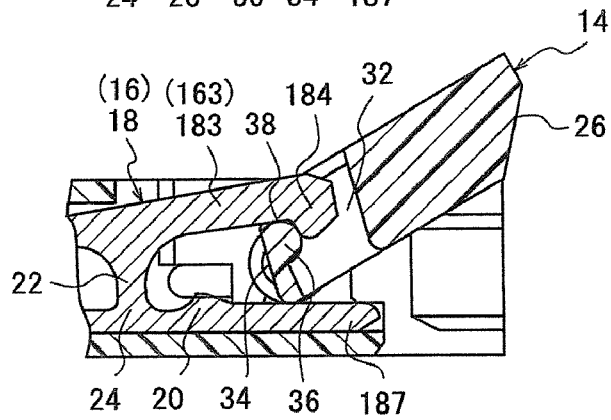
FIG. 15C is a view illustrating the state that the pivoting member has been pivoted further.
Figure 15D:
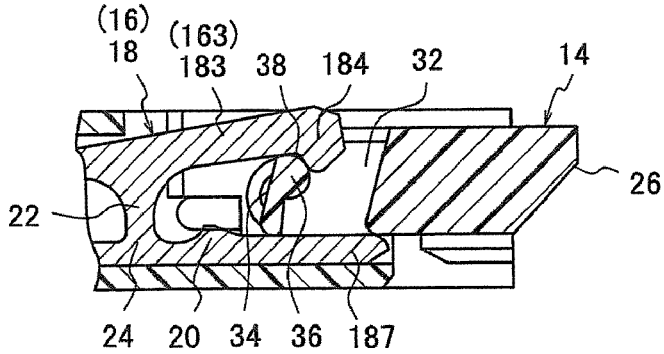
FIG. 15D is a view illustrating the state that the pivoting member has been pivoted in its closed position.

The pivotal movement of said cam portion 38 will be explained herein with reference to FIGS. 15A to 15D. First, when the flexible printed circuit board 80 is not inserted into the connector 10, the pivoting member 14 stands substantially upright as shown in FIG. 15A. Then, the flexible printed circuit board 80 is inserted and the pivoting member 14 is started to be pivotally moved, during initial stage of which the cam portion 38 is rotated about the rod portion 36 of said cam portion 38 as a rotating center and the cam portion 38 is in an inclined position at substantially 45 degrees as shown in FIG. 15B. When the pivoting member 14 is further pivotally moved, the cam portion 38 is rotated about the rod portion 36 of said cam portion 38 as a rotating center, and the cam portion 38 is in a substantially vertical position as shown in FIG. 15C. When the pivoting member 14 is further pivotally moved, the cam portion 38 is rotated about the rod portion 36 of said cam portion 38 as a rotating center, and the cam portion 38 is in substantially vertical position and slightly tilted to the right viewed in the drawing of FIG. 15D so that said pressure receiving portion 163 is raised by said cam portion 38.

Finally, the housing 12 will be explained. The housing 12 is formed from an electrically insulating plastic material by means of the injection molding of the known technique. The materials for the housing 12 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC) and the like and synthetic materials thereof.

The housing 12 is formed with inserting holes 44 into which a required number of the contacts are inserted and fixed, respectively, by means of press-fitting, hooking (lancing), welding, or the like.

The housing 12 is further formed at both the longitudinal ends with bearings into which the axles of the pivoting member 14 are fitted so as to permit the pivoting member 14 to be pivotally movable. The shape and size of the bearings may be any ones so long as the pivoting member 14 is pivotally moved, and may be suitably designed taking into account their functions, the strength and the size of the housing, and the like.

Moreover, the housing 12 is provided with a ceiling portion 40 for covering or insulating the contact portions 152 and 162 of the first pieces 151 and 161 of said first and second contacts 15 and 16. It is preferable to provide a conducting portion at the outer peripheries of the fitting opening 5 of said housing 12 for facilitating the insertion of a connecting object such as the flexible printed circuit board 80.

The arrangement of said first and second contacts 15 and 16 according to the invention will be explained. In the case that the number of the contacts is ten (10) or less, said first contacts 15 only are used. If the number of the contacts is more than ten (10), one or more of the second contacts 16 are used in place of the first contacts 15 at optional positions. In other words, in the case that the number of the contacts is more than ten (10), since it is envisioned that said pivoting member 14 may be deformed or warped due to the load when it is pivotally moving, such a deformation of said pivoting member 14 is prevented by causing the engaging rod 34 of said pivoting member 14 to engage the extended portion 164 of said second contact 16. The second contact 16 may be provided at any location insofar as the deformation or warping of the pivoting member 14 can be prevented. In the case that the number of the contacts is more than ten (10), it is effective (desirable) to arrange the second contacts at locations corresponding to about every fifth contact.

Figure 7A:
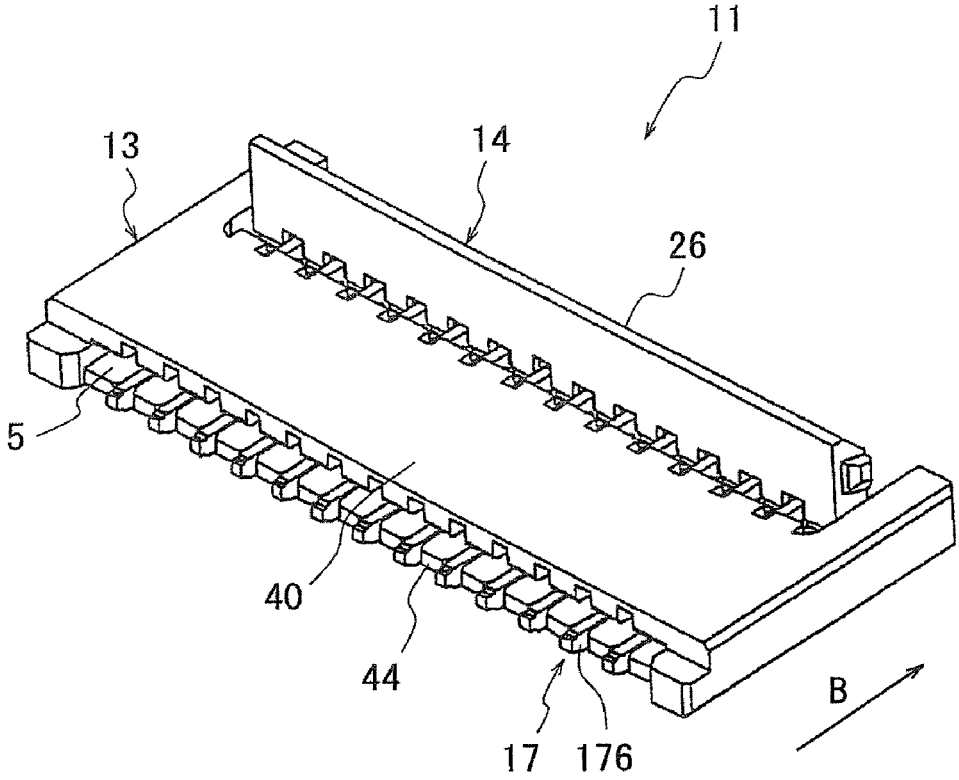
FIG. 7A is a perspective view of a connector according to the invention different from the connector shown in FIG. 1A viewed from the above on the side of the fitting opening for a flexible printed circuit board.
Figure 7B:
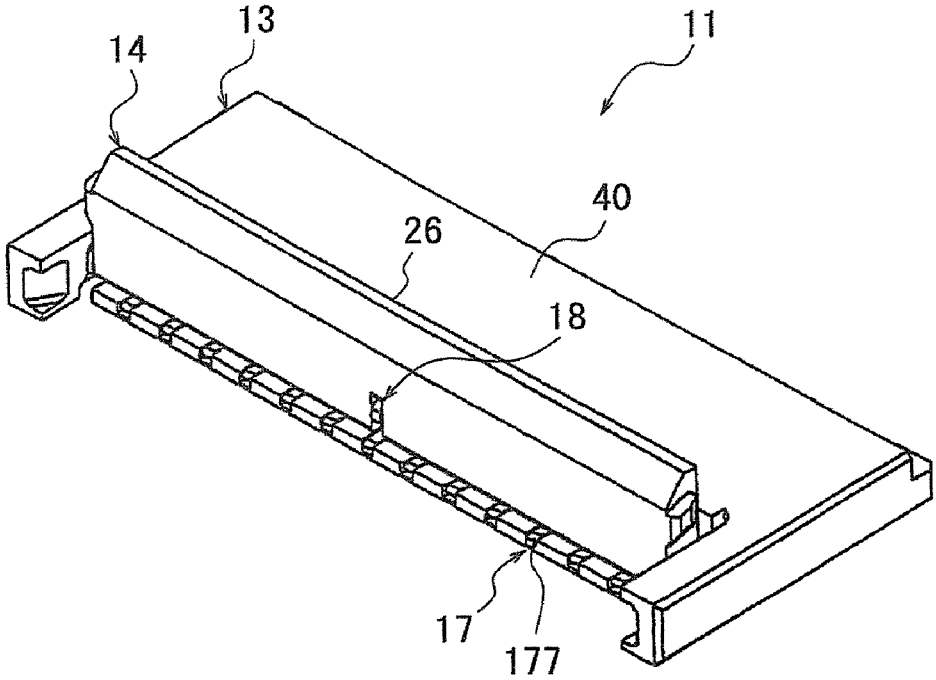
FIG. 7B is a perspective view of the connector shown in FIG. 7A viewed from the below on the opposite side of the fitting opening.
Figure 8A:
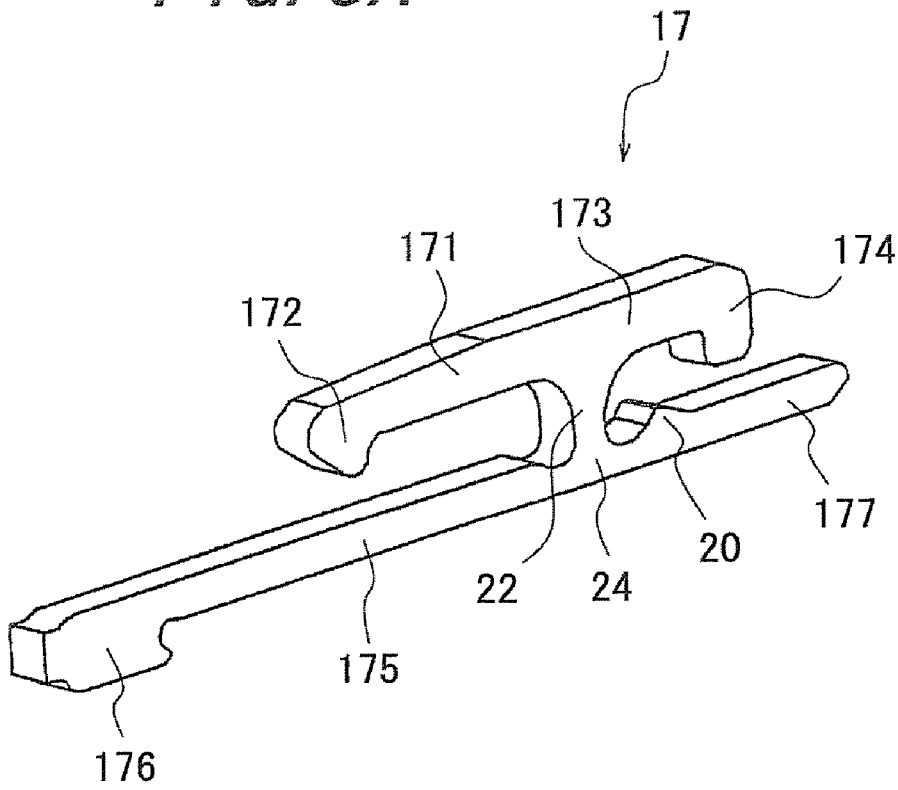
FIG. 8A is a perspective view of a third contact.
Figure 8B:
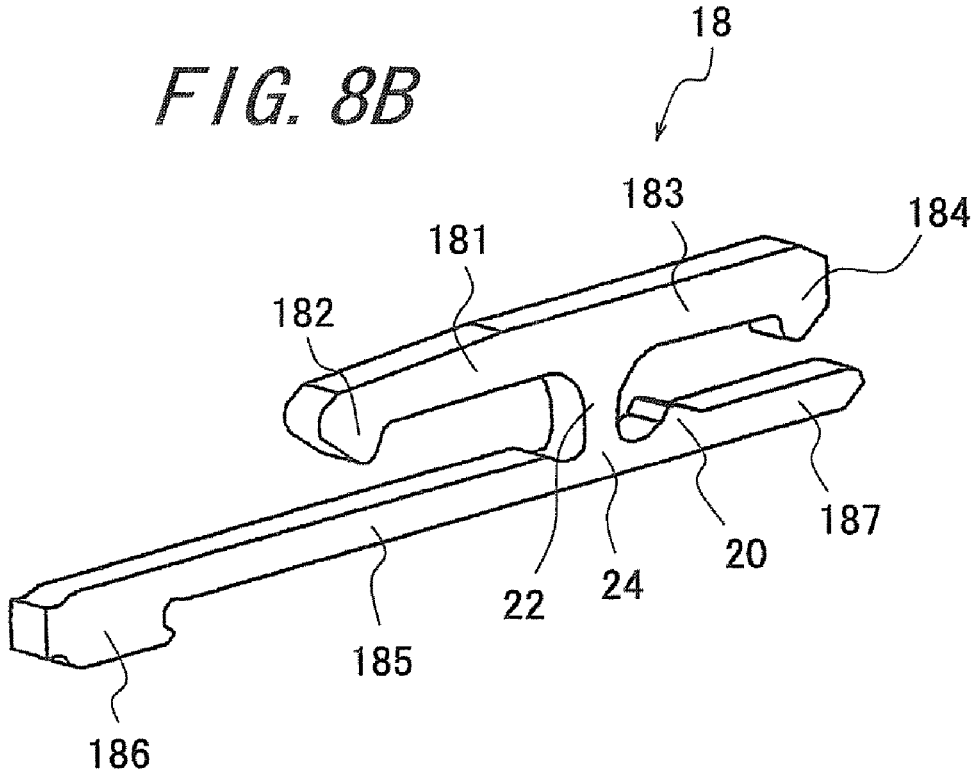
FIG. 8B is a perspective view of a fourth contact.
Figure 9A:
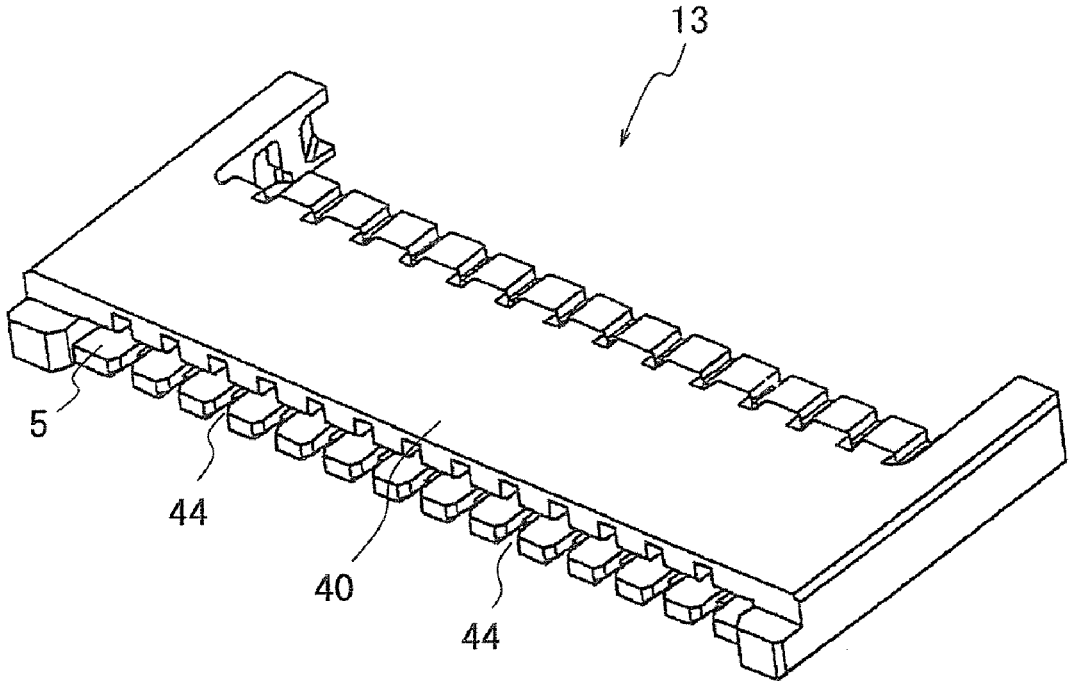
FIG. 9A is a perspective view of a housing different from the housing shown in FIG. 3A viewed from the above on the side of the fitting opening.
Figure 9B:
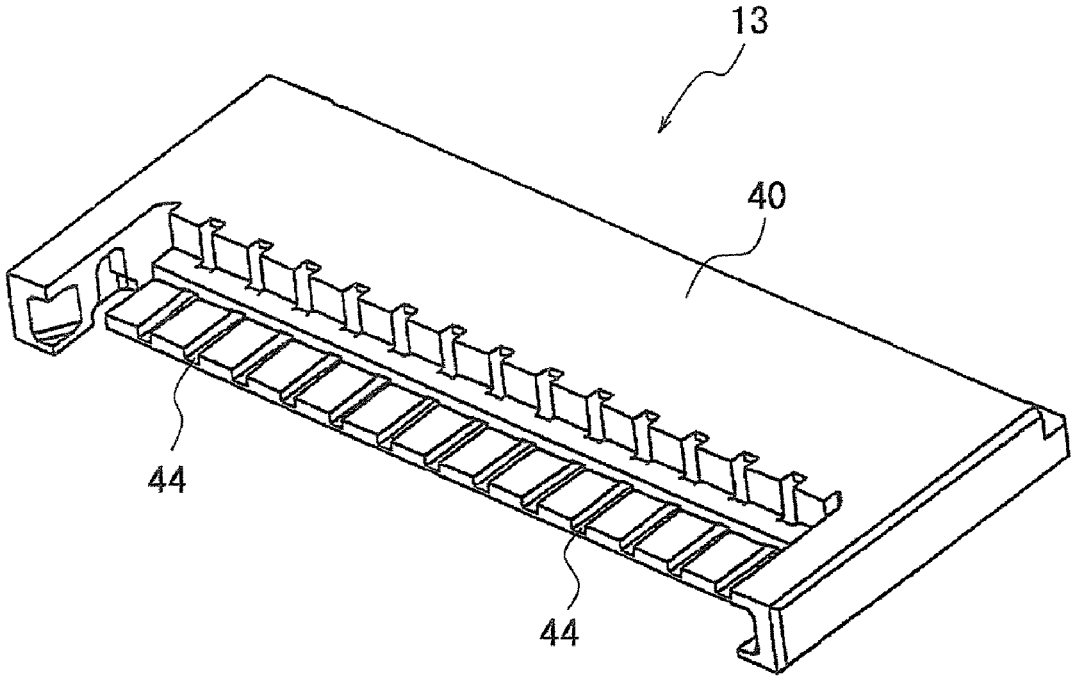
FIG. 9B is a perspective view of the housing shown in FIG. 9A viewed from the below on the opposite side of the fitting opening.
Figure 10:
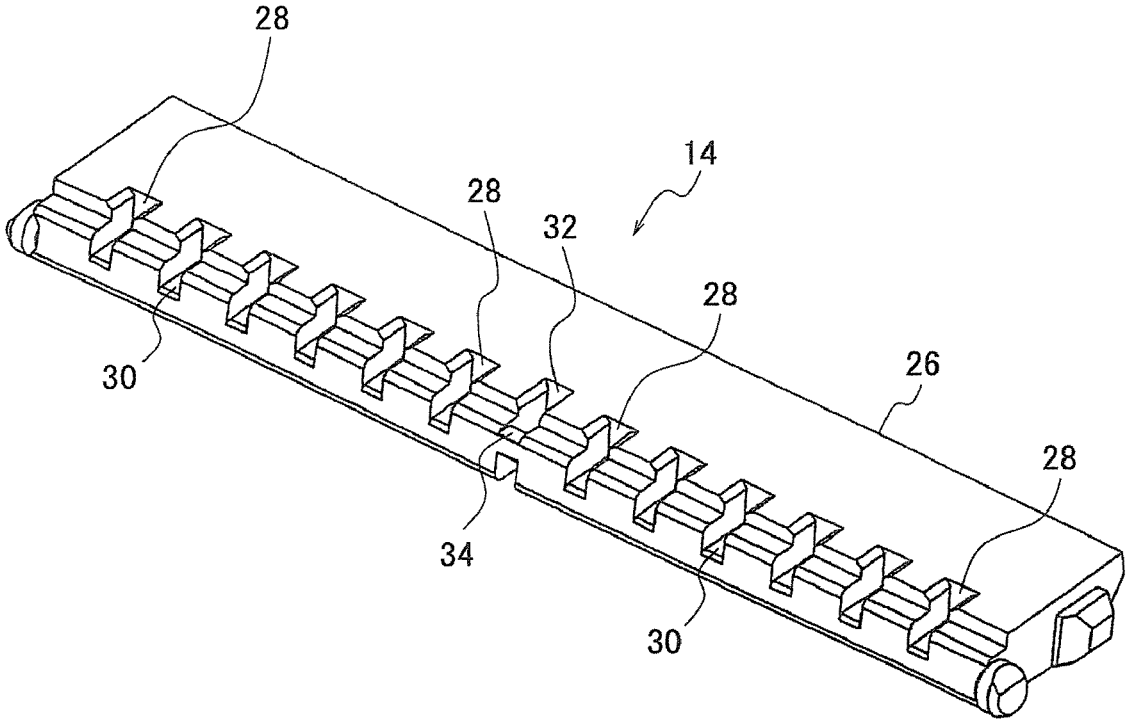
FIG. 10 is a perspective view of a pivoting member different from that shown in FIG. 4.
Figure 11A:
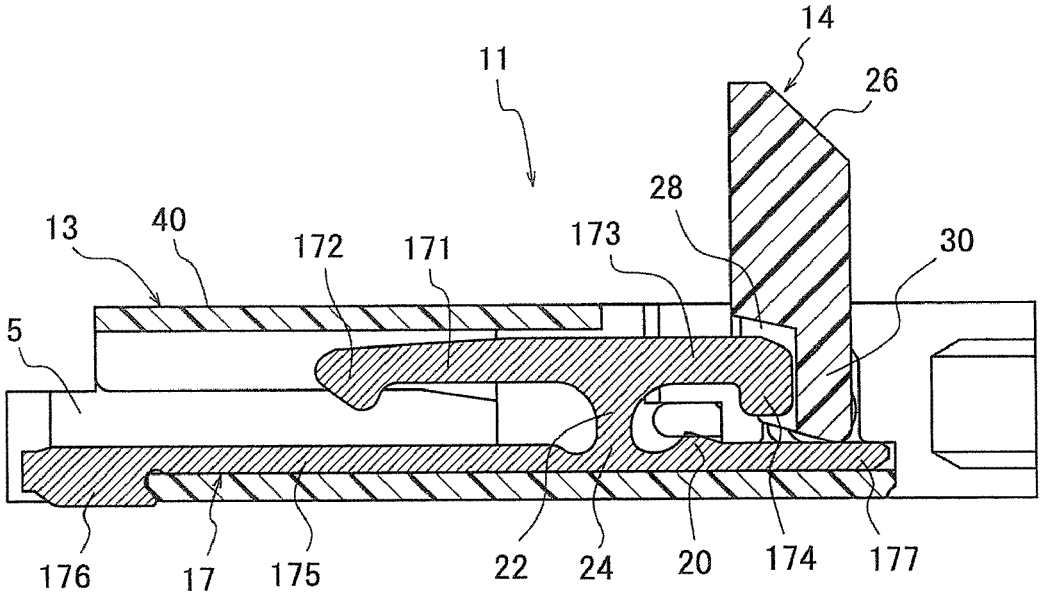
FIG. 11A is a sectional view of the connector with the pivoting member opened, taken along the third contact.
Figure 11B:
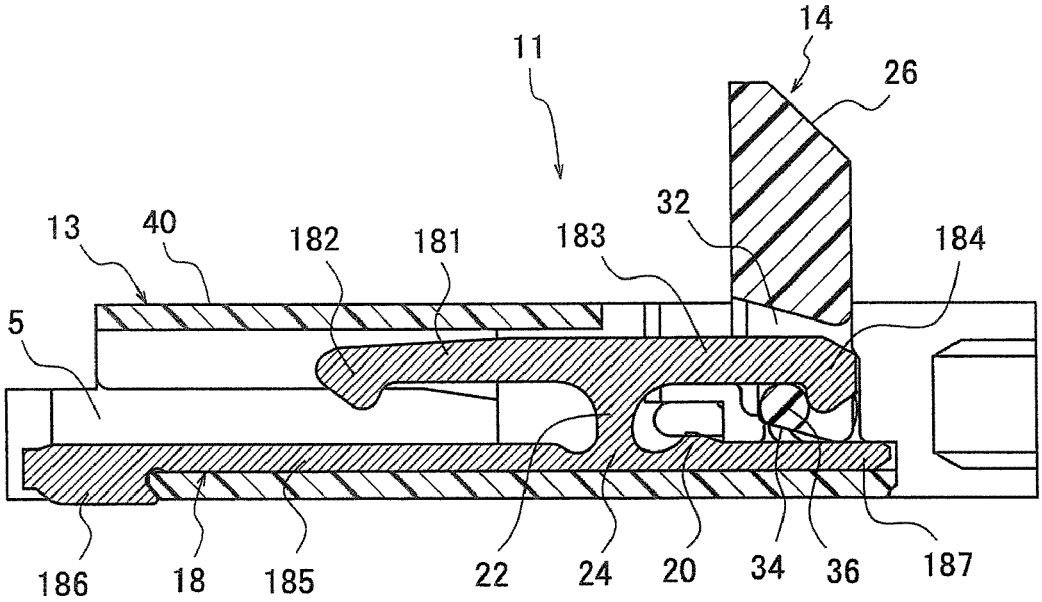
FIG. 11B is a sectional view of the connector with the pivoting member opened, taken along the fourth contact.
Figure 12A:
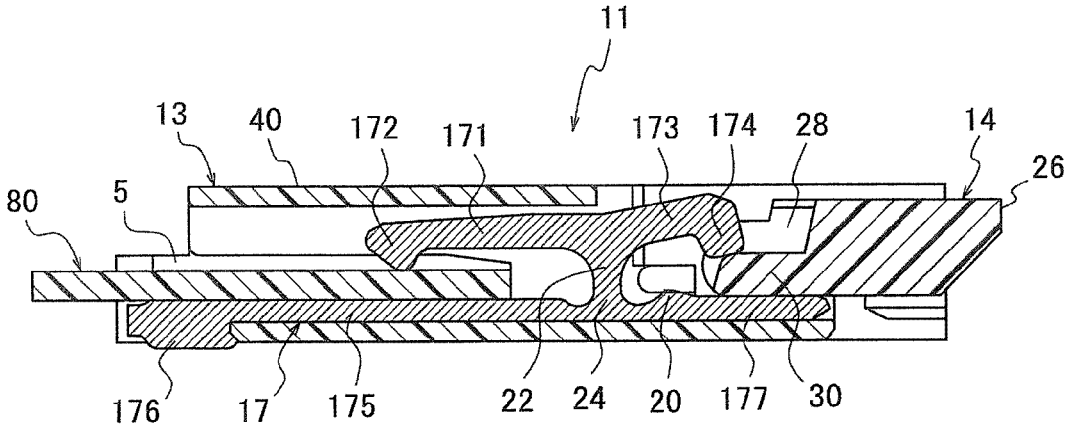
FIG. 12A is a sectional view of the connector with the flexible printed circuit board inserted and with the pivoting member closed, taken along the third contact.
Figure 12B:
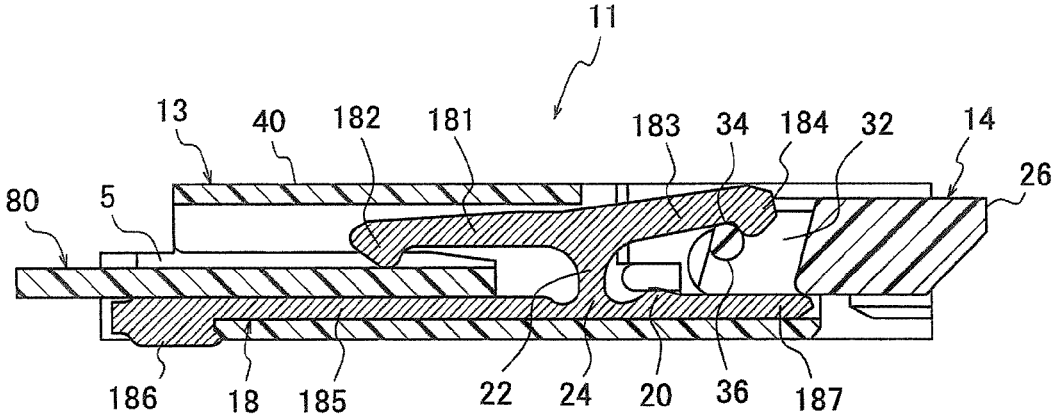
FIG. 12B is a sectional view of the connector with the flexible printed circuit board inserted and with the pivoting member closed, taken along the fourth contact.

A connector 11 of another embodiment of the invention will then be explained with reference to FIGS. 7A to 12B. FIG. 7A is a perspective view of the connector according to the invention different from the connector shown in FIG. 1A, viewed from the above on the side of the fitting opening for a flexible printed circuit board, and FIG. 1B is a perspective view of the connector viewed from the below on the opposite side of the fitting opening. FIG. 8A is a perspective view of a third contact, while FIG. 8B is a perspective view of a fourth contact. FIGS. 9A and 9B are perspective views of a housing different from the housing shown in FIGS. 3A and 3B, and FIG. 10 is a perspective view of a pivoting member different from the pivoting member shown in FIG. 4. FIG. 11A is a sectional view of the connector with the pivoting member opened, taken along the third contact, while FIG. 11B is a sectional view of the connector with the pivoting member opened, taken along the fourth contact. FIG. 12A is a sectional view of the connector with the flexible printed circuit board inserted and with the pivoting member closed, taken along the third contact, and FIG. 12B is a sectional view of the connector with the flexible printed circuit board inserted and with the pivoting member closed, taken along the fourth contact.

The connector 11 according to the invention comprises a housing 13, two kinds of contacts (third contacts 17 and fourth contacts 18), and a pivoting member 14 in the same manner as in the connector 10 described above.

Components of the connector 11 according to the invention will be explained with reference to the drawings. First, the two kinds of the contacts will be explained. The third and fourth contacts 17 and 18 of the two kinds are both made of a metal and formed by means of the press-working of the known technique. Preferred metals from which to form third and fourth contacts 17 and 18 of the two kinds include brass, beryllium copper, phosphor bronze and the like which comply with the requirements as to springiness, electric conductivity, and the like. In the illustrated embodiment, the two kinds of the contacts (third and fourth contacts 17 and 18) are inserted into inserting holes 44 of the housing 13 from the side of the fitting opening 5 of the housing.

Said third contact 17 comprises at least a first piece 171 having at one end a contact portion 172 and at the other end a pressure receiving portion 173, a second piece 175 having at one end a connection portion 176, and an elastic jointing portion (consisting of a fulcrum portion 24 and an elastic portion 22) for connecting or jointing the first piece 171 and the other end of said second piece 175. Said elastic jointing portion can be divided into the fulcrum portion 24 and the elastic portion 22 in the illustrated embodiment. In other words, said third contact 17 is substantially h-shaped and comprises the first piece 171 having at one end the contact portion 172 adapted to contact a flexible printed circuit board 80 (not shown in FIG. 8A) and at the other end the pressure receiving portion 173 to be pushed by said pivoting member 14, the second piece 175 having at one end the connection portion 176 to be connected to a substrate and at the other end the fulcrum portion 24, and the elastic portion 22 for jointing the substantially middle portion of the first piece 171 and the fulcrum portion 24 of the second piece 175 (said elastic jointing portion consisting of the fulcrum portion 24 and the elastic portion 22), and further may comprises a fixed portion 20 on an extension portion 177 (described in next paragraph) in the proximity of the elastic jointing portion. The contact portion 172 of said first piece 171, the elastic portion 22, the fulcrum portion 24 and the connection portion 176 are arranged substantially in the form of a U-shape.

In the illustrated embodiment, the third contact 17 is further provided with the extension portion 177 extending from said fulcrum portion 24 in the same direction extending the pressure receiving portion 173 (in opposite direction from the fitting opening 5) so that the third contact 17 is substantially H-shaped as shown in FIG. 8A.

Said fixed portion 20 is provided on said extension portion 177 in the proximity of the elastic jointing portion. The position and size of said fixed portion 20 may be suitably designed in consideration of the holding force for the third contact 17, the rising of the contact, stability of connectivity, and the like.

Said contact portion 172 is in the form of a protrusion for the purpose of facilitating the contact with the flexible printed circuit board 80. The connection portion 176 is of a surface mounting type (SMT) in the illustrated embodiment as shown in FIG. 7A. It may be of a dip type.

Said fulcrum portion 24, said elastic portion 22, and said pressure receiving portion 173 serve as the following description when said flexible printed circuit board 80 has been inserted into the connector 11. When the pivoting member 14 is being pivotally moved after the flexible printed circuit board 80 has been inserted into the connector 11, the pushing portions 30 of said pivoting member 14 enter the spaces between the extension portions 177 and the pressure receiving portions 173 of said third contacts 17 and are pivotally moved in the spaces, with the result that said pressure receiving portions 173 are raised upwardly. Therefore, the elastic portions 22 of said third contacts 17 are tilted toward said contact portions 172 about the fulcrum portions 24 of the third contacts 17 by the upward movement of the pressure receiving portions 173, so that the contact portions 172 are pushed to the flexible printed circuit board 80. The sizes and shapes of said fulcrum portions 24, said elastic portions 22, and said pressure receiving portions 173 may be suitably designed so as to achieve these functions.

It is preferable to provide an extended surface 174 on the pressure receiving portion 173 of said third contact 17 so as to extend toward said extension portion 177 for facilitating the occurrence of the above functions. The pushing portions 30 of said pivoting member 14 come into surface contact with said extended surfaces 174 of said third contacts 17 to ensure the above functions and more stable electrical connection. The size and shape of said extended surfaces may be suitably designed to achieve the above functions.

The fourth contact 18 will then be explained with reference to FIG. 8B. A great difference of the fourth contact 18 from the third contact 17 is in an extended portion 184 provided at the tip of the pressure receiving portion 183 of said fourth contact 18. The extended portion 184 of the fourth contact 18 engages the engaging rod 34 of the pivoting member 14 later described to obtain its assured pivotal (rotational) movement and to prevent the center portion of said pivoting member 14 from being deformed in a direction shown by an arrow B in FIG. 7A caused by the load (reaction force against the pivotal movement) acting upon the pivoting member 14 when it is being pivoted. The size of said extended portion 184 may be any one so long as it achieves such functions, and may be suitably designed such that the engaging rod 34 of said pivoting member 14 engages the extended portion 184 to achieve a stable pivotal (rotational) movement. The shape of said fourth contact 18 may be substantially h-shaped or H-shaped similarly to the third contact 17.

Said fourth contact 18 comprises at least a first piece 181 having at one end a contact portion 182 and at the other end a pressure receiving portion 183, a second piece 185 having at one end a connection portion 186, and an elastic jointing portion (consisting of a fulcrum portion 24 and an elastic portion 22) for connecting or jointing said first piece 181 and the other end of said second piece 185. Said elastic jointing portion can be divided into the fulcrum portion 24 and the elastic portion 22 in the illustrated embodiment. In other words, said fourth contact 18 is substantially h-shaped and comprises the first piece 181 having at one end the contact portion 182 adapted to contact the flexible printed circuit board 80 (not shown in FIG. 8B) and at the other end the pressure receiving portion 183 to be pushed by said pivoting member 14, the second piece 185 having at one end the connection portion 186 to be connected to the substrate and at the other end the fulcrum portion 24, and the elastic portion 22 (said fulcrum portion 24 and said elastic portion 22 form the elastic jointing portion) for jointing the substantially middle portion of said first piece 181 and said fulcrum portion 24 of said second piece 185, and further may comprises a fixed portion 20 on an extension portion 187 (described in next paragraph) in the proximity of the elastic jointing portion. Said contact portion 182 of said first piece 181, said elastic portion 22, said fulcrum portion 24, and said connection portion 186 are arranged substantially in the form of a U-shape.

In the illustrated embodiment, said fourth contact 18 is provided with the extension portion 187 extending from said fulcrum portion 24 in the direction opposite from said connection portion 186 (away from the fitting opening 5) so that the fourth contact 18 is substantially H-shaped as shown in FIG. 8B.

As described above, said fixed portion 20 is provided on said extension portion 187 in the proximity of its elastic jointing portion. The position and size of said fixed portion 20 may be designed taking into account the holding force for the fourth contact 18, the rising of the contact, stability of connectivity, and the like.

Said contact portion 182 is in the form of a protrusion in order to facilitate the contact with said flexible printed circuit board 80. Although said connection portion 186 is of a surface mounting type (SMT) as shown in FIG. 7A, it may be of a dip type.

In the illustrated embodiment, as shown in FIGS. 11B and 12B, when said engaging rod 34 of said pivoting member 14 is formed by merely a rod portion 36, said pressure receiving portion 183 only serves as a bearing, and said fulcrum portion 24 and said elastic portion 22 only serve to joint the first piece 181 and the second piece 185 of said fourth contact 18. In such a case, a space between the contact portion 182 and the connection portion 186 of said fourth contact 18 is designed to be smaller than the thickness of the flexible printed circuit board 80 to be inserted into the space (a so-called non-zero insertion force (N-ZIF) structure), thereby achieving a stable connection of the connector and the flexible printed circuit board inserted therein.

In the case that said engaging rod 34 of said pivoting member 14 is formed as a cam portion 38 which includes the rod portion 36 and has a substantially L-shaped cross-section (although not shown in FIGS. 7A to 12B), said fulcrum portion 24, said elastic portion 22, and said pressure receiving portion 183 perform the following functions when the flexible printed circuit board 80 has been inserted into the connector 11. After the flexible printed circuit board 80 has been inserted into the fitting opening 5 of said housing 13, when the cam portion 38 of said pivoting member 14 is pivotally moved between the pressure receiving portion 183 and the extension portion 187 (housing 13 in case of being free from the extension portion) of said fourth contact 18, said pressure receiving portion 183 is raised upwardly by the cam portion 38 so that the elastic portion 22 of said fourth contact 18 is tilted toward said contact portion 182 about the fulcrum portion 24 of said fourth contact 18, thereby pushing said contact portion 182 to said flexible printed circuit board 80. The sizes and shapes of said fulcrum portion 24, said elastic portion 22, and said pressure receiving portion 183 may be suitably designed so as to achieve such a function.

The pivoting member 14 will then be explained. The pivoting member 14 is formed from an electrically insulating plastic material by means of the injection molding of the known technique. The materials for the pivoting member 14 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC), polyphenylene sulfide (PPS), and the like, and synthetic materials thereof. Said pivoting member 14 mainly comprises an actuating portion 26, axles to be fitted in the housing 13 for pivotally moving the pivoting member relative to the housing 13, anchoring grooves 28 for receiving the pressure receiving portions 173 of said third contacts 17, pushing portions 30 for pushing the pressure receiving portions 173, an anchoring hole or holes 32 for receiving the pressure receiving portions 183 of said fourth contacts 18, and an engaging rod or rods 34 adapted to engage the extended portions 184. Said axles are fulcrums for pivotally moving the pivoting member 14 and suitably fitted in both the longitudinal ends of the housing 13 so as to permit the pivoting member 14 to be pivotally moved.

According to the invention, made to be different from each other are shapes of the portions (the pushing portions 30, the engaging rod or rods 34, and the like) of said pivoting member 14 with which the pressure receiving portions 173 and 183 of said third and fourth contacts 17 and 18 are engaged, respectively. In other words, in order to prevent said pivoting member 14 from being deformed (warped) in the direction shown by the arrow B in FIG. 7A due to the load (reaction against the pivotal movement) when the pivoting member 14 is being pivotally moved (rotated), said fourth contact or contacts 18 are arranged at optional locations instead of the third contacts 17.

Regarding the portions (the pushing portions 30) of said pivoting member 14 cooperating with said third contacts 17 and said anchoring grooves 28 whose bottom surfaces are formed substantially in the form of a plate, when said pivoting member 14 is pivotally moved (rotated), during the initial stage of the pivotal movement, the pushing portions 30 do not contact said third contacts 17 and in the state that the pivotal movement has been completed, the extended surfaces 174 of the pressure receiving portions 173 of said third contacts 17 are raised upwardly by the surfaces of said pushing portions 30, that is, the pushing portions 30 are exerted on said third contacts 17 as described above, thereby bringing the contact portions 172 of said third contacts 17 into contact with the inserted flexible printed circuit board 80. Preferably, the shape of said pushing portions 30 is substantially in the form of a plate. With such plate-shaped pushing portions 30, the extended surfaces 174 of said third contacts 17 can be raised upwardly by the surfaces of said pushing portions 30 (the bottom surfaces of the anchoring grooves 28) when the pivoting member 14 is inserted and pivotally moved. By causing the surfaces to contact each other, the extended surfaces can be securely raised and at the same time the load acting upon the pivoting member when pivotally moving can be reduced.

The size of said pushing portions 30 is determined so as to be larger than the distance between the extended surface 174 and the extension portion 177 of said third contact 17 so that the functions described above can be achieved. The pushing portions 30 may be suitably designed in consideration of the elasticity of the contacts, contact pressure, strength, and the like.

Said engaging grooves 28 are blind holes (grooves) and are independent from one another in order to maintain the strength of said pivoting member 14 and to avoid the pivoting member 14 from being damaged when it is pivotally moving. The depth of said engaging grooves 28 may be suitably designed so as to achieve the functions described above taking into account the relation to the thickness of said pushing portions 30, the elasticity of the contacts, contact pressure, strength and the like.

Insertion and pivotal movement of the pushing portions 30 cooperating with the third contact 17 will be explained herein with reference to FIGS. 14A to 14D. First, when the flexible printed circuit board 80 is not inserted into the connector 11, the pivoting member 14 stands substantially upright as shown in FIG. 14A. Then, the flexible printed circuit board 80 is inserted and the pivoting member 14 is started to be pivotally moved, during initial stage of which the pushing portion 30 does not contact the extended surface 174 of the third contact 17 as shown in FIG. 14B. When the pivoting member 14 is further pivotally moved, the tip of said pushing portion 30 comes into line contact with the extended surface 174 as shown in FIG. 14C. Upon further pivotal movement, the pivoting member 14 becomes substantially parallel to the housing 13 and said pushing portion 30 comes into surface contact with the extended surface 174 to cause the extended surface 174 to be raised by said pushing portion 30 as shown in FIG. 14D.

Figure 13A:
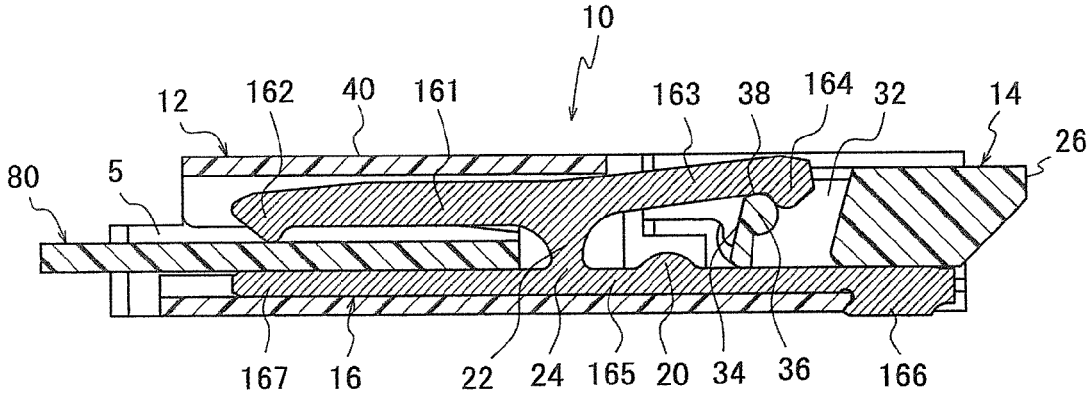
FIG. 13A is a sectional view of the connector with the flexible printed circuit board inserted and with the pivoting member closed, taken along the second contact different from that in FIG. 6B.
Figure 13B:
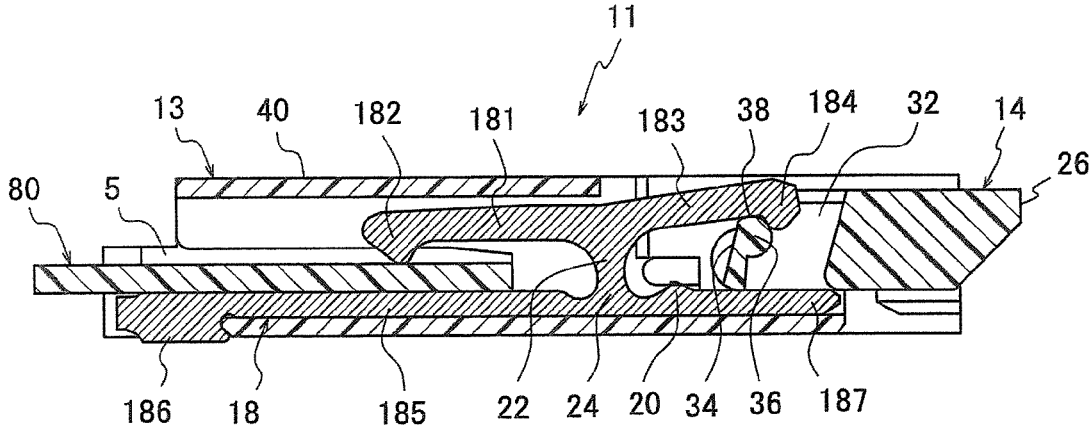
FIG. 13B is a sectional view of the connector with the flexible printed circuit board inserted and with the pivoting member closed, taken along the fourth contact different from that in FIG. 12B.

There is a case that the portion (the engaging rod 34) of said pivoting member 14 cooperating with said fourth contact 18 is only the rod portion 36 (the non-zero insertion force (N-ZIF) structure as described above) as shown in FIGS. 11B and 12B, or there is a case that the engaging rod 34 is the cam portion 38 having the substantially L-shaped cross-section including the engaging rod 34 and the rod portion 36 as shown in FIG. 13B and FIG. 15.

In the case that the engaging rod 34 is the rod portion 36 only (the non-zero insertion force (N-ZIF) structure as described above), the rod portion 36 only needs to engage the extended portion 184 of the fourth contact 18 and rotate and to be sufficient to prevent the pivoting member 14 from being deformed in the direction shown by the arrow B in FIG. 7A due to the load (the reaction force against the pivotal movement) when the pivoting member 14 is pivotally moving. In the illustrated embodiment, said rod portion 36 is substantially in the form of a cylindrical column. The size of said rod portion 36 may be suitably designed in consideration of the deformation or warping and strength of the pivoting member 14, miniaturization of the connector, pivotal (rotational) movability, the size of the extended portion 184 of the fourth contact 18, and the like.

In the case that the engaging rod 34 is the cam portion 38 having the substantially L-shaped cross-section including the engaging rod 34 and the rod portion 36, the rod portion 36 only needs to engage the extended portion 184 of said fourth contact 18 and rotate and to be sufficient to prevent the pivoting member 14 from being deformed in the direction shown by the arrow B in FIG. 7A due to the load (the reaction force against the pivotal movement) when the pivoting member 14 is pivotally moving. Further, the cam portion 38 only needs to raise the pressure receiving portion 183 of said fourth contact 18 by the difference in contact height of the cam portion 38 (the cross-section of the cam portion 38 is not perfectly circular) when the cam portion 38 is pivotally moved (rotated) so that the function described above occurs, thereby enabling the contact portion 182 of said fourth contact 18 to contact the flexible printed circuit board 80. In the illustrated embodiment, the rod portion 36 is substantially column-shaped, and the size of said rod portion 36 may be suitably designed in consideration of the deformation (warping) and strength of said pivoting member 14, miniaturization of the connector 10, pivotal (rotational) movability, the size of the extended portion 184 of the fourth contact 18, and the like. Moreover, the cam portion 38 may be suitably designed so as to achieve the functions described above, taking into account the elasticity, contact pressure and strength of the contact, and the like.

Said pivoting member 14 is provided with an anchoring hole or holes 32 which are through-holes and independent from each other and are located at positions corresponding to those of said fourth contacts 18. Said anchoring holes 32 may be suitably designed so that the pressure receiving portions 183 of said fourth contacts 18 are received in said anchoring holes 32 and said extended portions 184 engage said rod portions 36, thereby enabling a stable pivotal movement of said engaging rods 34.

The actuating portion 26 of said pivoting member 14 may be of any shape and size insofar as it enables said pivoting member 14 to be actuated to be pivotally moved, and may be suitably designed taking into account its operationality and strength.

The pivotal movement of said cam portion 38 will be explained herein with reference to FIGS. 15A to 15D. First, when the flexible printed circuit board 80 is not inserted into the connector 11, the pivoting member 14 stands substantially upright as shown in FIG. 15A. Then, the flexible printed circuit board 80 is inserted and the pivoting member 14 is started to be pivotally moved, during initial stage of which the cam portion 38 is rotated about the rod portion 36 of said cam portion 38 as a rotating center and the cam portion 38 is in an inclined position at substantially 45 degrees as shown in FIG. 15B. When the pivoting member 14 is further pivotally moved, the cam portion 38 is rotated about the rod portion 36 of said cam portion 38 as a rotating center, and the cam portion 38 is in a substantially vertical position as shown in FIG. 15C. When the pivoting member 14 is further pivotally moved, the cam portion 38 is rotated about the rod portion 36 of said cam portion 38 as a rotating center, and the cam portion 38 is in substantially vertical position and slightly tilted to the right viewed in the drawing of FIG. 15D so that said pressure receiving portion 183 is raised by said cam portion 38.

Finally, the housing 13 will be explained. The housing 13 is formed from an electrically insulating plastic material by means of the injection molding of the known technique. The materials for the housing 13 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC) and the like and synthetic materials thereof.

The housing 13 is formed with inserting holes 44 into which a required number of the contacts are inserted and fixed, respectively, by means of press-fitting, hooking (lancing), welding, or the like.

The housing 13 is further formed at both the longitudinal ends with bearings into which the axles of the pivoting member 14 are fitted so as to permit the pivoting member 14 to be pivotally movable. The shape and size of the bearings may be any ones so long as the pivoting member 14 is pivotally moved, and may be suitably designed taking into account their functions, the strength and the size of the housing 13, and the like.

Moreover, the housing 13 is provided with a ceiling portion 40 for covering or insulating the contact portions 172 and 182 of the first pieces 171 and 181 of said third and fourth contacts 17 and 18. It is preferable to provide a conducting portion at the outer peripheries of the fitting opening 5 of said housing 13 for facilitating the insertion of a connecting object such as the flexible printed circuit board 80.

The arrangement of said third and fourth contacts 17 and 18 according to the invention will be explained. In the case that the number of the contacts is ten (10) or less, said third contacts 17 only are used. If the number of the contacts is more than ten (10), one or more of the fourth contacts 18 are used in place of the third contacts 17 at optional positions. In other words, in the case that the number of the contacts is more than ten, since it is envisioned that said pivoting member 14 may be deformed or warped due to the load when it is pivotally moving, such a deformation of said pivoting member 14 is prevented by causing the engaging rod 34 of said pivoting member 14 to engage the extended portion 184 of said fourth contact 18. The fourth contact 18 may be provided at any location insofar as the deformation or warping of the pivoting member 14 can be prevented. In the case that the number of the contacts is more than ten, it is effective (desirable) to arrange the fourth contacts at locations corresponding to about every fifth contact.

A connector according to the invention whose contacts are alternately arranged to be staggered will then be explained hereinafter. The words "alternately arranged to be staggered" used herein mean that the contacts of two kinds are alternately arranged on the side of the fitting opening and the opposite side of the fitting opening of the housing.

Figure 16A:
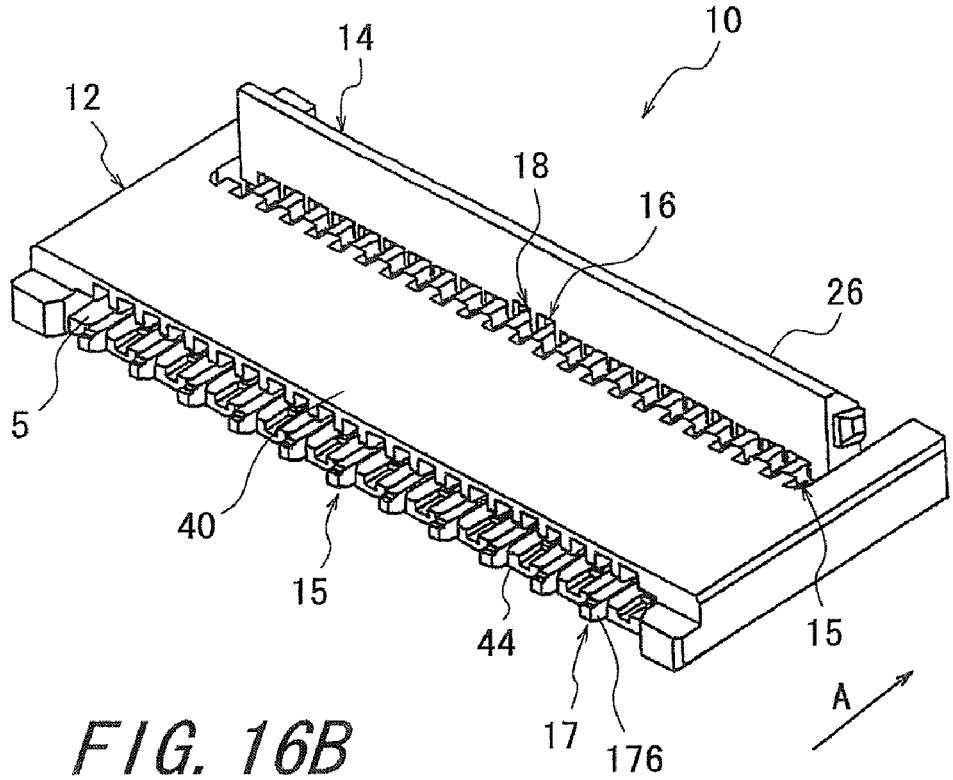
FIG. 16A is a perspective view of a further connector according to the invention viewed from the above on the side of the fitting opening for a flexible printed circuit board.
Figure 16B:
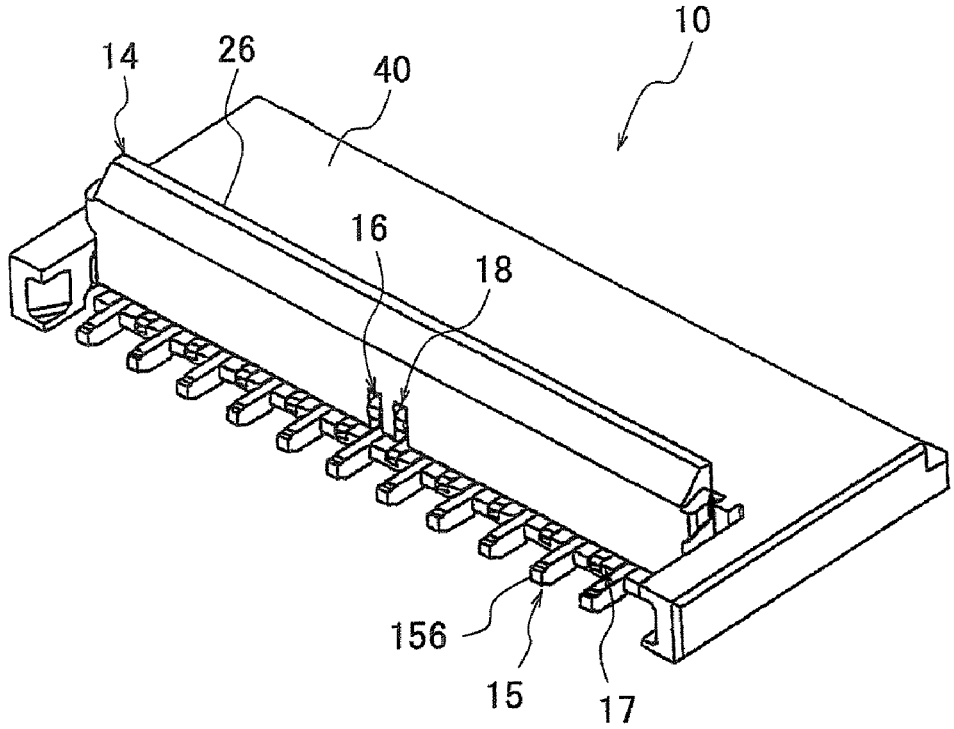
FIG. 16B is a perspective view of the connector shown in FIG. 16A viewed from the below on the opposite side of the fitting opening.
Figure 17A:
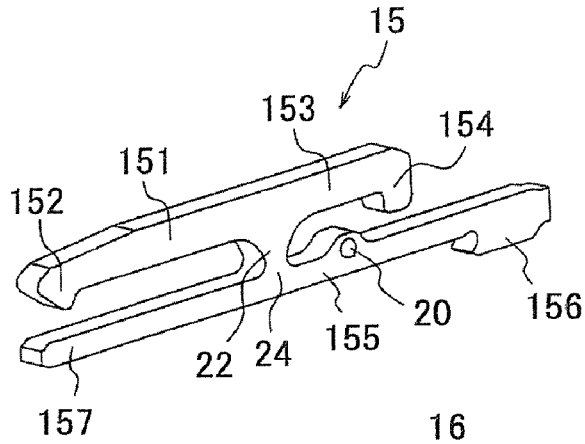
FIG. 17A is a perspective view of a first contact.
Figure 17B:
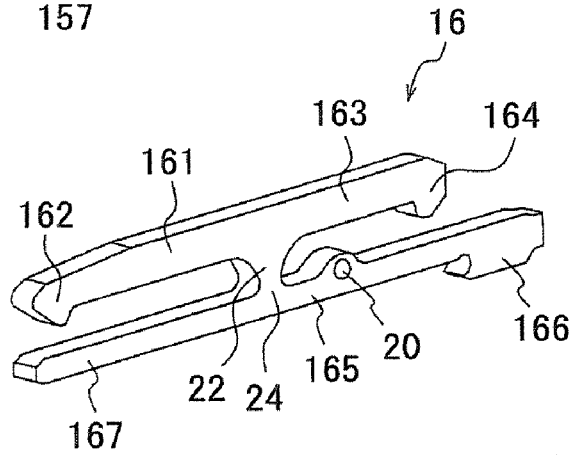
FIG. 17B is a perspective view of a second contact.
Figure 17C:
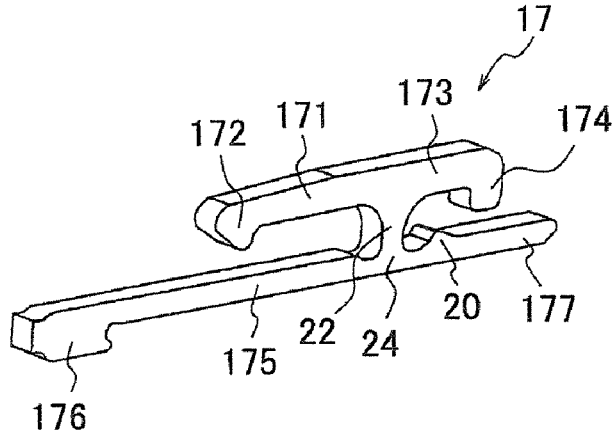
FIG. 17C is a perspective view of a third contact.
Figure 17D:
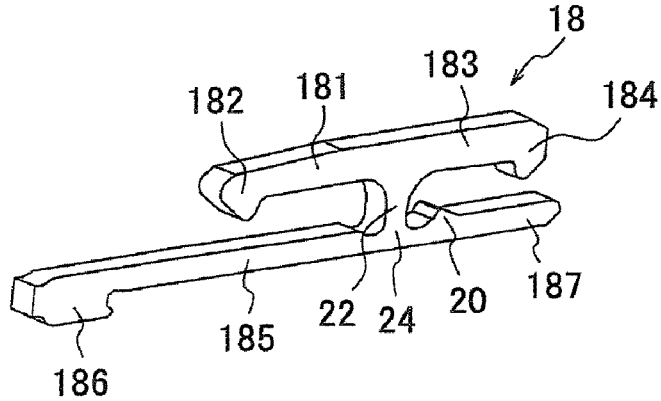
FIG. 17D is a perspective view of a fourth contact.
Figure 18A:
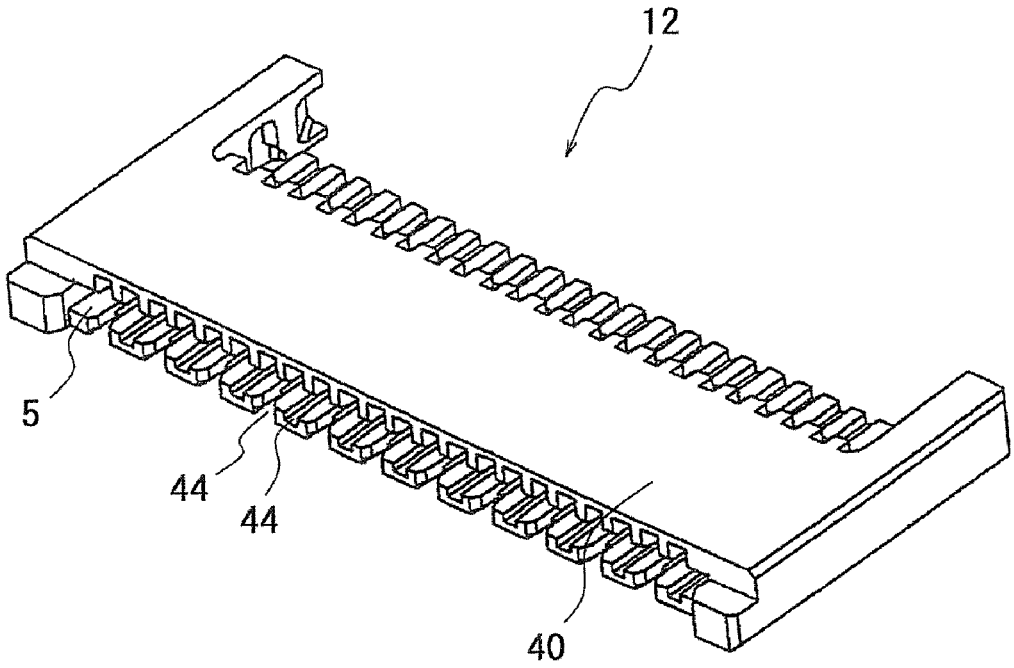
FIG. 18A is a perspective view of a housing viewed from the above on the side of its fitting opening.
Figure 18B:
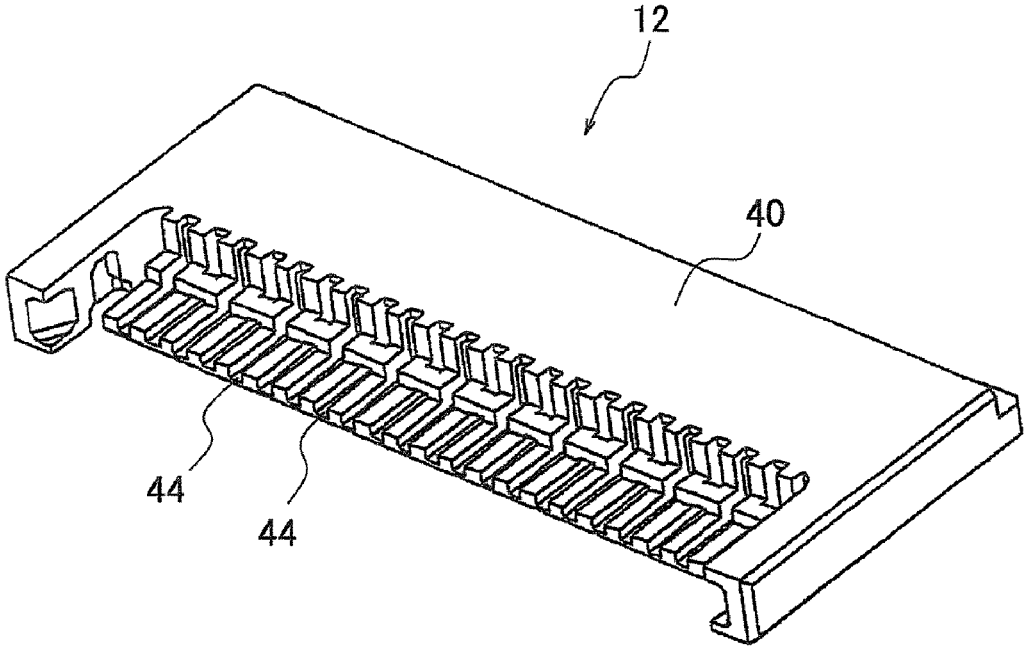
FIG. 18B is a perspective view of the housing shown in FIG. 18A viewed from the below on the opposite side of the fitting opening.
Figure 19:
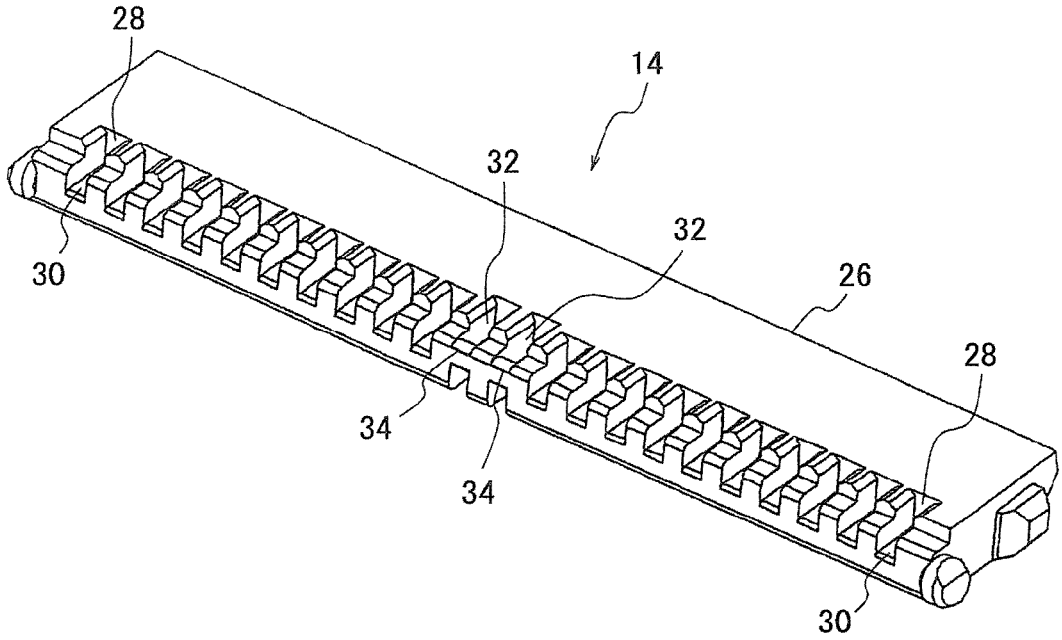
FIG. 19 is a perspective view of a pivoting member.
Figure 20A:
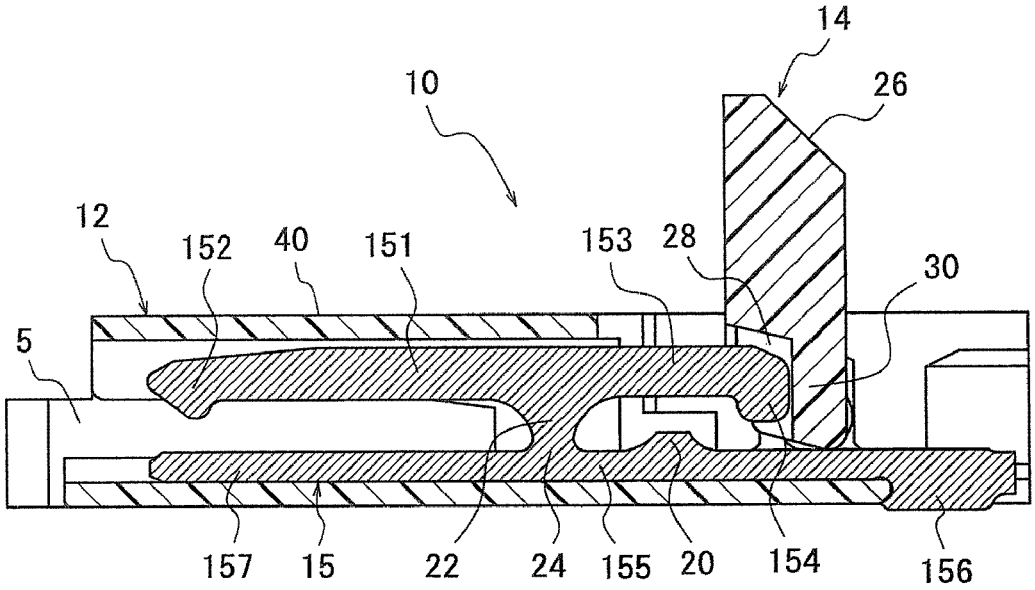
FIG. 20A is a sectional view of the connector with the pivoting member opened, taken along the first contact.
Figure 20B:
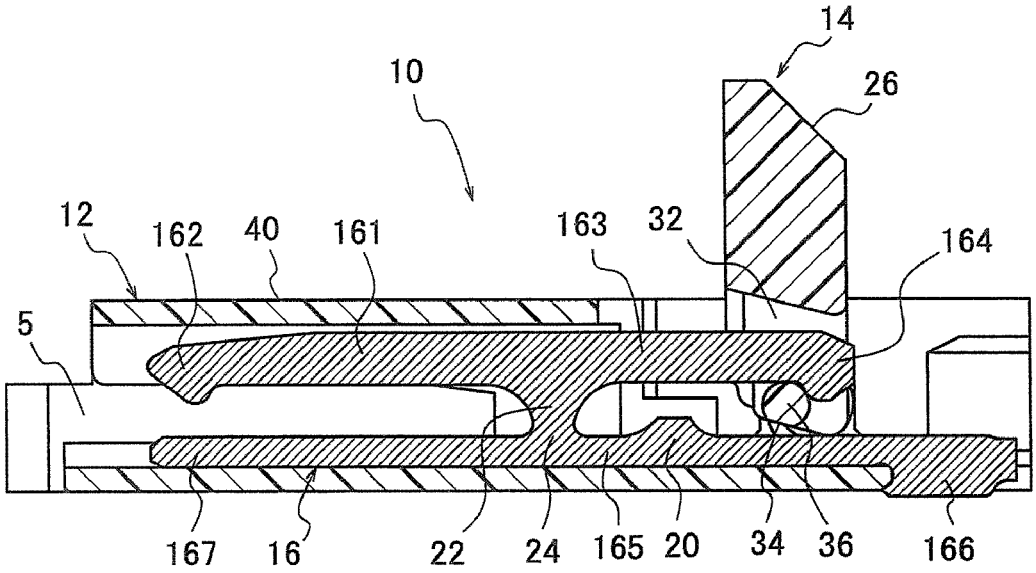
FIG. 20B is a sectional view of the connector with the pivoting member opened, taken along the second contact.
Figure 21A:
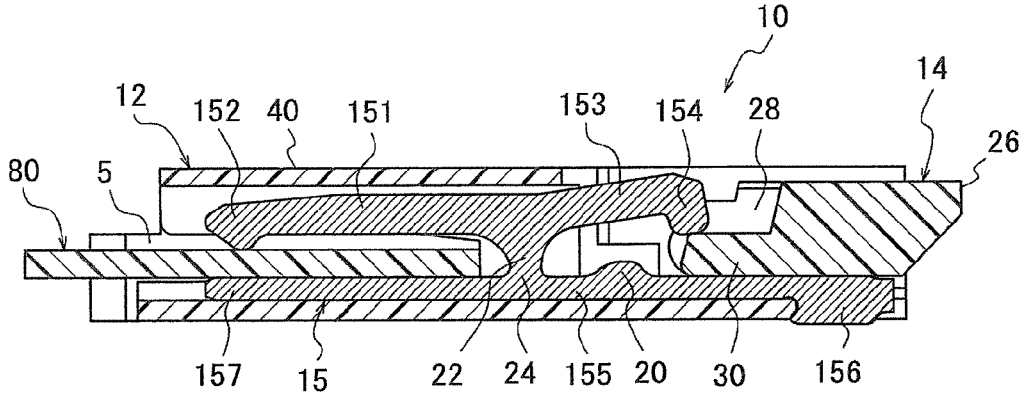
FIG. 21A is a sectional view of the connector with a flexible printed circuit board inserted and with the pivoting member closed, taken along the first contact.
Figure 21B:
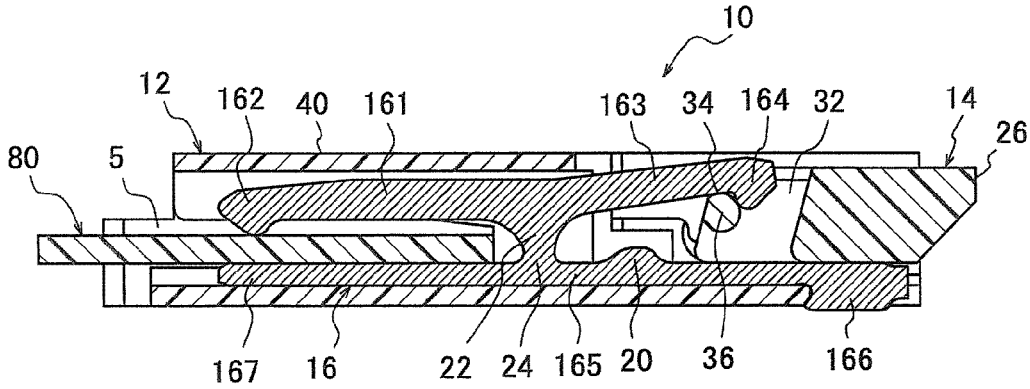
FIG. 21B is a sectional view of the connector with a flexible printed circuit board inserted and with the pivoting member closed, taken along the second contact.
Figure 22A:
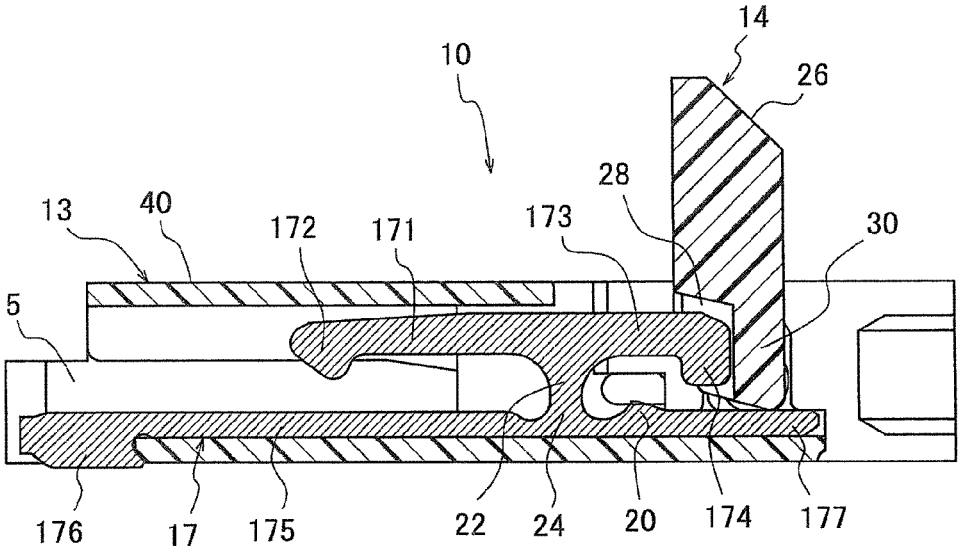
FIG. 22A is a sectional view of the connector with the pivoting member opened, taken along the third contact.
Figure 22B:
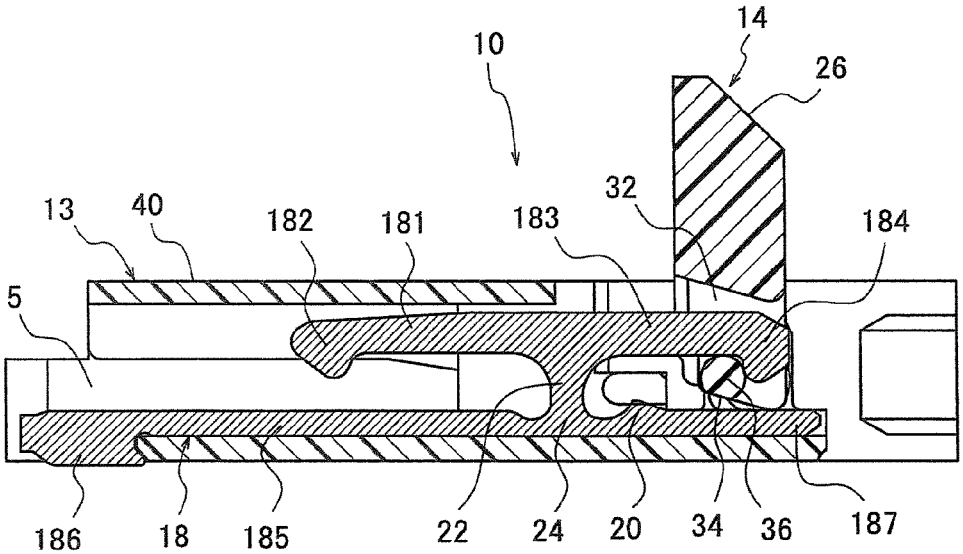
FIG. 22B is a sectional view of the connector with the pivoting member opened, taken along the fourth contact.
Figure 23A:
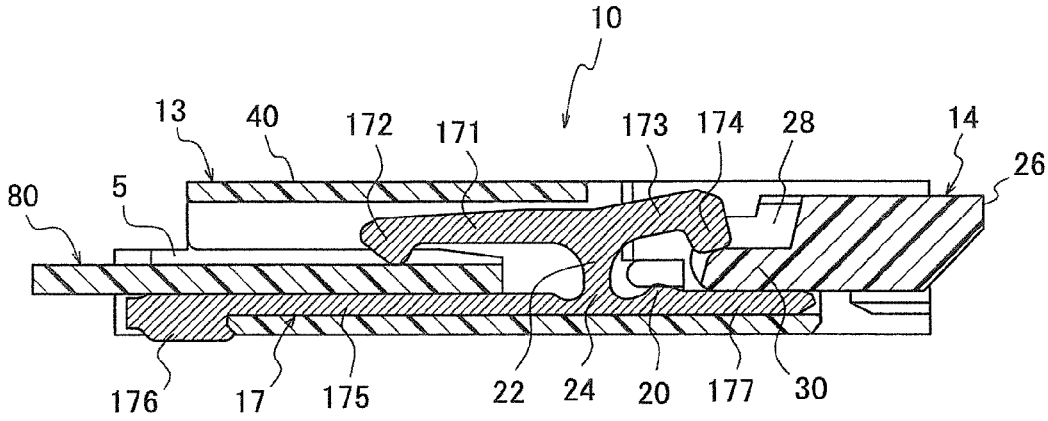
FIG. 23A is a sectional view of the connector with a flexible printed circuit board inserted and with the pivoting member closed, taken along the third contact.
Figure 23B:
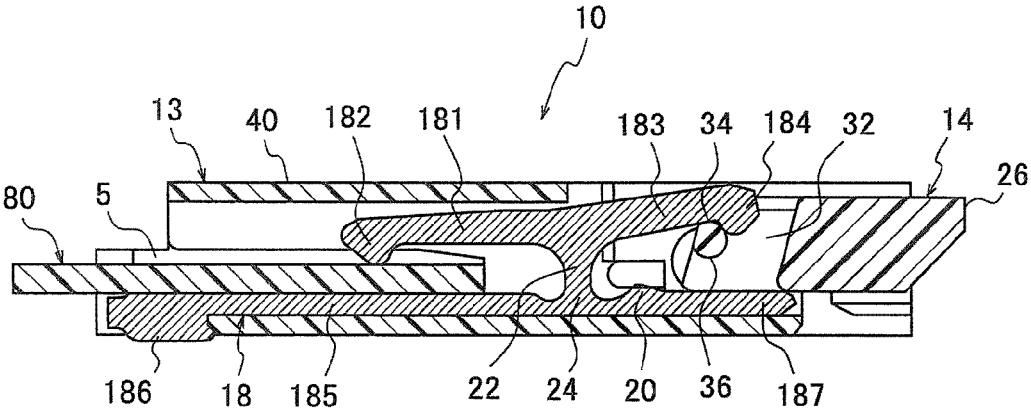
FIG. 23B is a sectional view of the connector with a flexible printed circuit board inserted and with the pivoting member closed, taken along the fourth contact.
Figure 24A:
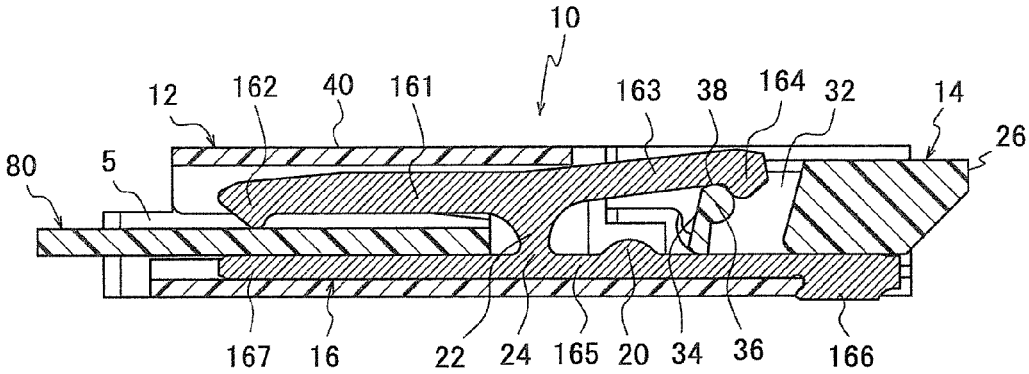
FIG. 24A is a sectional view of the connector with the flexible printed circuit board inserted and with the pivoting member closed, taken along the second contact different from that in FIG. 6B.
Figure 24B:
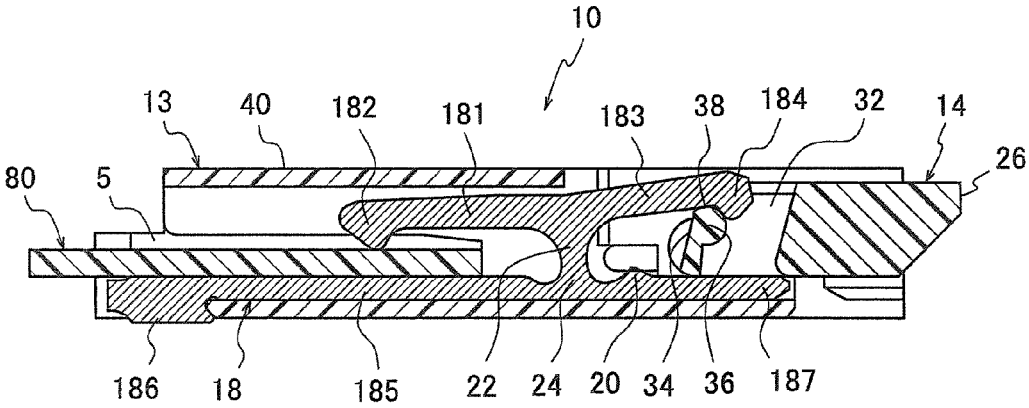
FIG. 24B is a sectional view of the connector with the flexible printed circuit board inserted and with the pivoting member closed, taken along the fourth contact different from that in FIG. 8B.

One embodiment of the connector 10 according to the invention will be explained with reference to FIGS. 16A to 23B. FIG. 16A is a perspective view of the connector according to the invention viewed from the above on the side of the fitting opening for a flexible printed circuit board, and FIG. 16B is a perspective view of the connector viewed from the below on the opposite side of the fitting opening. FIG. 17A is a perspective view of a first contact, and FIG. 17B is a perspective view of a second contact, while FIG. 17C is a perspective view of a third contact, and FIG. 17D is a perspective view of a fourth contact. FIGS. 18A and 18B are perspective views of a housing, and FIG. 19 is a perspective view of a pivoting member. FIG. 20A is a sectional view of the connector with the pivoting member opened, taken along the first contact, while FIG. 20B is a sectional view of the connector with the pivoting member opened, taken along the second contact. FIG. 21A is a sectional view of the connector with a flexible printed circuit board inserted and with the pivoting member closed, taken along the first contact, and FIG. 21B is a sectional view of the connector with a flexible printed circuit board inserted and with the pivoting member closed, taken along the second contact. FIG. 22A is a sectional view of the connector with the pivoting member opened, taken along the third contact, while FIG. 22B is a perspective view of the connector with the pivoting member opened, taken along the fourth contacts. FIG. 23A is a sectional view of the connector with the flexible printed circuit board inserted and with the pivoting member closed, taken along the third contact, while FIG. 23B is a sectional view of the connector with the flexible printed circuit board inserted and the pivoting member closed, taken along the fourth contact.

The connector 10 according to the invention mainly comprises a housing 12, three or four kinds of contacts (first, second, third, and fourth contacts 15, 16, 17 and 18), and a pivoting member 14.

Components of the connector 10 according to the invention will be explained with reference to the drawings. First, the four kinds of contacts will be explained. The first, second, third and fourth contacts 15, 16, 17 and 18 of the four kinds are both made of a metal and formed by means of the press-working of the known technique. Preferred metals from which to form first, second, third and fourth contacts 15, 16, 17 and 18 of the four kinds include brass, beryllium copper, phosphor bronze and the like which comply with the requirements as to springiness, electric conductivity, and the like. In the illustrated embodiment, the four kinds of contacts (first, second, third and fourth contacts 15, 16, 17 and 18) are inserted into inserting holes 44 of the housing 12 and fixed thereto.

Said first contact 15 comprises at least a first piece 151 having at one end a contact portion 152 and at the other end a pressure receiving portion 153, a second piece 155 having at its outer end a connection portion 156, and an elastic jointing portion (consisting of a fulcrum portion 24 and an elastic portion 22) for connecting the first piece 151 and the other end of said second piece 155. Said elastic jointing portion can be divided into the fulcrum portion 24 and the elastic portion 22 in the illustrated embodiment. In other words, said first contact 15 is substantially h-shaped and comprises the first piece 151 having at one end the contact portion 152 adapted to contact a flexible printed circuit board 80 (not shown in FIG. 17A) and at the other end the pressure receiving portion 153 to be pushed by said pivoting member 14, the second piece 155 having at one end the fulcrum portion 24 and at the other end the connection portion 156 to be connected to a substrate, and the elastic portion 22 for jointing the substantially middle portion of the first piece 151 and the fulcrum portion 24 of the second piece 155 (said elastic jointing portion consisting of the fulcrum portion 24 and the elastic portion 22), and further may comprises a fixed portion 20 on the second piece 155 in the proximity of the elastic jointing portion. The contact portion 152 of said first piece 151, the elastic portion 22, the fulcrum portion 24 and the connection portion 156 are arranged substantially in the form of a crank.

In the illustrated embodiment, the first contact 15 is further provided with an extension portion 157 extending from said fulcrum portion 24 in the direction opposite from said connection portion 156 (toward the fitting opening 5) so that the first contact 15 is substantially H-shaped as shown in FIG. 17A.

Said fixed portion 20 is provided on said second piece 155 in the proximity of the elastic jointing portion. The position and size of said fixed portion 20 may be suitably designed in consideration of the holding force for the first contact 15, the rising of the contact, stability of connectivity, and the like.

Said contact portion 152 is in the form of a protrusion for the purpose of facilitating the contact with the flexible printed circuit board 80. The connection portion 156 is of a surface mounting type (SMT) in the illustrated embodiment as shown in FIG. 16B. It may be of a dip type.

Said fulcrum portion 24, said elastic portion 22, and said pressure receiving portion 153 serve as the following description when said flexible printed circuit board 80 has been inserted into the connector 10. When the pivoting member 14 is being pivotally moved after the flexible printed circuit board 80 has been inserted into the fitting opening 5 of the housing 10, the pushing portions 30 of said pivoting member 14 enter the spaces between the connection portions 156 and the pressure receiving portions 153 of said first contacts 15, and are pivotally moved in the spaces, with the result that said pressure receiving portions 153 are raised upwardly by the pushing portions 30. Therefore, the elastic portions 22 of said first contacts 15 are tilted toward said contact portions 152 about the fulcrum portions 24 of the first contacts 15 by the upward movement of the pressure receiving portions 153, so that the contact portions 152 are pushed to the flexible printed circuit board 80. The sizes and shapes of said fulcrum portions 24, said elastic portions 22, and said pressure receiving portions 153 may be suitably designed so as to achieve these functions.

It is preferable to provide an extended surface 154 on the pressure receiving portion 153 of said first contact 15 so as to extend toward said connection portion 156 for facilitating the occurrence of the above functions. The pushing portions 30 of said pivoting member 14 come into surface contact with said extended surfaces 154 of said first contacts 15 to ensure the above functions and stable electrical connection. The size and shape of said extended surfaces may be suitably designed to achieve the above functions.

The second contact 16 will then be explained with reference to FIG. 17B. A great difference of the second contact 16 from the first contact 15 is in an extended portion 164 provided at the tip of the pressure receiving portion 163 of said second contact 16. The extended portion 164 of the second contact 16 engages an engaging rod 34 of the pivoting member 14 to obtain its assured pivotal (rotational) movement and to prevent the center portion of said pivoting member 14 from being deformed in a direction shown by an arrow A in FIG. 16A caused by the load (reaction force against the pivotal movement) acting upon the pivoting member 14 when it is being pivoted. The size of said extended portion 164 may be any one so long as it achieves such functions, and may be suitably designed such that the engaging rod 34 of said pivoting member 14 engages the extended portion 164 to achieve a stable pivotal (rotational) movement. The shape of said second contact 16 may be substantially h-shaped or H-shaped similarly to the first contact.

Said second contact 16 comprises at least a first piece 161 having at one end a contact portion 162 and at the other end a pressure receiving portion 163, a second piece 165 having at an outer end a connection portion 166, and an elastic jointing portion (consisting of a fulcrum portion 24 and an elastic portion 22) for connecting or jointing said first piece 161 and the other end of said second piece 165. Said elastic jointing portion can be divided into the fulcrum portion 24 and the elastic portion 22 in the illustrated embodiment. In other words, said second contact 16 is substantially h-shaped and comprises the first piece 161 having at one end the contact portion 162 adapted to contact the flexible printed circuit board 80 (not shown in FIG. 17B) and at the other end the pressure receiving portion 163 to be pushed by said pivoting member 14, the second piece 165 having at one end the fulcrum portion 24 and at the other end the connection portion 166 to be connected to the substrate, and the elastic portion 22 (said fulcrum portion 24 and said elastic portion 22 form the elastic jointing portion) for jointing the substantially middle portion of said first piece 161 and said fulcrum portion 24 of said second piece 165, and further may comprises a fixed portion 20 on said second piece 165 in the proximity of the elastic jointing portion. Said contact portion 162 of said first piece 161, said elastic portion 22, said fulcrum portion 24, and said connection portion 166 are arranged substantially in the form of a crank.

In the illustrated embodiment, said second contact 16 is provided with an extension portion 167 extending from said fulcrum portion 24 in the direction opposite from said connection portion 166 (toward the fitting opening 5) so that the second contact 16 is substantially H-shaped as shown in FIG. 17B.

As described above, said fixed portion 20 is provided on said second piece 165 in the proximity of its elastic jointing portion. The position and size of said fixed portion 20 may be designed taking into account the holding force for the second contact 16, the rising of the contact, stability of connectivity, and the like.

Said contact portion 162 is in the form of a protrusion in order to facilitate the contact with said flexible printed circuit board 80. Although said connection portion 166 is of a surface mounting type (SMT) as shown in FIG. 16B, it may be of a dip type.

In the illustrated embodiment, as shown in FIGS. 20B and 21B, when said engaging rod 34 of said pivoting member 14 is formed by merely a rod portion 36, said pressure receiving portion 163 only serves as a bearing, and said fulcrum portion 24 and said elastic portion 22 only serve to joint the first piece 161 and the second piece 165 of said second contact 16. In such a case, a space between the contact portion 162 and the extension portion 167 of said second contact 16 (the housing 12 in case of being free from the extension portion 167) is designed to be smaller than the thickness of the flexible printed circuit board 80 to be inserted into the space (a so-called non-zero insertion force (N-ZIF) structure), thereby achieving a stable connection of the connector and the flexible printed circuit board inserted therein.

In the case that said engaging rod 34 of said pivoting member 14 is formed as a cam portion 38 which includes the rod portion 36 and has a substantially L-shaped cross-section (not shown), said fulcrum portion 24, said elastic portion 22, and said pressure receiving portion 163 perform the following functions when the flexible printed circuit board 80 has been inserted into the connector 10. After the flexible printed circuit board 80 has been inserted into the fitting opening 5 of said housing 12, when the cam portion 38 of said pivoting member 14 is pivotally moved between the connection portion 166 and the pressure receiving portion 163 of said second contact 16, said pressure receiving portion 163 is raised upwardly by the cam portion 38 so that the elastic portion 22 of said second contact 16 is tilted toward said contact portion 162 about the fulcrum portion 24 of said second contact 16, thereby pushing said contact portion 162 to said flexible printed circuit board 80. The sizes and shapes of said fulcrum portion 24, said elastic portion 22, and said pressure receiving portion 163 may be suitably designed so as to achieve such a function.

Said third contact 17 comprises at least a first piece 171 having at one end a contact portion 172 and at the other end a pressure receiving portion 173, a second piece 175 having at one end a connection portion 176, and an elastic jointing portion (consisting of a fulcrum portion 24 and an elastic portion 22) for connecting or jointing the first piece 171 and the other end of said second piece 175. Said elastic jointing portion can be divided into the fulcrum portion 24 and the elastic portion 22 in the illustrated embodiment. In other words, said third contact 17 is substantially h-shaped and comprises the first piece 171 having at one end the contact portion 172 adapted to contact a flexible printed circuit board 80 (not shown in FIG. 17C) and at the other end the pressure receiving portion 173 to be pushed by said pivoting member 14, the second piece 175 having at one end the connection portion 176 to be connected to a substrate and at the other end the fulcrum portion 24, and the elastic portion 22 for jointing the substantially middle portion of the first piece 171 and the fulcrum portion 24 of the second piece 175 (said elastic jointing portion consisting of the fulcrum portion 24 and the elastic portion 22), and further may comprises a fixed portion 20 on an extension portion 177 (described in next paragraph) in the proximity of the elastic jointing portion. The contact portion 172 of said first piece 171, the elastic portion 22, the fulcrum portion 24 and the connection portion 176 are arranged substantially in the form of a U-shape.

In the illustrated embodiment, the third contact 17 is further provided with the extension portion 177 extending from said fulcrum portion 24 in the same direction extending the pressure receiving portion 173 (in opposite direction from the fitting opening 5) so that the third contact 17 is substantially H-shaped as shown in FIG. 17C.

Said fixed portion 20 is provided on said extension portion 177 in the proximity of the elastic jointing portion. The position and size of said fixed portion 20 may be suitably designed in consideration of the holding force for the third contact 17, the rising of the contact, stability of connectivity, and the like.

Said contact portion 172 is in the form of a protrusion for the purpose of facilitating the contact with the flexible printed circuit board 80. The connection portion 176 is of a surface mounting type (SMT) in the illustrated embodiment as shown in FIG. 16B. It may be of a dip type.

Said fulcrum portion 24, said elastic portion 22, and said pressure receiving portion 173 serve as the following description when said flexible printed circuit board 80 has been inserted into the connector 10. When the pivoting member 14 is being pivotally moved after the flexible printed circuit board 80 has been inserted into the connector 10, the pushing portions 30 of said pivoting member 14 enter the spaces between the extension portions 177 and the pressure receiving portions 173 of said third contacts 17 and are pivotally moved in the spaces, with the result that said pressure receiving portions 173 are raised upwardly. Therefore, the elastic portions 22 of said third contacts 17 are tilted toward said contact portions 172 about the fulcrum portions 24 of the third contacts 17 by the upward movement of the pressure receiving portions 173, so that the contact portions 172 are pushed to the flexible printed circuit board 80. The sizes and shapes of said fulcrum portions 24, said elastic portions 22, and said pressure receiving portions 173 may be suitably designed so as to achieve these functions.

It is preferable to provide an extended surface 174 on the pressure receiving portion 173 of said third contact 17 so as to extend toward said extension portion 177 for facilitating the occurrence of the above functions. The pushing portions 30 of said pivoting member 14 come into surface contact with said extended surfaces 174 of said third contacts 17 to ensure the above functions and more stable electrical connection. The size and shape of said extended surfaces may be suitably designed to achieve the above functions.

The fourth contact 18 will then be explained with reference to FIG. 17D. A great difference of the fourth contact 18 from the third contact 17 is in an extended portion 184 provided at the tip of the pressure receiving portion 183 of said fourth contact 18. The extended portion 184 of the fourth contact 16 engages the engaging rod 34 of the pivoting member 14 to obtain its assured pivotal (rotational) movement and to prevent the center portion of said pivoting member 14 from being deformed in a direction shown by an arrow A in FIG. 16A caused by the load (reaction force against the pivotal movement) acting upon the pivoting member 14 when it is being pivoted. The size of said extended portion 184 may be any one so long as it achieves such functions, and may be suitably designed such that the engaging rod 34 of said pivoting member 14 engages the extended portion 184 to achieve a stable pivotal (rotational) movement. The shape of said fourth contact 18 may be substantially h-shaped or H-shaped similarly to the third contact 17.

Said fourth contact 18 comprises at least a first piece 181 having at one end a contact portion 182 and at the other end a pressure receiving portion 183, a second piece 185 having at one end a connection portion 186, and an elastic jointing portion (consisting of a fulcrum portion 24 and an elastic portion 22) for connection or jointing said first piece 181 and the other end of said second piece 185. Said elastic jointing portion can be divided into the fulcrum portion 24 and the elastic portion 22 in the illustrated embodiment. In other words, said fourth contact 18 is substantially h-shaped and comprises the first piece 181 having at one end the contact portion 182 adapted to contact the flexible printed circuit board 80 (not shown in FIG. 17D) and at the other end the pressure receiving portion 183 to be pushed by said pivoting member 14, the second piece 185 having at one end the connection portion 186 to be connected to the substrate and at the other end the fulcrum portion 24, and the elastic portion 22 (said fulcrum portion 24 and said elastic portion 22 form the elastic jointing portion) for connecting or jointing the substantially middle portion of said first piece 181 and said fulcrum portion 24 of said second piece 185, and further may comprises a fixed portion 20 on an extension portion 187 (described in next paragraph) in the proximity of the elastic jointing portion. Said contact portion 182 of said first piece 181, said elastic portion 22, said fulcrum portion 24, and said connection portion 186 are arranged substantially in the form of a U-shape.

In the illustrated embodiment, said fourth contact 18 is provided with the extension portion 187 extending from said fulcrum portion 24 in the direction opposite from said connection portion 186 (away from the fitting opening 5) so that the second contact 16 is substantially H-shaped as shown in FIG. 17D.

As described above, said fixed portion 20 is provided on said extension portion 187 in the proximity of its elastic jointing portion. The position and size of said fixed portion 20 may be designed taking into account the holding force for the fourth contact 18, the rising of the contact, stability of connectivity, and the like.

Said contact portion 182 is in the form of a protrusion in order to facilitate the contact with said flexible printed circuit board 80. Although said connection portion 186 is of a surface mounting type (SMT) as shown in FIG. 16B, it may be of a dip type.

In the illustrated embodiment, as shown in FIGS. 22B and 23B, when said engaging rod 34 of said pivoting member 14 is formed by merely a rod portion 36, said pressure receiving portion 183 only serves as a bearing, and said fulcrum portion 24 and said elastic portion 22 only serve to joint the first piece 181 and the second piece 185 of said fourth contact 18. In such a case, a space between the contact portion 182 and the connection portion 186 of said fourth contact 18 is designed to be smaller than the thickness of the flexible printed circuit board 80 to be inserted into the space (a so-called non-zero insertion force (N-ZIF) structure), thereby achieving a stable connection of the connector and the flexible printed circuit board inserted therein.

In the case that said engaging rod 34 of said pivoting member 14 is formed as a cam portion 38 which includes the rod portion 36 and has a substantially L-shaped cross-section (although not shown in FIGS. 16A to 23B), said fulcrum portion 24, said elastic portion 22, and said pressure receiving portion 163 perform the following functions when the flexible printed circuit board 80 has been inserted into the connector 10. After the flexible printed circuit board 80 has been inserted into the fitting opening 5 of said housing 13, when the cam portion 38 of said pivoting member 14 is pivotally moved between the pressure receiving portion 183 and the extension portion 187 (housing 13 in case of being free from the extension portion) of said fourth contact 18, said pressure receiving portion 183 is raised upwardly by the cam portion 38 so that the elastic portion 22 of said fourth contact 18 is tilted toward said contact portion 182 about the fulcrum portion 24 of said fourth contact 18, thereby pushing said contact portion 182 to said flexible printed circuit board 80. The sizes and shapes of said fulcrum portion 24, said elastic portion 22, and said pressure receiving portion 183 may be suitably designed so as to achieve such a function.

The pivoting member 14 will then be explained. The pivoting member 14 is formed from an electrically insulating plastic material by means of the injection molding of the known technique. The materials for the pivoting member 14 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC), polyphenylene sulfide (PPS), and the like, and synthetic materials thereof. Said pivoting member 14 mainly comprises an actuating portion 26, axles to be fitted in the housing 12 for pivotally moving the pivoting member relative to the housing 12, anchoring grooves 28 for receiving the pressure receiving portions 153 of said first contacts 15, pushing portions 30 for pushing the pressure receiving portions 153, an anchoring hole or holes 32 for receiving the pressure receiving portions 163 of said second contacts 16, and an engaging rod or rods 34 adapted to engage the extended portions 164. Said axles are fulcrums for pivotally moving the pivoting member 14 and suitably fitted in both the longitudinal ends of the housing 12 so as to permit the pivoting member 14 to be pivotally moved.

According to the invention, made to be different from each other are shapes of the portions (the pushing portions 30, the engaging rod or rods 34, and the like) of said pivoting member 14 with which the pressure receiving portions 153, 163, 173 and 183 of said first, second, third and fourth contacts 15, 16, 17 and 18 are engaged, respectively. In other words, in order to prevent said pivoting member 14 from being deformed (warped) in the direction shown by the arrow A in FIG. 16A due to the load (reaction against the pivotal movement) when the pivoting member 14 is being pivotally moved (rotated), said second and fourth contacts 16 and 18 are arranged at optional locations instead of either or both of the first and third contacts 15 and 17.

Regarding the portions (the pushing portions 30) of said pivoting member 14 cooperating with said first and third contacts 15 and 17 and said anchoring grooves 28 whose bottom surfaces are formed substantially in the form of a plate, when said pivoting member 14 is pivotally moved (rotated), during the initial stage of which pivotal movement, the pushing portions 30 do not contact said first and third contacts 15 and 17 and in the state that the pivotal movement has been completed, the extended surfaces 154 and 174 of the pressure receiving portions 153 and 173 of said first and third contacts 15 and 17 are raised upwardly by the surfaces of said pushing portions 30, that is, the pushing portions 30 are exerted on said first and third contacts 15 and 17 as described above, thereby bringing the contact portions 152 and 172 of said first and third contacts 15 and 17 into contact with the inserted flexible printed circuit board 80. Preferably, the shape of said pushing portions 30 is substantially in the form of a plate. With such plate-shaped pushing portions 30, the extended surfaces 154 and 174 of said first and third contacts 15 and 17 can be raised upwardly by the surfaces of said pushing portions 30 (the bottom surfaces of the anchoring grooves 28) when the pivoting member 14 is pivotally moved. By causing the surfaces to contact each other, the extended surfaces can be securely raised and at the same time the load acting upon the pivoting member when pivotally moving can be reduced.

The size of said pushing portions 30 is determined so as to be larger than the distances between the extended surfaces 154 and 174 and the connection portion 156 and 176 of said first and third contacts 15 and 17 so that the functions described above can be achieved. The pushing portions 30 may be suitably designed in consideration of the elasticity of the contacts, contact pressure, strength, and the like.

Said engaging grooves 28 are blind holes (grooves) and are independent from one another in order to maintain the strength of said pivoting member 14 to avoid the pivoting member 14 from being damaged when it is pivotally moving. The depth of said engaging grooves 28 may be suitably designed so as to achieve the functions described above taking into account the relation to the thickness of said pushing portions 30, the elasticity of the contacts, contact pressure, strength and the like.

Figure 25A:
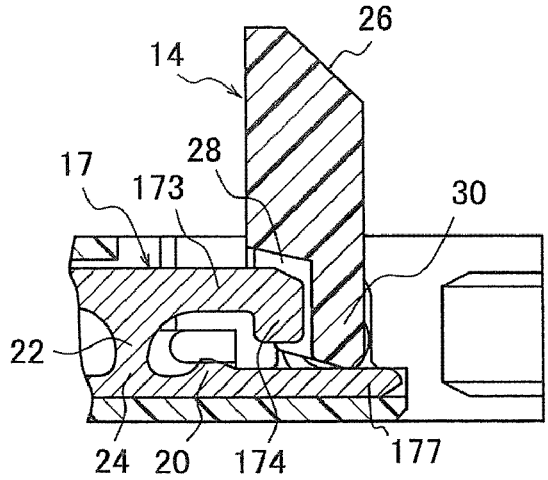
FIG. 25A is a view for explaining the insertion and pivoting movement of a pushing portion of the pivoting member acting on the third contact.
Figure 25B:
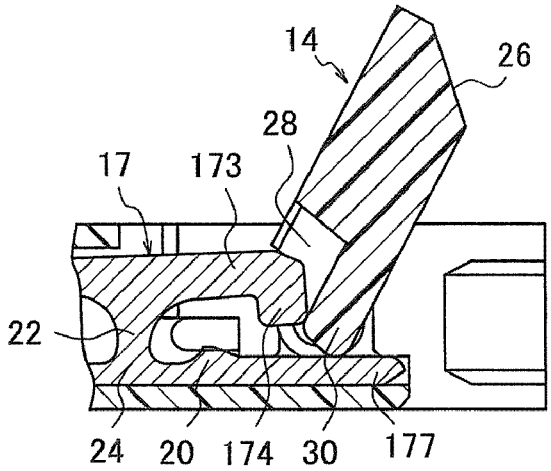
FIG. 25B is a view illustrating the state that the pivoting member has been pivoted by some degrees.
Figure 25C:
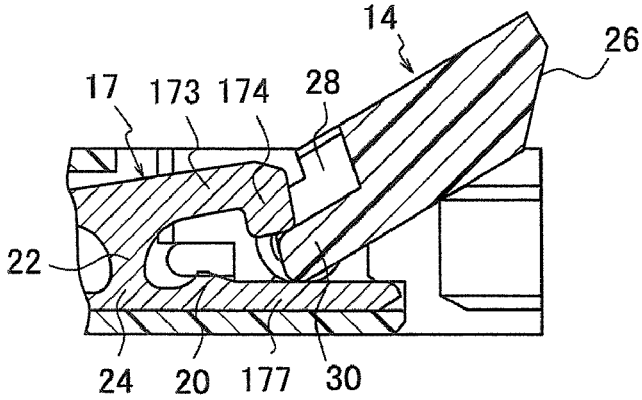
FIG. 25C is a view illustrating the state that the pivoting member has been pivoted further.
Figure 25D:
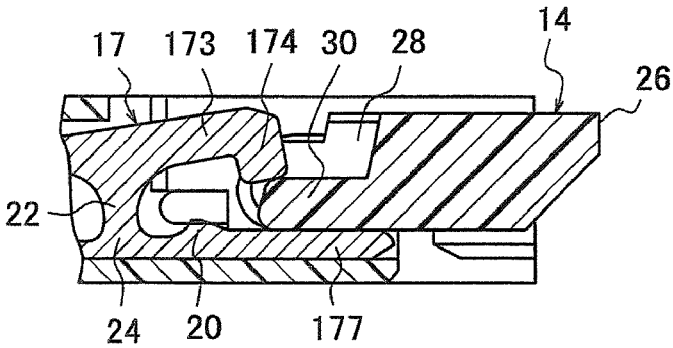
FIG. 25D is a view illustrating the state that the pivoting member has been pivoted in its closed position.

Insertion and pivotal movement of the pushing portions 30 will be explained herein with reference to FIGS. 25A to 25D. First, when the flexible printed circuit board 80 is not inserted into the connector 10, the pivoting member 14 stands substantially upright as shown in FIG. 25A. Then, the flexible printed circuit board 80 is inserted and the pivoting member 14 is started to be pivotally moved, during initial stage of which the pushing portion 30 does not contact the extended surfaces 154 and 174 of the first and third contacts 15 and 17 as shown in FIG. 25B. When the pivoting member 14 is further pivotally moved, the tip of said pushing portion 30 comes into line contact with the extended surfaces 154 and 174 as shown in FIG. 25C. Upon further pivotal movement, the pivoting member 14 becomes substantially parallel to the housing 12 and said pushing portion 30 comes into surface contact with the extended surfaces 154 and 174 to cause the extended surfaces 154 and 174 to be raised by said pushing portion 30 as shown in FIG. 25D.

There is a case that the portions (the engaging rods 34) of said pivoting member 14 cooperating with said second and fourth contacts 16 and 18 are only the rod portions 36 (the non-zero insertion force (N-ZIF) structure as described above) as shown in FIGS. 20B and 21B, or there is a case that the engaging rod 34 is the cam portion 38 having the substantially L-shaped cross-section including the engaging rod 34 and the rod portion 36 as shown FIGS. 13A and 13B.

In the case that the engaging rods 34 are the rod portions 36 only (the non-zero insertion force (N-ZIF) structure as described above), the rod portions 36 only need to engage the extended portion 164 and 184 of the second and fourth contacts 16 and 18 and rotate and to be sufficient to prevent the pivoting member 14 from being deformed in the direction shown by the arrow A in FIG. 16A due to the load (the reaction force against the pivotal movement) when the pivoting member 14 is pivotally moving. In the illustrated embodiment, said rod portions 36 are substantially in the form of a cylindrical column. The size of said rod portions 36 may be suitably designed in consideration of the deformation or warping and strength of the pivoting member 14, miniaturization of the connector, pivotal (rotational) movability, the size of the extended portions 164 and 184 of the second and fourth contacts 16 and 18, and the like.

In the case that the engaging rods 34 are the cam portions 38 each having the substantially L-shaped cross-section including the engaging rod 34 and the rod portion 36, first, the rod portions 36 only need to engage the extended portions 164 and 184 of said second and fourth contacts 16 and 18 and rotate and to be sufficient to prevent the pivoting member 14 from being deformed in the direction shown by the arrow A in FIG. 16A due to the load (the reaction force against the pivotal movement) when the pivoting member 14 is pivotally moving. Further, the cam portions 38 only need to raise the pressure receiving portions 163 and 183 of said second and fourth contacts 16 and 18 by the difference in contact height of the cam portions 38 (the cross-sections of the cam portions 38 are not perfectly circular) when the cam portions 38 are pivotally moved (rotated) so that the function described above occurs, thereby enabling the contact portions 162 and 182 of said second and fourth contacts 16 and 18 to contact the flexible printed circuit board 80. In the illustrated embodiment, the rod portions 36 are substantially column-shaped, and the size of said rod portions 36 may be suitably designed in consideration of the deformation (warping) and strength of said pivoting member 14, miniaturization of the connector 10, pivotal (rotational) movability, the size of the extended portion 164 and 184 of the second and fourth contacts 16 and 18, and the like. Moreover, the cam portions 38 may be suitably designed so as to achieve the functions described above, taking into account the elasticity, contact pressure and strengths of the contacts, and the like.

Said pivoting member 14 is provided with anchoring holes 32 which are through-holes and independent from each other and are located at positions corresponding to those of said second and fourth contacts 16 and 18. Said anchoring holes 32 may be suitably designed so that the pressure receiving portions 163 and 183 of said second and fourth contacts 16 and 18 are received in said anchoring holes 32, and said extended portions 164 and 184 engage said rod portions 36, thereby enabling a stable pivotal movement of said engaging rods 34.

The actuating portion 26 of said pivoting member 14 may be of any shape and size insofar as it enables said pivoting member 14 to be actuated to be pivotally moved, and may be suitably designed taking into account its operationality and strength.

Figure 26A:
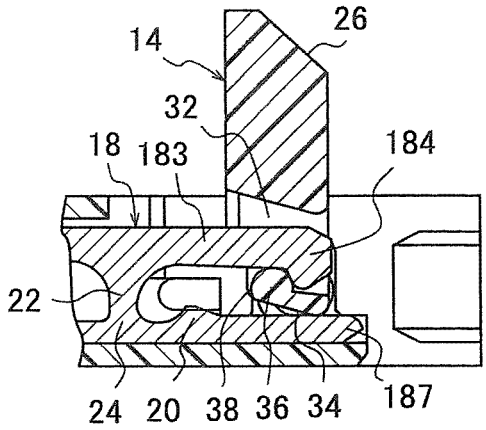
FIG. 26A is a view for explaining the insertion and pivoting movement of a pushing portion of the pivoting member acting on the fourth contact.
Figure 26B:
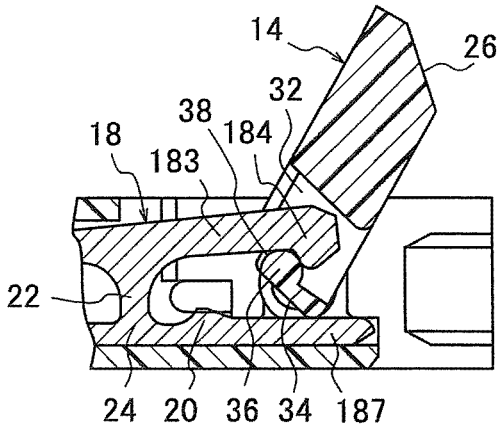
FIG. 26B is a view illustrating the state that the pivoting member has been pivoted by some degrees.
Figure 26C:
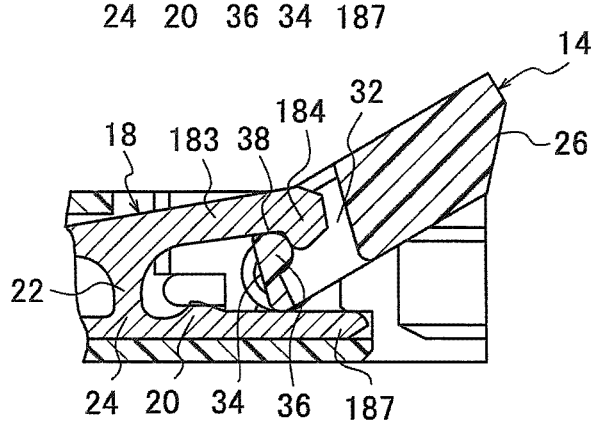
FIG. 26C is a view illustrating the state that the pivoting member has been pivoted further.
Figure 26D:
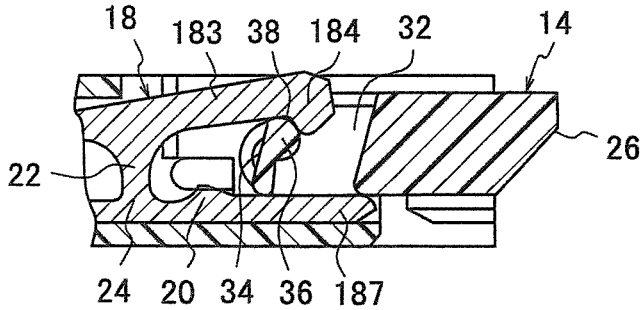
FIG. 26D is a view illustrating the state that the pivoting member has been pivoted in its closed position.

The pivotal movement of said cam portion 38 cooperating with the fourth contact 18 will be explained herein with reference to FIGS. 26A to 26D. First, when the flexible printed circuit board 80 is not inserted into the connector 10, the pivoting member 14 stands substantially upright as shown in FIG. 26A. Then, the flexible printed circuit board 80 is inserted and the pivoting member 14 is started to be pivotally moved, during initial stage of which the cam portion 38 is rotated about the rod portion 36 of said cam portion 38 as a rotating center and the cam portion 38 is in an inclined position at substantially 45 degrees as shown in FIG. 26B. When the pivoting member 14 is further pivotally moved, the cam portion 38 is rotated about the rod portion 36 of said cam portion 38 as a rotating center, and the cam portion 38 is in a substantially vertical position as shown in FIG. 26C. When the pivoting member 14 is further pivotally moved, the cam portion 38 is rotated about the rod portion 36 of said cam portion 38 as a rotating center, and the cam portion 38 is in substantially vertical position and slightly tilted to the right viewed in the drawing of FIG. 26D so that said pressure receiving portions 163 and 183 are raised by said cam portion 38.

Finally, the housing 12 will be explained. The housing 12 is formed from an electrically insulating plastic material by means of the injection molding of the known technique. The materials for the housing 12 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC) and the like and synthetic materials thereof.

The housing 12 is formed with inserting holes 44 into which a required number of the contacts are inserted and fixed, respectively, by means of press-fitting, hooking (lancing), welding, or the like.

The housing 12 is further formed at both the longitudinal ends with bearings into which the axles of the pivoting member 14 are fitted so as to permit the pivoting member 14 to be pivotally movable. The shape and size of the bearings may be any ones so long as the pivoting member 14 is pivotally moved, and may be suitably designed taking into account their functions, the strength and the size of the housing 12, and the like.

Moreover, the housing 12 is provided with a ceiling portion 40 for covering or insulating the contact portions 152, 162, 172 and 182 of the first pieces 151, 161, 171 and 181 of said first, second, third and fourth contacts 15, 16, 17 and 18. It is preferable to provide a conducting portion at the outer peripheries of the fitting opening 5 of said housing 12 for facilitating the insertion of a connecting object such as the flexible printed circuit board 80.

The arrangement of said first, second, third and fourth contacts 15, 16, 17 and 18 according to the invention will be explained. In the case that the number of the contacts is ten (10) or less, said first and third contacts 15 and 17 only are used. Said first contacts 15 and said third contacts 17 are alternately arranged to be staggered. If the number of the contacts is more than ten (10), said second and fourth contacts 16 and 18 are used instead of either or both of the first and third contacts 15 and 17 at optional positions. In other words, in the case that the number of the contacts is more than ten, it is envisioned that said pivoting member 14 may be deformed or warped due to the load when it is pivotally moving, such a deformation of said pivoting member 14 is prevented by causing the engaging rods 34 of said pivoting member 14 to engage the extended portions 164 and 184 of said second and fourth contacts 16 and 18. Said second and fourth contacts 16 and 18 may be provided at any locations so long as the deformation or warping of the pivoting member 14 can be prevented. In the case that the number of the contacts is more than ten, it is effective (desirable) to arrange the second and fourth contacts 16 and 18 at locations corresponding to about every fifth contact. From the standpoint of manufacturing cost (die cost and managing expense), it is preferable to arrange the first and fourth contacts 15 and 18 alternately to be staggered or the second and third contacts 16 and 17 alternately to be staggered.

Examples of applications of the invention are connectors for use in mobile or cellular phones, notebook personal computers, digital cameras and the like, and more particularly connectors superior in stable electrical connection without a pivoting member being damaged when the pivoting member is being pivotally moved after a connecting object such as a flexible printed circuit board and a flexible flat cable has been inserted, even if pitches of contacts of the connectors become smaller (miniaturization of the connectors) and wall thicknesses of insulators of the connectors become as thin as possible.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A connector to be detachably fitted with a connecting object, said connector including a required number of contacts each having a contact portion adapted to contact said connecting object and a connection portion to be connected to a substrate, a housing having inserting holes for arranging and holding said contacts inserted in said inserting holes and a fitting opening into which said connecting object is inserted, and a pivoting member mounted on said housing on an opposite side of said fitting opening and acting upon said contacts to bring them into contact with said connecting object, wherein said contacts consist of two kinds, wherein said contacts of a first kind termed as first contacts each comprises a first piece having at one end a contact portion and at another end a pressure receiving portion, a second piece having at an outer end said connection portion, and an elastic portion and a fulcrum portion positioned between said contact portion and said connection portion and jointing said first piece and the another end of said second piece, and said contact portion, said elastic portion, said fulcrum portion and said connection portion being arranged substantially in the form of a crank, wherein said pivoting member is provided with anchoring grooves independent from one another for receiving the pressure receiving portions of said first contacts, respectively, and said pivoting member is further provided with pushing portions formed by bottoms of said anchoring grooves, said pushing portions acting upon said pressure receiving portions of said first contacts, respectively, when said pivoting member is being pivotally moved (rotated), wherein said contacts of a second kind termed as second contacts each comprise a first piece having at one end said contact portion and at the another end a pressure receiving portion provided with an extended portion at the tip of the pressure receiving portion and a second piece, an elastic portion and a fulcrum portion are likewise with said first contacts, and said pivoting member is further provided with an anchoring hole or holes independent from one another each for receiving the pressure receiving portion of said second contact, and said pivoting member is further provided with an engaging rod or rods each engaging said extended portion of said second contact, wherein said first and second contacts are alternately arranged to be staggered, wherein the anchoring grooves have a different shape from the anchoring hole or holes, and wherein the pushing portions have a different second shape from the engaging rod or rods.

2. The connector as claimed in claim 1 wherein said engaging rods are each formed as a cam portion having a substantially L-shaped cross-section including the rod portion, and when said pivoting member is pivotally moved about the rod portions of said cam portions as a center of the pivotal movement, the pressure receiving portions of said second contacts are raised by said cam portions.

3. The connector as claimed in claim 1, wherein said first contacts and said second contacts are each provided with an extension portion extending from said fulcrum portion to a location facing to said contact portion or said pressure receiving portion.

4. The connector as claimed in claim 1, wherein said pressure receiving portion is provided with an extended surface adapted to contact a surface of said pushing portion of said pivoting member.

5. A connector to be detachably fitted with a connecting object, said connector including a required number of contacts each having a contact portion adapted to contact said connecting object and a connection portion to be connected to a substrate, a housing having inserting holes for arranging and holding said contacts inserted in said inserting holes and a fitting opening into which said connecting object is inserted, and a pivoting member mounted on said housing on the opposite side of said fitting opening and acting upon said contacts to bring them into contact with said connecting object, wherein said contacts each comprise a first piece having at one end said contact portion and at the other end a pressure receiving portion, a second piece having at an outer end said connection portion, and an elastic portion and a fulcrum portion positioned between said contact portion and said connection portion and jointing said first piece and the other end of said second piece, and said contact portion, said elastic portion, said fulcrum portion and said connection portion being arranged substantially in the form of a crank, and such type of contacts are named as first contacts, wherein said pivoting member is provided with anchoring grooves independent from one another for receiving the pressure receiving portions of said first contacts, respectively, and said pivoting member is further provided with pushing portions formed by bottoms of said anchoring grooves, said pushing portions acting upon said pressure receiving portions of said first contacts, respectively, when said pivoting member is being pivotally moved (rotated), wherein when the number of said contacts is a predetermined number or less, said first contacts only are installed in said housing, wherein when the number of said contacts is more than said predetermined number, one or more of said first contacts are each provided with an extended portion located at the tip of the pressure receiving portion of said first contact and extending toward said connection portion, such type of contacts being named as second contacts, and said pivoting member is further provided with an anchoring hole or holes independent from one another each for receiving the pressure receiving portion of said second contact, and said pivoting member is further provided with an engaging rod or rods each engaging said extended portion of said second contact, wherein said second contact is arranged instead of at least one of said first contacts at an arbitrary location so as to prevent said pivoting member from being warped, wherein the anchoring grooves have a different shape from the anchoring hole or holes, and wherein the pushing portions have a different second shape from the engaging rod or rods.

6. The connector as claimed in claim 5, wherein said first contacts and said second contacts are alternately arranged to be staggered.

7. The connector as claimed in claim 5, wherein said pushing portions are substantially plate-shaped, and when said pivoting member is being pivotally moved, during initial stage of which said pushing portions do not contact said first contacts, and in the state that the pivotal movement of said pivoting member has been completed, surfaces of said pushing portions cause the pressure receiving portions of said first contacts to be raised.

8. The connector as claimed in claim 5, wherein in the case that said engaging rods each comprises a rod portion only, a spacing between the contact portions of said second contacts and said housing is smaller than the thickness of said connecting object.

9. The connector as claimed in claim 5, wherein said engaging rods are each formed as a cam portion having a substantially L-shaped cross-section including the rod portion, and when said pivoting member is pivotally moved about the rod portions of said cam portions as a center of the pivotal movement, the pressure receiving portions of said second contacts are raised by said cam portions.

10. The connector as claimed in claim 5, wherein said first and second contacts are each provided with an extension portion extending from said fulcrum portion to a location facing to said contact portion or said pressure receiving portion.

11. A connector to be detachably fitted with a connecting object, said connector including a required number of contacts each having a contact portion adapted to contact said connecting object and a connection portion to be connected to a substrate, a housing having inserting holes for arranging and holding said contacts inserted in said inserting holes and a fitting opening into which said connecting object is inserted, and a pivoting member mounted on said housing on the opposite side of said fitting opening and acting upon said contacts to bring them into contact with said connecting object, wherein said contacts each comprise a first piece having at one end said contact portion and at the other end a pressure receiving portion, a second piece having at one end said connection portion, and an elastic portion and a fulcrum portion positioned between said contact portion and said connection portion and jointing said first piece and the other end of said second piece, and said contact portion, said elastic portion, said fulcrum portion and said connection portion being arranged substantially in a U-shape, and such type of contacts are named as first contacts, wherein said pivoting member is provided with anchoring grooves independent from one another for receiving the pressure receiving portions of said first contacts, respectively, and said pivoting member is further provided with pushing portions formed by bottoms of said anchoring grooves, said pushing portions acting upon said pressure receiving portions of said first contacts, respectively, when said pivoting member is being pivotally moved (rotated), wherein when the number of said contacts is a predetermined number or less, said first contacts only are installed in said housing, wherein when the number of said contacts is more than said predetermined number, one or more of said first contacts are each provided with an extended portion located at the tip of the pressure receiving portion of said first contact and extending toward said housing, such type of contacts being named as second contacts, and said pivoting member is further provided with an anchoring hole or holes independent from one another each for receiving the pressure receiving portion of said second contact and said pivoting member is further provided with an engaging rod or rods each engaging said extended portion of said second contact, wherein said first and second contacts are alternately arranged to be staggered so as to prevent said pivoting member from being warped, wherein the anchoring grooves have a different shape from the anchoring hole or holes, and wherein the pushing portions have a different second shape from the engaging rod or rods.

12. The connector as claimed in claim 11, wherein said pushing portions are substantially plate-shaped, and when said pivoting member is being pivotally moved, during initial stage of which said pushing portions do not contact said first contacts, and in the state that the pivotal movement of said pivoting member has been completed, surfaces of said pushing portions cause the pressure receiving portions of said first contacts to be raised.

13. The connector as claimed in claim 11, wherein in the case that said engaging rods each comprises a rod portion only, a spacing between the contact portions of said second contacts and said housing is smaller than the thickness of said connecting object.

14. The connector as claimed in claim 11, wherein said engaging rods are each formed as a cam portion having a substantially L-shaped cross-section including the rod portion, and when said pivoting member is pivotally moved about the rod portions of said cam portions as a center of the pivotal movement, the pressure receiving portions of said second contacts are raised by said cam portions.

15. The connector as claimed in claim 11, wherein said first and second-contacts are each provided with an extension portion extending from said fulcrum portion to a location facing to said contact portion or said pressure receiving portion.

16. A connector to be detachably fitted with a connecting object, said connector including a required number of contacts each having a contact portion adapted to contact said connecting object and a connection portion to be connected to a substrate, a housing having inserting holes for arranging and holding said contacts inserted in said inserting holes and a fitting opening into which said connecting object is inserted, and a pivoting member mounted on said housing on the opposite side of said fitting opening and acting upon said contacts to bring them into contact with said connecting object, wherein said contacts each comprise a first piece having at one end said contact portion and at the other end a pressure receiving portion, a second piece having at one end said connection portion, and an elastic portion and a fulcrum portion positioned between said contact portion and said connection portion and jointing said first piece and the other end of said second piece, and said contact portion, said elastic portion, said fulcrum portion and said connection portion being arranged substantially in a U-shape, and such type of contacts are named as first contacts, wherein said pivoting member is provided with anchoring grooves independent from one another for receiving the pressure receiving portions of said first contacts, respectively, and said pivoting member is further provided with pushing portions formed by bottoms of said anchoring grooves, said pushing portions acting upon said pressure receiving portions of said first contacts, respectively, when said pivoting member is being pivotally moved (rotated), wherein when the number of said contacts is a predetermined number or less, said first contacts only are installed in said housing, wherein when the number of said contacts is more than said predetermined number, one or more of said first contacts are each provided with an extended portion located at the tip of the pressure receiving portion of said first contact and extending toward said housing, such type of contacts being named as second contacts, and said pivoting member is further provided with an anchoring hole or holes independent from one another each for receiving the pressure receiving portion of said second contact and said pivoting member is further provided with an engaging rod or rods each engaging said extended portion of said second contact, wherein said second contact is arranged instead of at least one of said first contacts at an arbitrary location so as to prevent said pivoting member from being warped, wherein the anchoring grooves have a different shape from the anchoring hole or holes, and wherein the pushing portions have a different second shape from the engaging rod or rods.

17. The connector as claimed in claim 16, wherein in the case that said engaging rods each comprises a rod portion only, a spacing between the contact portions of said second contacts and said housing is smaller than the thickness of said connecting object.

18. The connector as claimed in claim 16, wherein said engaging rods are each formed as a cam portion having a substantially L-shaped cross-section including the rod portion, and when said pivoting member is pivotally moved about the rod portions of said cam portions as a center of the pivotal movement, the pressure receiving portions of said second contacts are raised by said cam portions.

19. A connector to be detachably fitted with a connecting object, said connector including a required number of contacts each having a contact portion adapted to contact said connecting object and a connection portion to be connected to a substrate, a housing having inserting holes for arranging and holding said contacts inserted in said inserting holes and a fitting opening into which said connecting object is inserted, and a pivoting member mounted on said housing on an opposite side of said fitting opening and acting upon said contacts to bring them into contact with said connecting object, wherein said contacts consists of two kinds, wherein said contacts of said first kind termed as first contacts each comprises a first piece having at one end a contact portion and at another end a pressure receiving portion, a second piece having at an outer end said connection portion, and an elastic portion and a fulcrum portion positioned between said contact portion and said connection portion and jointing said first piece and the another end of said second piece, and said contact portion, said elastic portion, said fulcrum portion and said connection portion being arranged substantially in the form of a crank, wherein said pivoting member is provided with anchoring grooves independent from one another for receiving the pressure receiving portions of said first contacts, respectively, and said pivoting member is further provided with pushing portions formed by bottoms of said anchoring grooves, said pushing portions acting upon said pressure receiving portions of said first contacts, respectively, when said pivoting member is being pivotally moved (rotated), wherein said contacts of a second kind each comprise a first piece having at one end a contact portion and at the other end a pressure receiving portion, a second piece having at one end said connection portion, and an elastic portion and a fulcrum portion positioned between said contact portion and said connection portion and jointing said first piece and the another end of said second piece, and said contact portion, said elastic portion, said fulcrum portion and said connection portion being arranged substantially in a U-shape, and such type of contacts are named as second contacts, wherein said pivoting member is provided with anchoring grooves independent from one another for receiving the pressure receiving portions of said second contacts, respectively, and said pivoting member is further provided with pushing portions formed by bottoms of said anchoring grooves, said pushing portions acting upon said pressure receiving portions of said second contacts, respectively, when said pivoting member is being pivotally moved (rotated), wherein said first and second contacts are alternately arranged to be staggered.

20. The connector as claimed in claim 19, wherein said engaging rods are each formed as a cam portion having a substantially L-shaped cross-section including the rod portion, and when said pivoting member is pivotally moved about the rod portions of said cam portions as a center of the pivotal movement, the pressure receiving portions of said second contacts are raised by said cam portions.

* * * * *